US008424781B2

(12) United States Patent
Rosko et al.

(10) Patent No.: US 8,424,781 B2
(45) Date of Patent: Apr. 23, 2013

(54) POWER SPRAYER

(75) Inventors: Michael Scot Rosko, Greenwood, IN (US); John D. Vogel, Columbus, IN (US); Patrick B. Jonte, Zionsville, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1233 days.

(21) Appl. No.: 11/702,867

(22) Filed: Feb. 6, 2007

(65) Prior Publication Data

US 2007/0194148 A1 Aug. 23, 2007

Related U.S. Application Data

(60) Provisional application No. 60/849,625, filed on Oct. 5, 2006, provisional application No. 60/771,192, filed on Feb. 6, 2006.

(51) Int. Cl.
*A62C 31/00* (2006.01)

(52) U.S. Cl.
USPC ..... 239/449; 239/446; 239/527; 239/528; 239/558; 239/586

(58) Field of Classification Search ..... 239/443–449, 239/525, 526, 527, 528, 562–565, 574, 586, 239/558
See application file for complete search history.

(56) References Cited

U.S. PATENT DOCUMENTS

| | | | | |
|---|---|---|---|---|
| 603,144 | A | 4/1898 | Kellerman et al. | |
| 1,123,189 | A | 12/1914 | Moore et al. | |
| 1,647,983 | A | 11/1927 | Bloch | |
| 2,314,071 | A | 3/1943 | Bucknell et al. | |
| 2,331,741 | A | 10/1943 | Smith | |
| 2,416,737 | A | 3/1947 | Budan | |
| 2,416,747 | A | 3/1947 | Geimer | |
| 2,566,878 | A | 9/1951 | Fahrenkrog et al. | |
| 2,567,176 | A | 9/1951 | Ballard | |
| 2,584,943 | A | 2/1952 | Thomas | |
| 2,842,154 | A * | 7/1958 | Lindsley | 137/270 |
| 2,956,579 | A | 10/1960 | Hannaford | |
| 3,022,015 | A * | 2/1962 | Burch | 239/444 |
| 3,144,878 | A | 8/1964 | Williams | |
| 3,207,443 | A * | 9/1965 | Gilmour | 239/312 |
| 3,341,132 | A | 9/1967 | Parkison | |
| 3,524,591 | A | 8/1970 | Samuels et al. | |
| 3,545,473 | A | 12/1970 | Moia | |
| 3,554,451 | A | 1/1971 | Aghnides | |
| 3,588,040 | A | 6/1971 | Ward | |
| 3,591,083 | A | 7/1971 | O'Rear | |

(Continued)

FOREIGN PATENT DOCUMENTS

| | | |
|---|---|---|
| DE | 3306947 | 8/1984 |
| DE | 3643320 | 7/1988 |

(Continued)

OTHER PUBLICATIONS

International Search Report and Written Opinion for PCT/US2007/061699, 8 pages.

*Primary Examiner* — Christopher Kim
(74) *Attorney, Agent, or Firm* — Faegre Baker Daniels LLP

(57) ABSTRACT

A power sprayer or spray device for use with a faucet. The spray device may include a spray mode and a stream mode of operation.

20 Claims, 51 Drawing Sheets

U.S. PATENT DOCUMENTS

| | | | | |
|---|---|---|---|---|
| 3,656,503 | A | | 4/1972 | Ward |
| 3,682,392 | A | | 8/1972 | Kint |
| 3,685,541 | A | | 8/1972 | Caparone et al. |
| 3,698,644 | A | | 10/1972 | Nystuen |
| 3,722,525 | A | | 3/1973 | Epple |
| 3,722,798 | A | * | 3/1973 | Bletcher et al. ..... 239/428.5 |
| 3,730,440 | A | | 5/1973 | Parkison |
| 3,768,735 | A | | 10/1973 | Ward |
| 3,786,995 | A | | 1/1974 | Manoogian et al. |
| 3,851,825 | A | | 12/1974 | Parkison et al. |
| 3,902,671 | A | | 9/1975 | Symmons |
| 3,944,141 | A | | 3/1976 | Siczek |
| 4,029,119 | A | | 6/1977 | Klieves |
| 4,052,002 | A | | 10/1977 | Stouffer et al. |
| 4,119,276 | A | | 10/1978 | Nelson |
| 4,132,362 | A | | 1/1979 | Hyde et al. |
| 4,145,004 | A | | 3/1979 | Krizik |
| 4,187,986 | A | | 2/1980 | Petrovic |
| 4,221,337 | A | | 9/1980 | Shames et al. |
| 4,224,962 | A | | 9/1980 | Orszullok |
| 4,257,460 | A | | 3/1981 | Paranay et al. |
| 4,396,156 | A | | 8/1983 | Southworth et al. |
| 4,398,669 | A | | 8/1983 | Fienhold |
| 4,421,269 | A | | 12/1983 | Ts'ao |
| 4,461,052 | A | | 7/1984 | Mostul |
| 4,470,546 | A | | 9/1984 | Wildfang |
| 4,516,753 | A | | 5/1985 | Thomsen |
| 4,524,911 | A | | 6/1985 | Rozniecki |
| 4,534,512 | A | | 8/1985 | Chow et al. |
| 4,534,513 | A | | 8/1985 | Aghnides |
| 4,534,514 | A | | 8/1985 | Aghnides |
| 4,541,568 | A | | 9/1985 | Lichfield |
| 4,581,707 | A | | 4/1986 | Millar |
| 4,582,253 | A | | 4/1986 | Gerdes |
| 4,606,370 | A | | 8/1986 | Geipel et al. |
| 4,618,100 | A | | 10/1986 | White et al. |
| 4,619,403 | A | | 10/1986 | Goldney et al. |
| 4,629,124 | A | | 12/1986 | Gruber |
| 4,650,120 | A | | 3/1987 | Kress |
| 4,653,693 | A | | 3/1987 | Steingass |
| 4,666,085 | A | | 5/1987 | Liaw |
| 4,682,728 | A | | 7/1987 | Oudenhoven et al. |
| 4,696,322 | A | | 9/1987 | Knapp et al. |
| 4,700,884 | A | | 10/1987 | Barrett et al. |
| 4,703,893 | A | | 11/1987 | Gruber |
| 4,712,591 | A | | 12/1987 | McCann et al. |
| 4,776,517 | A | | 10/1988 | Heren |
| 4,785,998 | A | | 11/1988 | Takagi |
| 4,789,103 | A | | 12/1988 | Ruhnke |
| 4,795,092 | A | | 1/1989 | Fuller |
| 4,823,409 | A | | 4/1989 | Gaffney et al. |
| 4,830,280 | A | | 5/1989 | Yankoff |
| RE32,981 | E | | 7/1989 | Marty |
| 4,854,498 | A | | 8/1989 | Stayton |
| 4,854,545 | A | | 8/1989 | Pezzarossi |
| 4,869,287 | A | | 9/1989 | Pepper et al. |
| 4,869,427 | A | | 9/1989 | Kawamoto et al. |
| 4,886,210 | A | | 12/1989 | Gaffney et al. |
| 4,893,653 | A | | 1/1990 | Ferrigno |
| 4,909,443 | A | | 3/1990 | Takagi |
| 4,923,116 | A | | 5/1990 | Homan |
| 4,927,115 | A | | 5/1990 | Bahroos et al. |
| 4,934,402 | A | | 6/1990 | Tarney et al. |
| 4,945,943 | A | | 8/1990 | Cogger |
| 4,955,546 | A | | 9/1990 | Liaw |
| 4,986,475 | A | | 1/1991 | Spadafora et al. |
| 4,997,131 | A | | 3/1991 | Heren |
| 5,014,919 | A | | 5/1991 | Knapp |
| 5,040,106 | A | | 8/1991 | Maag |
| 5,052,587 | A | | 10/1991 | Graves |
| 5,069,241 | A | | 12/1991 | Hochstrasse |
| 5,093,943 | A | | 3/1992 | Wei |
| 5,100,055 | A | | 3/1992 | Rokitenetz et al. |
| 5,124,934 | A | | 6/1992 | Kawamoto et al. |
| 5,143,299 | A | | 9/1992 | Simonetti et al. |
| 5,145,114 | A | | 9/1992 | Monch |
| 5,148,824 | A | | 9/1992 | Wilson et al. |
| 5,158,234 | A | | 10/1992 | Magnenat et al. |
| 5,160,086 | A | | 11/1992 | Kuykendal et al. |
| 5,160,092 | A | | 11/1992 | Rose et al. |
| 5,170,361 | A | | 12/1992 | Reed |
| 5,170,816 | A | | 12/1992 | Schnieders |
| 5,172,866 | A | | 12/1992 | Ward |
| 5,184,777 | A | | 2/1993 | Magnenat et al. |
| 5,201,468 | A | | 4/1993 | Freier et al. |
| 5,232,162 | A | | 8/1993 | Chih |
| 5,242,119 | A | | 9/1993 | Jariyasunant |
| 5,255,848 | A | | 10/1993 | Rhodehouse |
| 5,256,287 | A | | 10/1993 | Underwood |
| 5,287,570 | A | | 2/1994 | Peterson et al. |
| 5,323,968 | A | | 6/1994 | Kingston et al. |
| 5,333,792 | A | | 8/1994 | Wang |
| 5,348,228 | A | | 9/1994 | Wang |
| 5,348,231 | A | | 9/1994 | Arnold et al. |
| 5,370,314 | A | | 12/1994 | Gebauer et al. |
| 5,383,604 | A | | 1/1995 | Boesch |
| 5,398,872 | A | | 3/1995 | Joubran |
| 5,433,384 | A | | 7/1995 | Chan et al. |
| 5,445,182 | A | | 8/1995 | Sturman et al. |
| 5,467,927 | A | | 11/1995 | Lee |
| 5,467,929 | A | | 11/1995 | Bosio |
| 5,467,967 | A | | 11/1995 | Gillooly |
| 5,477,885 | A | | 12/1995 | Knapp |
| 5,486,383 | A | | 1/1996 | Nowotarski et al. |
| 5,507,314 | A | | 4/1996 | Knapp |
| 5,542,449 | A | | 8/1996 | Huang |
| 5,630,548 | A | | 5/1997 | Chih |
| 5,634,220 | A | | 6/1997 | Chiu |
| 5,641,120 | A | | 6/1997 | Kuykendal et al. |
| 5,647,537 | A | | 7/1997 | Bergmann |
| 5,649,562 | A | | 7/1997 | Sturman et al. |
| 5,662,273 | A | | 9/1997 | Chih |
| 5,662,276 | A | | 9/1997 | Ko |
| 5,669,558 | A | | 9/1997 | Ichel |
| 5,707,011 | A | | 1/1998 | Bosio |
| 5,722,597 | A | | 3/1998 | Guo |
| 5,732,884 | A | | 3/1998 | Jauner |
| 5,735,467 | A | | 4/1998 | Lee |
| 5,743,286 | A | | 4/1998 | Ko |
| 5,772,120 | A | | 6/1998 | Huber |
| 5,794,854 | A | | 8/1998 | Yie |
| 5,806,770 | A | | 9/1998 | Wang |
| 5,806,771 | A | | 9/1998 | Loschelder et al. |
| 5,813,435 | A | | 9/1998 | Knapp |
| 5,823,229 | A | | 10/1998 | Bertrand et al. |
| 5,829,681 | A | | 11/1998 | Hamel et al. |
| 5,853,130 | A | | 12/1998 | Ellsworth |
| 5,858,215 | A | | 1/1999 | Burchard et al. |
| 5,873,531 | A | | 2/1999 | Wang |
| 5,887,796 | A | | 3/1999 | Dimmer |
| 5,889,684 | A | | 3/1999 | Ben-David et al. |
| 5,906,319 | A | | 5/1999 | Crowl |
| 5,918,816 | A | | 7/1999 | Huber |
| 5,927,333 | A | | 7/1999 | Grassberger |
| 5,937,905 | A | | 8/1999 | Santos |
| 5,944,141 | A | | 8/1999 | Kochan et al. |
| 5,971,299 | A | | 10/1999 | Loschelder et al. |
| 5,975,429 | A | | 11/1999 | Jezek |
| 5,975,432 | A | | 11/1999 | Han |
| 5,979,776 | A | | 11/1999 | Williams |
| 5,984,207 | A | | 11/1999 | Wang |
| 6,000,626 | A | | 12/1999 | Futo et al. |
| 6,000,637 | A | | 12/1999 | Duncan |
| 6,003,170 | A | | 12/1999 | Humpert et al. |
| 6,007,003 | A | | 12/1999 | Wang |
| 6,016,975 | A | | 1/2000 | Amaduzzi |
| 6,019,130 | A | | 2/2000 | Rump |
| 6,029,094 | A | | 2/2000 | Diffut |
| 6,039,269 | A | | 3/2000 | Mandzukic |
| 6,045,062 | A | | 4/2000 | Bosio |
| 6,048,181 | A | | 4/2000 | Chang |
| 6,058,971 | A | | 5/2000 | Palmer et al. |
| 6,059,200 | A | | 5/2000 | Chou |
| 6,076,743 | A | | 6/2000 | Fan |
| 6,085,790 | A | | 7/2000 | Humpert et al. |

6,129,294 A 10/2000 Wang
6,145,757 A 11/2000 Knapp
6,151,729 A * 11/2000 Yean ..... 4/675
6,158,152 A 12/2000 Nathenson et al.
6,164,566 A 12/2000 Hui-Chen
6,173,910 B1 1/2001 Yean
6,173,911 B1 1/2001 Hui-Chen
6,179,130 B1 1/2001 Nguyen et al.
6,216,965 B1 4/2001 Chao
6,220,297 B1 4/2001 Marty et al.
6,230,989 B1 5/2001 Haverstraw et al.
6,234,192 B1 5/2001 Esche et al.
6,247,654 B1 6/2001 Kuo
6,250,570 B1 6/2001 Starr et al.
D445,874 S 7/2001 Czerwinski, Jr. et al.
6,254,016 B1 7/2001 Chao
6,260,772 B1 7/2001 Hennemann, Jr. et al.
6,260,774 B1 7/2001 Erickson
6,290,147 B1 9/2001 Bertrand
6,296,011 B1 10/2001 Esche et al.
6,302,339 B1 10/2001 Chou
6,305,619 B1 10/2001 Thurn
6,315,208 B1 11/2001 Doyle
6,341,389 B2 1/2002 Philipps-Liebich et al.
6,341,738 B1 1/2002 Coles
6,367,710 B2 4/2002 Fan
6,367,711 B1 4/2002 Benoist
6,368,503 B1 4/2002 Williamson et al.
6,370,713 B2 4/2002 Bosio
6,382,529 B1 5/2002 Wu
6,415,958 B1 7/2002 Donley
6,427,931 B1 8/2002 Guo
6,431,468 B1 8/2002 Brown et al.
6,446,875 B1 9/2002 Brooks et al.
6,454,186 B2 9/2002 Haverstraw et al.
6,454,187 B1 9/2002 Wang
6,460,782 B1 10/2002 Wang
6,467,104 B1 10/2002 Shieh
6,471,141 B2 10/2002 Smith et al.
6,471,146 B1 10/2002 Kuykendal et al.
6,484,953 B2 11/2002 Frier
6,502,768 B2 1/2003 Chang
6,508,415 B2 1/2003 Wang
6,513,787 B1 2/2003 Jeromson et al.
6,520,427 B1 2/2003 Chen
RE38,013 E 3/2003 Stouffer
6,540,159 B1 4/2003 Wang
6,540,163 B1 4/2003 Huang
6,561,210 B2 5/2003 Hsieh et al.
6,561,441 B1 5/2003 Hsieh
6,568,605 B1 5/2003 Chen
6,575,196 B1 6/2003 Creswell
6,575,387 B1 6/2003 Baker
6,592,057 B1 7/2003 Ericksen et al.
6,595,440 B2 7/2003 Moriarity et al.
6,612,507 B1 9/2003 Meyer et al.
6,622,945 B1 9/2003 Wu
6,629,645 B2 10/2003 Mountford et al.
6,631,525 B2 10/2003 Piatt et al.
6,634,573 B2 10/2003 Bosch et al.
6,641,060 B2 11/2003 Bratolli et al.
6,641,061 B1 11/2003 Hsieh
6,644,333 B2 11/2003 Gloodt
6,659,373 B1 12/2003 Heren et al.
6,663,022 B1 12/2003 Baker
6,685,110 B2 2/2004 Wang et al.
6,691,933 B1 2/2004 Bosio
6,691,937 B2 2/2004 Heren et al.
6,694,544 B2 2/2004 Piatt et al.
6,705,534 B1 3/2004 Mueller
6,715,699 B1 4/2004 Greenberg et al.
6,719,219 B1 4/2004 Wang
6,730,177 B1 5/2004 Talley et al.
6,738,996 B1 5/2004 Malek et al.
6,739,523 B2 5/2004 Haverstraw et al.
6,749,135 B2 6/2004 Groblebe et al.
6,757,921 B2 7/2004 Esche
6,786,240 B2 9/2004 Ouyoung
6,796,515 B2 9/2004 Heren et al.
6,808,130 B1 10/2004 Ouyoung
6,808,131 B2 10/2004 Bosio
6,811,099 B2 11/2004 Krestine et al.
6,860,438 B1 3/2005 Huang
6,866,208 B2 3/2005 Kao
6,879,863 B2 4/2005 Mueller et al.
6,880,768 B2 4/2005 Lau
6,915,967 B1 7/2005 Chen
6,921,032 B2 7/2005 Habermacher et al.
6,945,474 B1 9/2005 Chen
6,962,298 B1 11/2005 Martin
6,964,404 B2 11/2005 Patterson et al.
6,964,405 B2 11/2005 Marcichow et al.
6,971,591 B2 12/2005 Fleischmann
6,981,661 B1 1/2006 Chen
7,000,266 B2 2/2006 Piatt et al.
7,000,626 B1 2/2006 Cress
7,000,854 B2 2/2006 Malek et al.
7,661,609 B2 * 2/2010 Dexter et al. ..... 239/527
2001/0020302 A1 9/2001 Bosio
2002/0185553 A1 12/2002 Benstead et al.
2002/0190141 A1 12/2002 Huang
2003/0042331 A1 3/2003 Lu
2003/0042337 A1 3/2003 Liang et al.
2003/0125842 A1 7/2003 Chang et al.
2003/0127541 A1 7/2003 Marino
2003/0173423 A1 9/2003 Haenlein et al.
2003/0189111 A1 10/2003 Heren et al.
2004/0010848 A1 1/2004 Esche
2004/0060308 A1 4/2004 Yoshizawa et al.
2004/0074543 A1 4/2004 Dickson et al.
2004/0088786 A1 5/2004 Malek et al.
2004/0112985 A1 6/2004 Malek et al.
2004/0155460 A1 8/2004 Nobili
2004/0164183 A1 8/2004 Nobili
2004/0173688 A1 9/2004 Gloodt
2004/0222320 A1 11/2004 Wu
2004/0227014 A1 11/2004 Williams et al.
2005/0103897 A1 5/2005 Cannon et al.
2005/0121542 A1 6/2005 Su Lim
2005/0145554 A1 7/2005 Cunningham et al.
2005/0161533 A1 7/2005 Nobili
2005/0178857 A1 8/2005 Roman
2005/0178858 A1 8/2005 Roman
2005/0189438 A1 9/2005 Bosio
2005/0204462 A1 9/2005 Cotton et al.
2005/0242210 A1 11/2005 Heren et al.
2006/0016912 A1 1/2006 Nobili
2006/0022071 A1 2/2006 Burnworth et al.
2006/0117477 A1 6/2006 Rosko
2006/0214016 A1 9/2006 Erdely et al.
2006/0255167 A1 11/2006 Vogel et al.
2008/0067264 A1 3/2008 Erickson et al.
2008/0105764 A1 5/2008 Jianglin et al.

FOREIGN PATENT DOCUMENTS

EP 0 251 990 1/1988
EP 0 337 367 10/1989
EP 0 809 539 12/1997
EP 0 933 136 8/1999
EP 0 975 432 2/2000
EP 1 132 141 9/2001
EP 0809539 5/2003
EP 1 354 634 10/2003
EP 1 418 007 5/2004
EP 1 598 116 11/2005
EP 0975432 11/2005
GB 1452974 10/1976
GB 1 555 003 11/1979
GB 2 171 175 8/1986
JP 02-052061 2/1990
JP 9-52061 2/1997
JP 10230192 9/1998
JP 11021956 1/1999
JP 2000027247 1/2000
WO WO 80/01940 9/1980
WO WO 86/06654 11/1986
WO WO 96/25237 8/1996

| | | |
|---|---|---|
| WO | WO 98/46366 | 10/1998 |
| WO | WO 00/32314 | 6/2000 |
| WO | WO 2004/094990 | 11/2004 |
| WO | WO 2004/104305 | 12/2004 |
| WO | WO 2005/018814 | 3/2005 |
| WO | WO 2005/115554 | 12/2005 |

* cited by examiner

POWER SPRAYER

CROSS REFERENCE TO RELATED APPLICATIONS

The present application claims the benefit of U.S. Provisional Patent Application Ser. No. 60/849,625, filed Oct. 5, 2006 and U.S. Provisional Application Ser. No. 60/771,192, filed Feb. 6, 2006, the disclosures of each of the above-identified applications are expressly incorporated by reference herein. Further, the present application is related to U.S. patent application Ser. No. 11/383,267, filed May 15, 2006, now U.S. Pat. No. 7,850,098, which claims the benefit of U.S. Provisional Application Ser. No. 60/680,939, filed May 13, 2005, and the disclosures of each of the above-identified applications are expressly incorporated by reference herein.

BACKGROUND AND SUMMARY OF THE INVENTION

The present invention relates to a power sprayer or side spray of the type used in connection with a kitchen faucet and, more particularly, to a power sprayer including a control mechanism configured to provide a plurality of modes of operation. The present invention further relates to a nozzle assembly configured to generate a continuous sheet-like water shield around a stream of water.

According to an illustrative embodiment of the present disclosure, a spray device for use with a faucet includes a body having a water inlet. A spray head is supported by the body and includes a stream nozzle and a spray assembly. A trigger is supported by the body for movement between a first position and a second position. An activation valve assembly is operably coupled to the trigger, and is configured to seal the water inlet from the spray head when the trigger is in the first position and to provide fluid communication between the water inlet and the spray head when the trigger is in the second position. A button is supported by the body for movement between a first position and a second position. A diverter valve assembly is operably coupled to the button, and is configured to divert water to the spray assembly when the button is in the first position and to divert water to the stream nozzle when the button is in the second position.

According to a further illustrative embodiment, a spray device for use with a faucet includes a body having a water inlet. A spray head is supported by the body and includes a stream nozzle and a spray assembly. A trigger is supported by the body for movement between a first position and a second position. A stem is operably coupled to the trigger. An activation valve assembly and a diverter valve assembly are operably coupled to the stem. A knob is operably coupled to the stem and is configured to move the stem between a first position and a second position. The diverter valve assembly is configured to divert water to the spray assembly when the knob is in the first position and to divert water to the stream nozzle when the knob is in the second position.

According to another illustrative embodiment, a spray device for use with a faucet includes a body having a water inlet. A spray head is supported by the body and includes a stream nozzle and a spray assembly. A sleeve is supported by the body. An activation valve assembly is configured to move between a first position where the water inlet is sealed from the sleeve, and a second position where the water inlet is in fluid communication with the sleeve. A diverter valve assembly includes a piston slidably supported within the sleeve for movement between a spray position where the piston is configured to divert water within the sleeve to the spray assembly, and a stream position where the piston is configured to divert water within the sleeve to the stream nozzle. A stem is slidably supported within the piston and is coupled to the activation valve assembly. The stem includes an engagement member configured to selectively contact and move the piston. A trigger is operably coupled to the stem and is supported by the body for movement between a first position where the activation valve assembly is in the first position and the diverter valve assembly is in the spray position, a second position where the activation valve assembly is in the second position and the diverter valve assembly is in the spray position, and a third position where the activation valve assembly is in the second position and the diverter valve assembly is in the stream position.

According to yet another illustrative embodiment of the present disclosure, a spray device for use with a faucet includes a body having a water inlet and a water outlet. A cartridge assembly is supported by the water outlet and includes an inlet, a first outlet in fluid communication with the inlet and configured to produce a water stream, and a second outlet in fluid communication with the inlet and configured to produce a continuous shield of water extending outwardly in a sheet-like layer around the water stream. A spray assembly is coupled to the cartridge assembly. A trigger is operably coupled to a valve assembly for movement between a plurality of positions. In a first or off position, the valve assembly prevents water flow from the body inlet to the water outlet. In a second or regular spray position, the valve assembly provides a fluid path from the body inlet to a spray assembly. In a third position, the valve assembly provides a fluid path for water from the body inlet to the cartridge assembly.

According to yet another illustrative embodiment of the present disclosure, a spray device comprises a body having a water inlet and a first water outlet in fluid communication with the water inlet and a second water outlet in fluid communication with the water inlet. The body including a head portion having the first water outlet and the second water outlet and a grip portion. The spray device further comprising an actuator supported by the body. The actuator being moveable relative to the body. the spray device further comprising a valve assembly positioned in the grip portion of the body, being translatable relative to the body and being operably coupled to the actuator. In a first position the valve assembly blocks water from the water inlet reaching the first water outlet and the second water outlet when the actuator is in a first position. The valve assembly translates to a second position and permits water from the water inlet to reach the first water outlet and blocks water from the water inlet reaching the second water outlet when the actuator is in a second position. The valve assembly translates to a third position and blocks water from the water inlet reaching the first water outlet and permits water from the water inlet to reach the second water outlet when the actuator is in a third position.

According to still a further illustrative embodiment of the present disclosure, a spray device comprises a body having a water inlet and a first water outlet in fluid communication with the water inlet and a second water outlet in fluid communication with the water inlet. The body including a head portion having the first water outlet and the second water outlet and a grip portion. The spray device further comprising an actuator supported by the body, the actuator being moveable relative to the body. The spray device further comprising a valve assembly positioned in the grip portion and actuated by a movement of the actuator. The valve assembly having a longitudinal axis and a plurality of seals which are positionable in a plurality of positions such that the valve assembly is configured to permit the flow of water from the water inlet to the first water outlet, to permit the flow of water from the water inlet to the second water outlet, to block the flow of water from the water inlet to the first water outlet, and to block the flow of water from the water inlet to the second water outlet. Each of the plurality of seals surrounding the longitudinal axis of the valve assembly and wherein each seal maintains its spacing relative to at least one adjacent seal.

According to still a yet further illustrative embodiment of the present disclosure, a spray device comprises a body having a water inlet and a first water outlet in fluid communication with the water inlet and a second water outlet in fluid communication with the water inlet. The body including a head portion having the first water outlet and the second water outlet and a grip portion. The spray device further comprising an actuator supported by the body. The actuator being moveable relative to the body. The spray device further comprising a first valve assembly positioned in the grip portion and having a first longitudinal axis. The spray device further comprising a second valve assembly positioned in the grip portion and having a second longitudinal axis. The first valve assembly being actuatable by a movement of the actuator and being configured to permit the flow of water from the water inlet to the second valve assembly and to block the flow of water from the water inlet to the second valve assembly and the second valve assembly being configured in a first position to divert water flowing from the first valve assembly to the first water outlet and in a second position to divert water flowing from the first valve assembly to the second water outlet, wherein the longitudinal axis of the second valve assembly is angled relative to the longitudinal axis of the first valve assembly.

According to still a yet another illustrative embodiment of the present disclosure, a spray device comprises a body having a water inlet and a first water outlet in fluid communication with the water inlet and a second water outlet in fluid communication with the water inlet. The body including a head portion having the first water outlet and the second water outlet and a grip portion. The spray device further comprising an actuator supported by the body. The actuator being moveable relative to the body. The spray device further comprising a valve assembly positioned in the grip portion of the body and including a first piston and a second piston connected to the first piston by a link. The valve assembly configured to regulate the flow of water from the water inlet to the first water outlet and the second water outlet. The first piston and the second piston configured to move together.

Additional features and advantages of the present invention will become apparent to those skilled in the art upon consideration of the following detailed description of the illustrative embodiment exemplifying the best mode of carrying out the invention as presently perceived.

DESCRIPTION OF THE DRAWINGS

The detailed description of the drawings particularly refers to the accompanying figures in which.

DETAILED DESCRIPTION OF THE DRAWINGS

Figure 1:
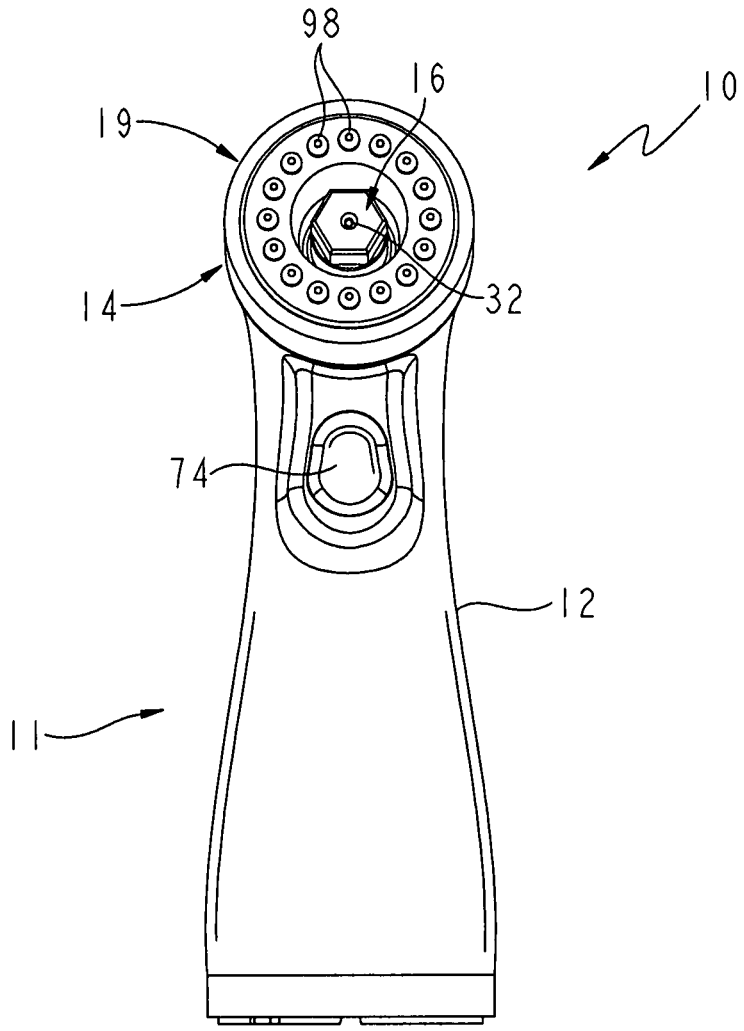
FIG. 1 is front plan view of an illustrative embodiment spray device of the present invention.
Figure 2:
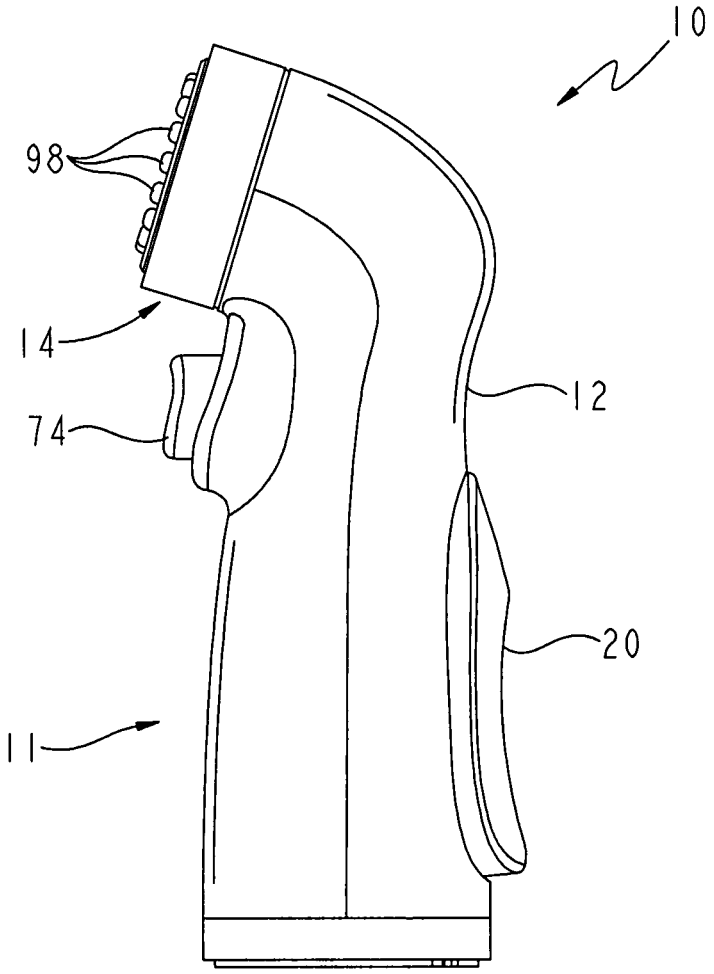
FIG. 2 is a side elevational view of the spray device of FIG. 1.
Figure 3:
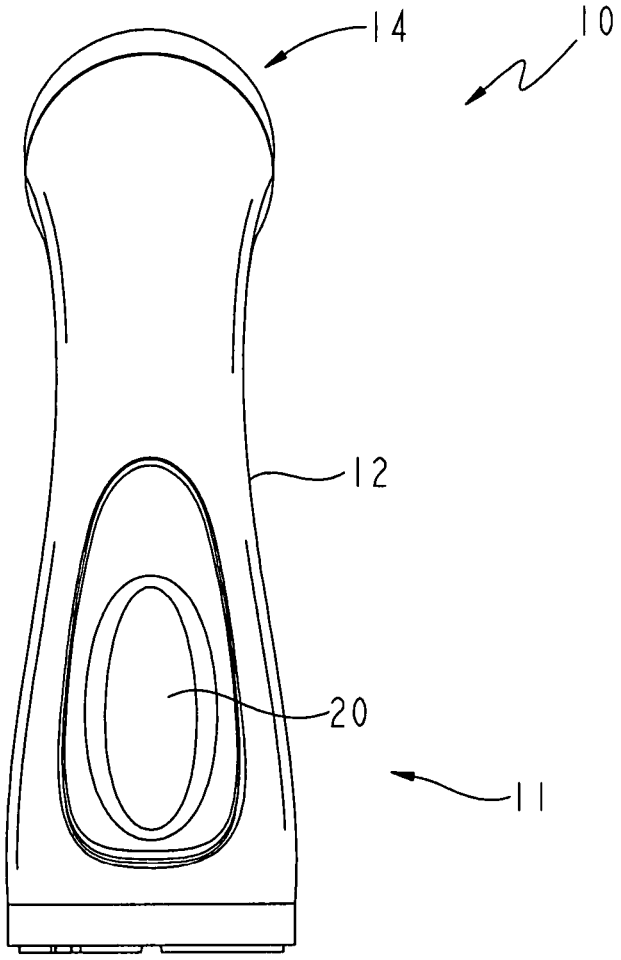
FIG. 3 is a rear plan view of the spray device of FIG. 1.

Referring initially to FIGS. 1-3, an illustrative embodiment power sprayer or spray device 10 includes a body 12 which receives a spray head 14. Illustratively, spray head 14 includes a cartridge assembly 16 threadably received within a spray nozzle assembly 19. In turn, spray nozzle assembly 19 is threadably received within an upper portion of body 12.

Figure 5:
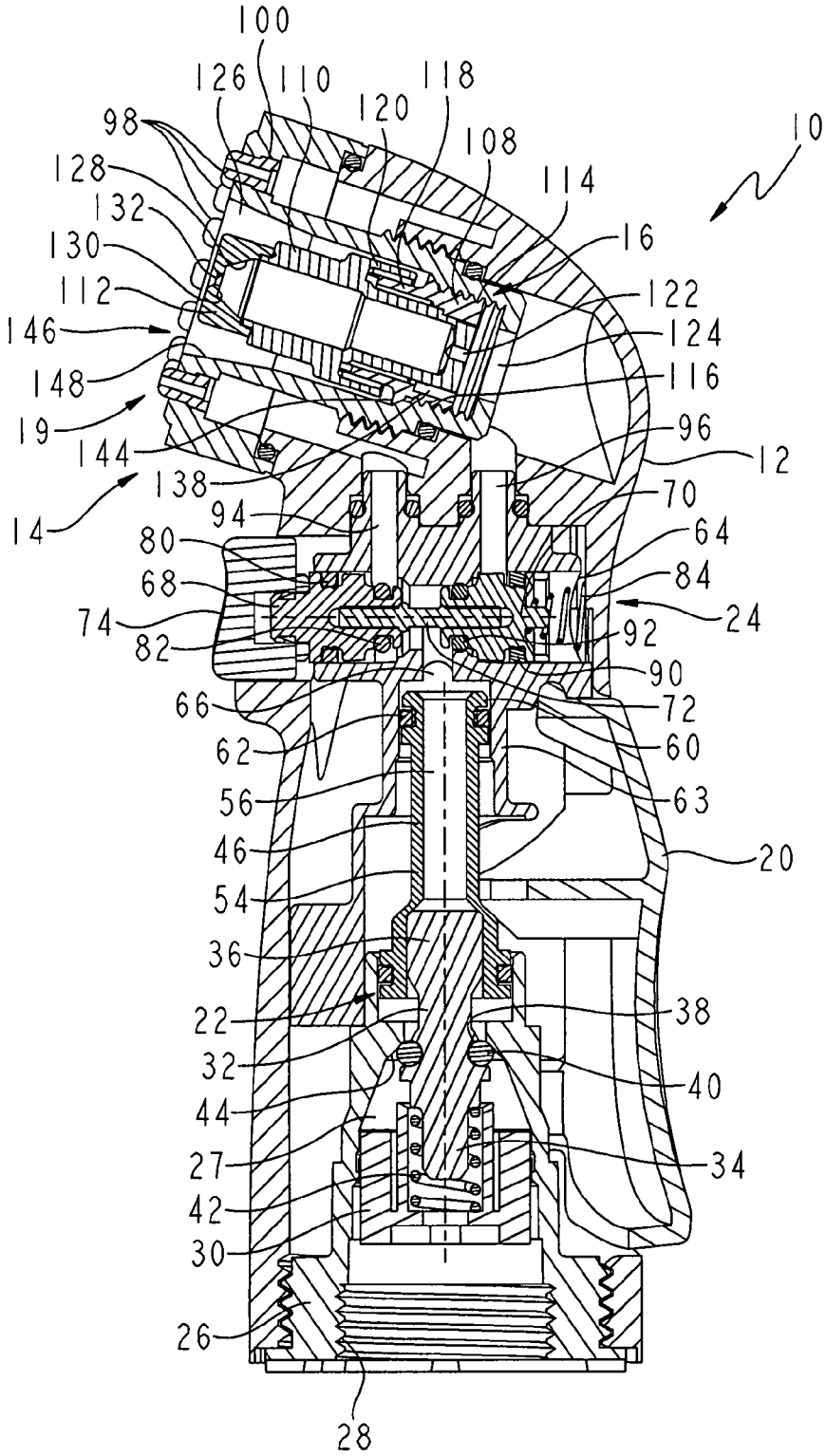
FIG. 5 is a cross-sectional view of the spray device of FIG. 1, showing the activation valve assembly in an inactive or closed position, and the diverter valve assembly in a spray position.
Figure 6:
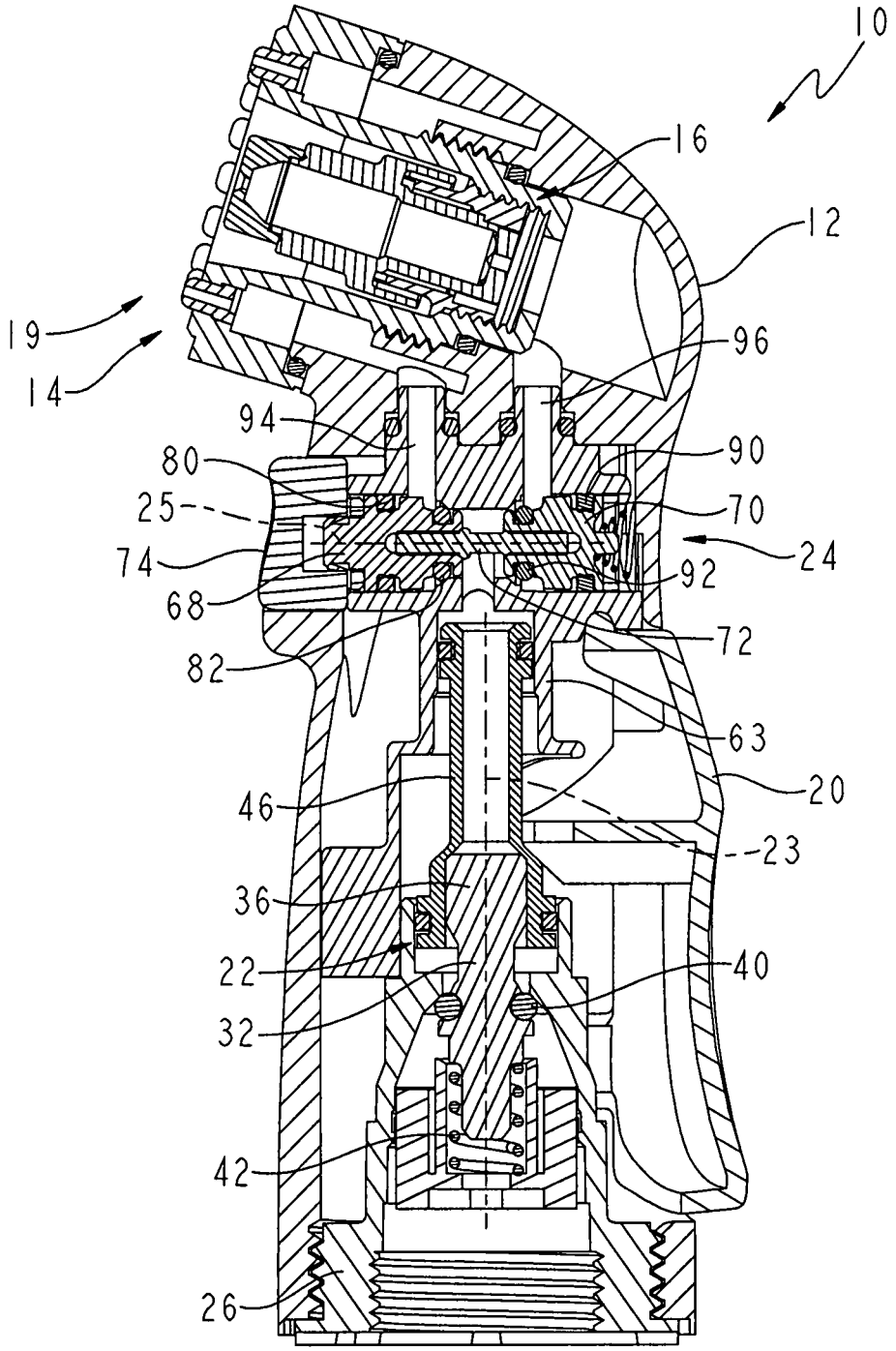
FIG. 6 is a cross-sectional view similar to FIG. 5, showing the activation valve assembly in the inactive position, and the diverter valve assembly in a stream position.

A trigger 20 (see FIG. 2) is supported by body 12 and is operably coupled to an activation valve assembly 22 (see FIG. 5) in order to control the flow of water to a diverter valve assembly 24 (see FIG. 5). In one embodiment, as illustrated in FIG. 6 a longitudinal axis 23 of activation valve is angled relative to a longitudinal axis 25 of diverter valve 24. In the illustrated embodiment, longitudinal axis 23 is oriented vertically and longitudinal axis 25 is oriented horizontally and perpendicular to longitudinal axis 23. Trigger 20 may be actuated by the palm of the operator. A button 74 (see FIG. 2) is supported by body 12 and is operably coupled to the diverter valve assembly 24. Button 74 may be actuated by a finger of the operator. Both trigger 20 and button 74 are provided in a grip portion 11 of spray device 10 and do not require the operator to release spray device 10 to actuate.

Figure 4:
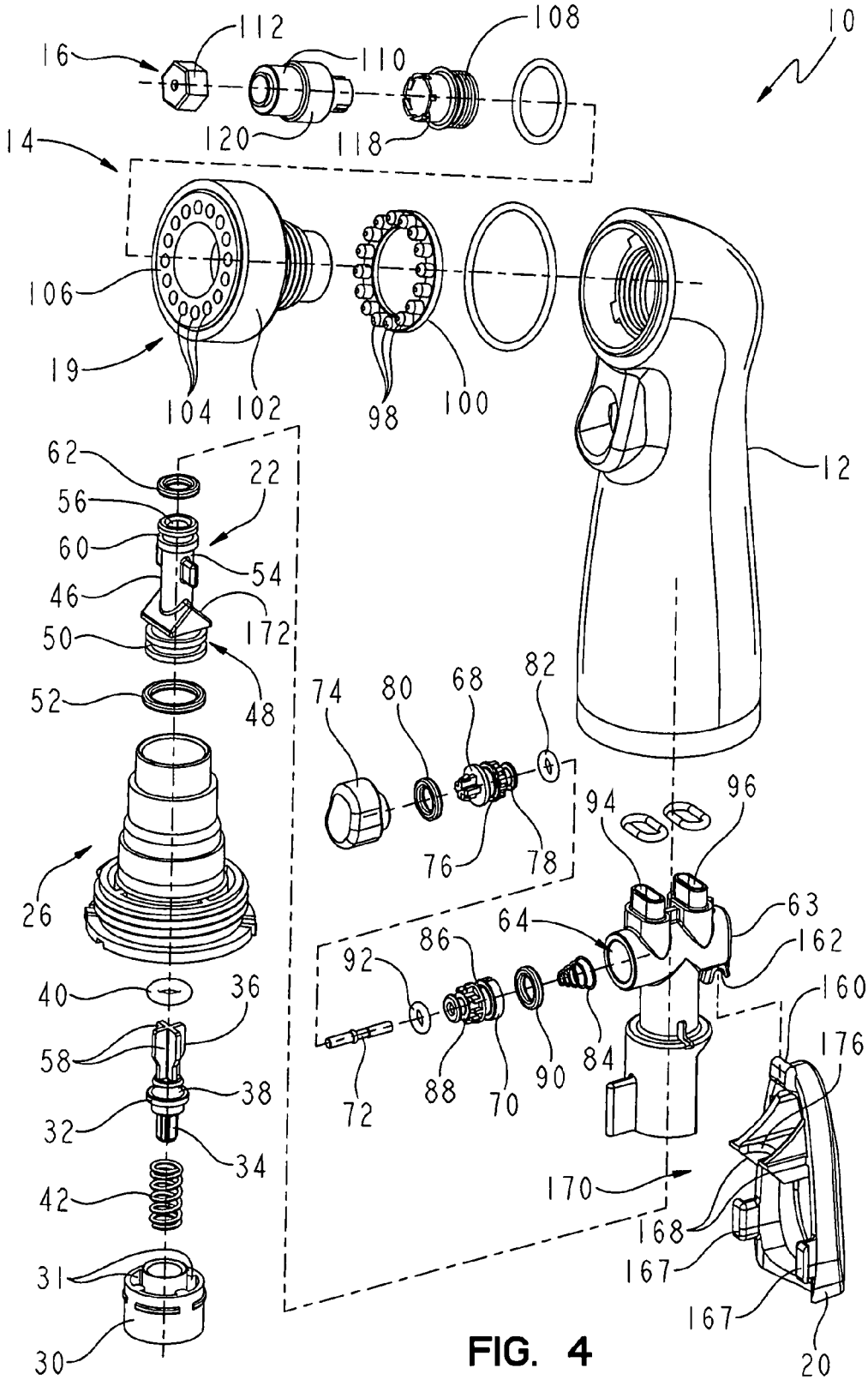
FIG. 4 is an exploded perspective view of the spray device of FIG. 1.

With reference to FIGS. 4 and 5, a lower waterway 26 is threadably received within a lower portion of body 12 and includes a chamber 27 and internal threads 28 configured to be coupled with a conventional conduit or hose (not shown). Activation valve assembly 22 is retained within body 12 by a lower waterway insert 30 which is received within lower waterway 26 and includes a plurality of passageways or channels 31 (see FIG. 4) in fluid communication with chamber 27. Activation valve assembly 22 includes a plunger 32 including a post or lower portion 34 and a cross or upper portion 36. A seal retaining groove 38 is formed intermediate the lower portion 34 and the upper portion 36. A conventional seal, such as an o-ring 40, is received within the retaining groove 38.

A spring 42 is received over lower portion 34 and is configured to bias plunger 32 away from insert 30. More particularly, spring 42 is configured to bias seal 40 against a valve seat 44 defined by lower waterway 26, wherein the activation valve assembly 22 is in an inactive or closed position, as shown in FIG. 5. Upper portion 36 of plunger 32 is coupled to a straw member 46. Straw member 46 includes a lower portion 48 including a retaining groove 50 configured to receive a conventional seal, such as an o-ring 52. Lower portion 48 is slidably received within lower waterway 26. Straw member 46 further includes an upper portion 54 including a passageway or conduit 56 in fluid communication with a plurality of channels 58 formed within upper portion 36 of plunger 32. A retaining groove 60 is formed in upper portion 54 and is configured to receive a conventional seal 62, such as an o-ring, to provide sealing engagement with an upper waterway 63 received within body 12.

With reference to FIGS. 4 and 5, passageway 56 of straw member 46 is in fluid communication with a chamber 64 receiving diverter valve assembly 24 by way of a port 66. Diverter valve assembly 24 includes a front piston 68 coupled to a rear piston 70 through a link 72. Front piston 68 is coupled to a button 74 which extends outwardly from body 12. Front portion 68 includes an outer retaining groove 76 and an inner retaining groove 78 configured to receive seals 80 and 82, respectively. Seals 80 and 82 may comprise conventional o-rings. Rear piston 70 is operably coupled to a spring 84 which biases both front piston 68 and rear piston 70 toward button 74. Rear piston 70 includes an outer retaining groove 86 and an inner retaining groove 88 configured to receive seals 90 and 92, respectively. Again, seals 90 and 92 may comprise conventional o-rings.

Through the movement of diverter valve assembly 24 port 66 may be selectively brought into fluid communication with port 94 of upper waterway 63 and port 96 of upper waterway 63. Port 94 provides selective fluid communication between chamber 64 and spray nozzle assembly 19 while port 96 provides selective fluid communication between chamber 64 and cartridge assembly 16. Although cartridge assembly 16 is illustrated, additional cartridge assemblies may be implemented. Exemplary cartridge assemblies are disclosed in U.S. patent application Ser. No. 11/383,267, filed May 15, 2006 , now U.S. Pat. No. 7,850,098 entitled "POWER SPRAYER" and U.S. Provisional Patent Application Ser. No. 60/680,939, filed May 13, 2005 entitled "POWER SPRAYER", the disclosures of which have been expressly incorporated by reference herein. Diverter valve assembly 24 is slidably moveable within chamber 64 between a spray position (see FIG. 5), where chamber 64 is in fluid communication with port 94, and a stream position (see FIG. 6), where chamber 64 is in fluid communication with port 96. As may be appreciated, spring 84 biases diverter valve assembly 24 to its spray position.

In other words, diverter valve assembly 24 is configured to provide two distinct operational modes. In a first operational mode, water flows into a first passageway 94 for delivery through spray outlets 98. In a second operational mode, the diverter valve assembly 24 has been moved to the right and, as such, water flows through a second passageway 96 and through a cartridge assembly 16. In the illustrated embodiment, cartridge assembly 16 provides a central stream of water surrounded by a continuous shield of water, the central stream having a substantially laminar flow. In one embodiment, the cartridge assembly is configured to provide only a central stream of water. In one example, the central stream is substantially laminar. In another example, the cartridge assembly includes an aerator and the central stream is an aerated stream.

The outer seals 80 and 90 of the front and rear pistons 68 and 70, respectively, have greater diameters and hence, effective cross-sectional areas, than the inner seals 82 and 92. As such, water within chamber 64 provides pressure to assist in operation of the diverter valve assembly 24. More particularly, when the diverter valve assembly 24 is in the spray position (see FIG. 5), water within chamber 64 exerts pressure against outer seal 80 and inner seal 92. The greater area of outer seal 80 causes a net force to be exerted against seal 80 in the direction of button 74, thereby assisting spring 84. Similarly, when diverter valve assembly 24 is in the stream position (see FIG. 6), water within chamber 64 exerts pressure against outer seal 90 and inner seal 82. The greater area of outer seal 90 causes a net force to be exerted against seal 90 in the direction of spring 84, thereby assisting the user in acting against the biasing force exerted by spring 84.

Referring to FIG. 5, spray nozzle assembly 19 is in fluid communication with port 94 and includes a plurality of conventional spray nozzles 98 supported by an annular ring 100 in a circular arrangement around cartridge assembly 16. Ring 100 is supported within a body 102 such that spray nozzles 98 extend through a plurality of circumferentially disposed openings 104 formed in a faceplate 106.

Cartridge assembly 16 is concentrically received within spray nozzle assembly 19 and threadably engages body 102 as shown in FIG. 5. Cartridge assembly 16 is in fluid communication with port 96 and includes a holder 108, a flow straightener 110, and a laminar flow nozzle 112. A first end of holder 108 includes a plurality of external threads 114 configured to threadably engage a plurality of internal threads 116 formed within body 102 of spray nozzle assembly 19. A second end of holder 108 includes a whirl member 118 which cooperates with an annular back deflector 120 formed proximate a center portion of flow straightener 110.

Figure 11:
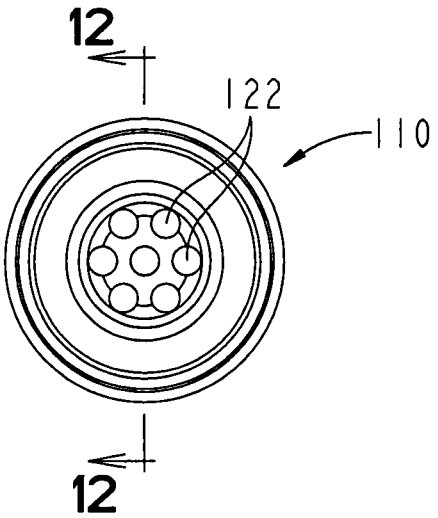
FIG. 11 is front plan view of the flow director of the flow cartridge assembly.

A first end of flow straightener 110 is concentrically received within the first end of holder 108 and includes a plurality of parallel, longitudinally aligned bores 122 (see FIG. 11) configured to receive fluid from port 96 through an inlet 124 (see FIG. 5) formed by body 102. Bores 122 are configured to assist in removing turbulence from fluid flowing there through, and provide a more linear flow to the fluid.

Figure 14:
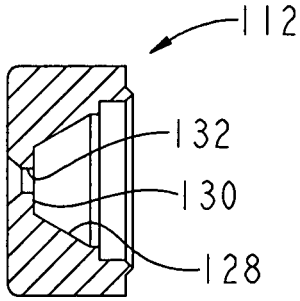
FIG. 14 is a cross-sectional view taken along line 14-14 of FIG. 13.

Flow nozzle 112 is coupled to a second end of flow straightener 110 and includes an outer wall 126 and a tapered or conical inner wall 128. Conical inner wall 128 abuts a substantially planar end wall 130 defining a flow orifice 132, such that water passing there through forms a center water stream 134 (see FIG. 8). Orifice 132 includes sharp entry corners 136 (see FIG. 14) to assist in providing a laminar flow to stream 134. Relative dimensions of flow straightener 110 and flow nozzle 112 are configured to provide laminar flow characteristics to water stream 134. Such relative dimensions are provided in U.S. Provisional Application Ser. No. 60/771,192, filed Feb. 6, 2006, the disclosure of which is expressly incorporated by reference herein.

Figure 10:
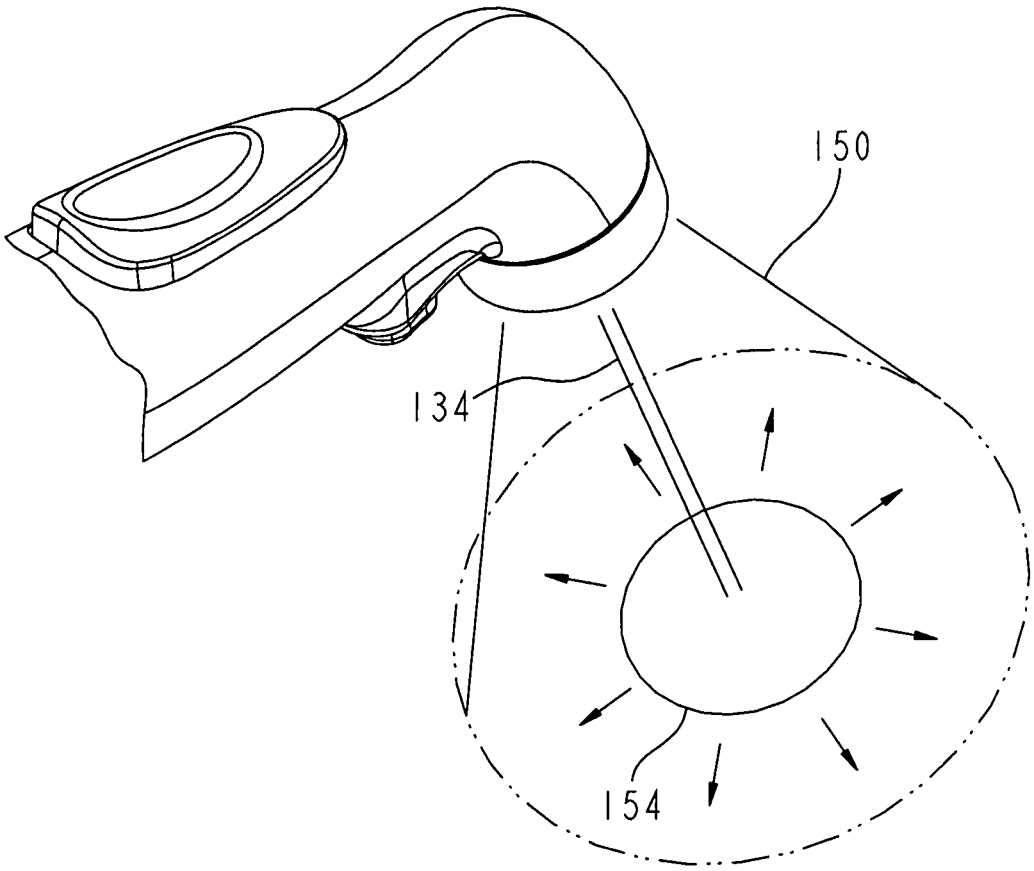
FIG. 10 is a perspective view showing the illustrative laminar stream and water shield of FIG. 8.
Figure 12:
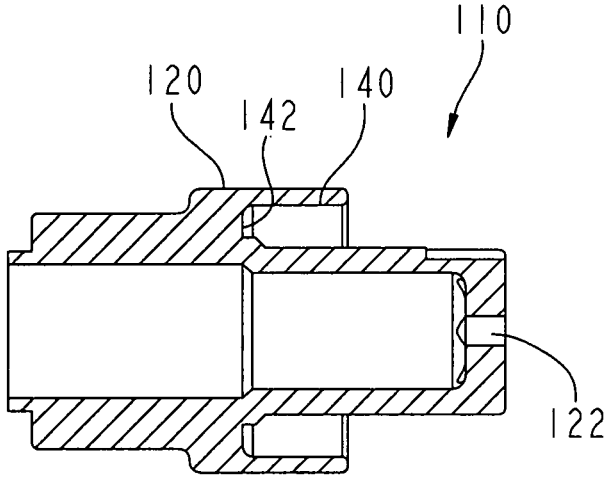
FIG. 12 is a cross-sectional view taken along line 12-12 of FIG. 11.
Figure 13:
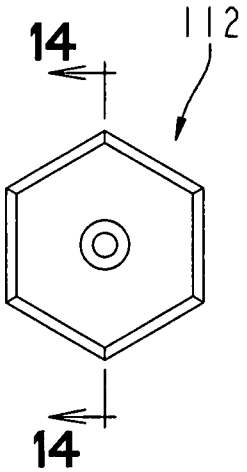
FIG. 13 is a front plan view of the nozzle of the flow cartridge assembly.

A plurality of passageways 138 (see FIG. 5) are formed within holder 108 and are in fluid communication with whirl member 118. Whirl member 118 is configured to impart rotational movement to fluid passing there through. Once the rotational movement is imparted to the fluid, it moves outwardly due to centrifugal force and contacts a side wall 140 (FIG. 12) of back deflector 120. An end wall 142 (FIG. 12) of back deflector 120 directs fluid in a rearward direction, where an end wall 144 formed by holder 108 then redirects the fluid back in a forward direction and toward a shield outlet 146. As the fluid moves toward shield outlet 146, centrifugal force causes it to follow an inner surface 148 of body 102. Due to the well-known Coanda effect, where fluid flowing along a solid surface which is curved slightly from the stream tends to follow the surface, the fluid defines a substantially continuous shield of fluid 150 having a sheet-like appearance (FIG. 10). As shown in FIG. 5, inner surface 148 illustratively includes a flared or angled portion extending toward shield outlet 146. In order to reduce turbulence and to assist in providing a continuous sheet of water within shield 150, inner surface 148 contacted by the rotating fluid should be substantially smooth.

Additional details regarding cartridge assembly 16 and other exemplary cartridge assemblies are provided in U.S. patent application Ser. No. 11/383,267, filed May 15, 2006, now U.S. Pat. No. 7,850,098 entitled "POWER SPRAYER," and U.S. Provisional Patent Application Ser. No. 60/680,939, filed May 13, 2005, the disclosures of which have been expressly incorporated by reference herein.

Figure 8:
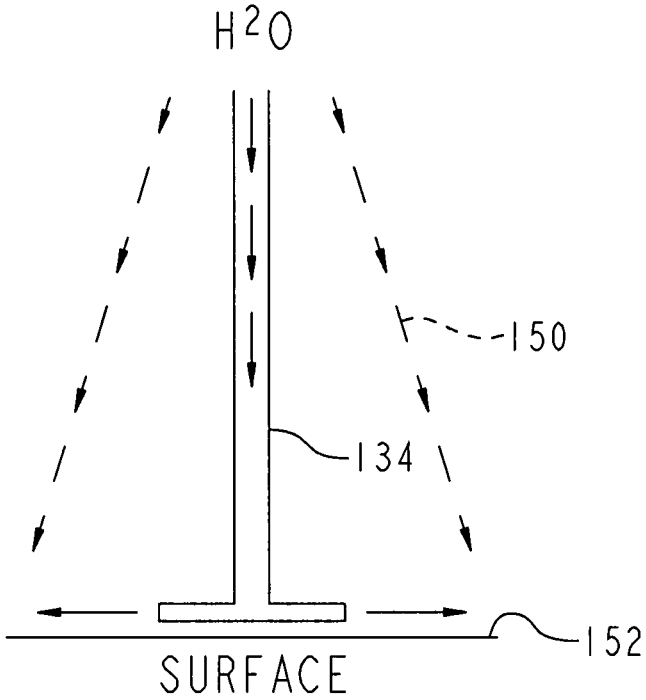
FIG. 8 is a side schematic view showing an illustrative laminar stream and water shield produced by the flow cartridge assembly of the spray device of FIG. 1.
Figure 9:
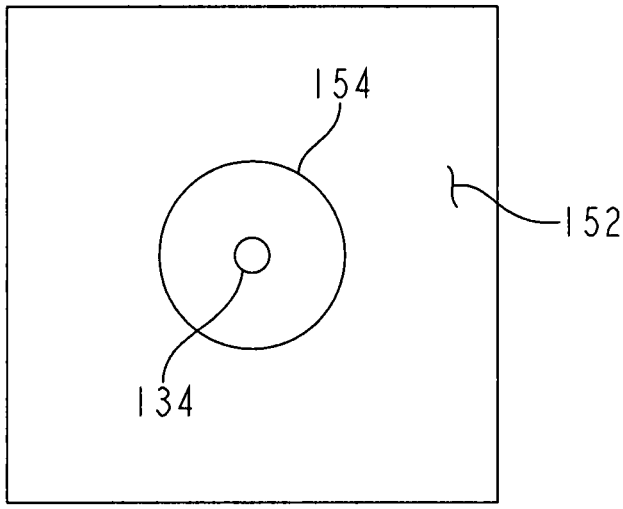
FIG. 9 is a top schematic view showing an illustrative velocity circle formed by the laminar stream.

With further reference to FIGS. 8-10, laminar stream 134 is surrounded by shield 150, which essentially acts as a splash barrier. As laminar stream 134 impacts a surface 152, fluid follows the surface 152 in a direction radially outwardly from the center axis of stream 134. More particularly, the laminar characteristics of stream 134 and the Coanda effect causes the fluid to generate a velocity zone 154, substantially circular, which extends outwardly to mix with fluid from shield 150 impacting surface 152. When laminar stream 134 contacts surface 152, it creates a substantially circular zone 154 (illustratively about 1 inch in diameter) that is of a high pressure and flows parallel to surface 152. Water flow within zone 154 thus tends to strip particles from surface 152 to facilitate cleaning, similar to a mechanical scraping. Further, fluid from stream 134 and from shield 150 combine to form a turbulent flow which also facilitates cleaning of surface 152.

Figure 7:
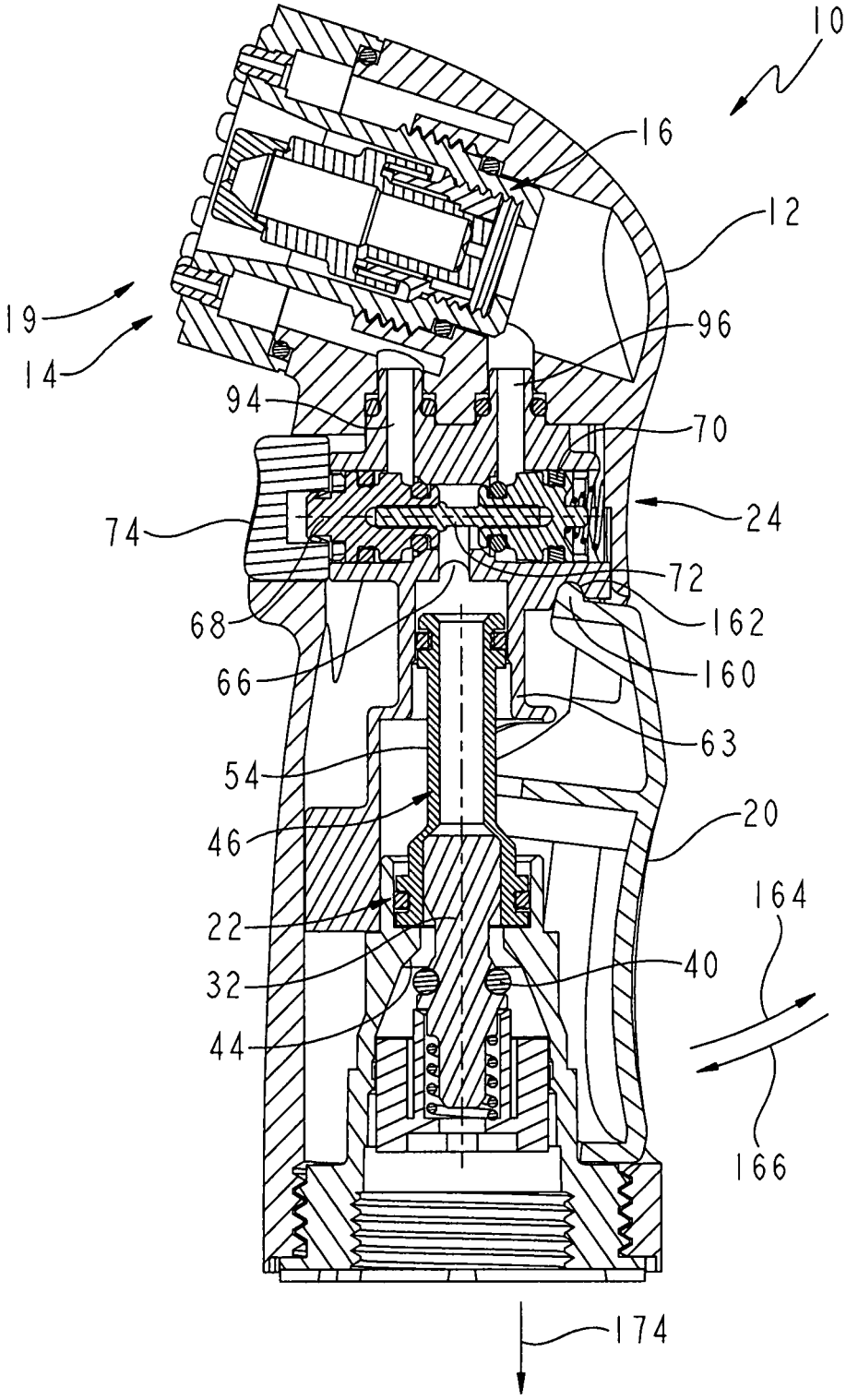
FIG. 7 is a cross-sectional view similar to FIG. 5, showing the activation valve assembly in an active or open position, and the diverter valve assembly in a stream position.

Referring to FIG. 7, button 74 has been depressed placing diverter valve assembly 24 in stream position and trigger 20 has been actuated to open activation valve assembly 22 to bring port 66 into fluid communication with chamber 27. Trigger 20 includes at an upper portion a tab 160 which is received in a recess 162 of waterway assembly 63. Trigger 20 is rotatable about tab 160 in directions 164 and 166. As trigger 20 rotates in direction 164, activation valve assembly 22 is moved to the closed or inactive state illustrated in FIG. 5. Trigger 20 includes stop members 167 which limit the movement of trigger 20 in direction 164. Stop members 167 are illustrated as tabs which abut body 12 to prevent further rotation of trigger 20. As trigger 20 rotates in direction 166, activation valve assembly 22 is moved to the open or active state illustrated in FIG. 7.

Angled surfaces 168 of an engagement member 170 of trigger 20 interact with angled surfaces 172 of straw member 46 to move straw member 46 and plunger 32 in direction 174, thereby moving seal 40 away from valve seat 44. A central portion of straw member 46 is received in a recess 176 formed in engagement member 170 of trigger 20.

Figure 15:
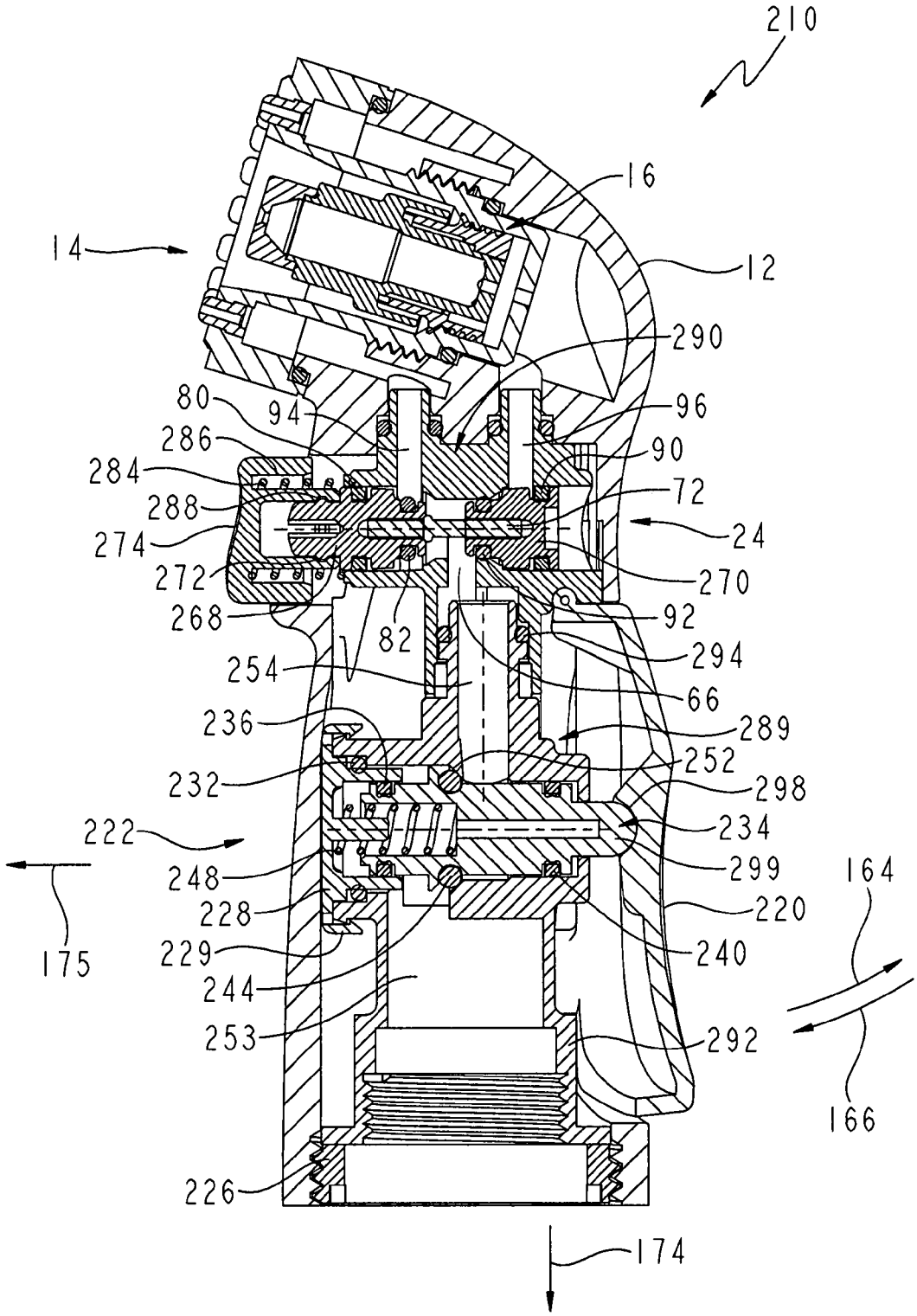
FIG. 15 is a cross-sectional view of a further illustrative embodiment spray device.
Figure 16:
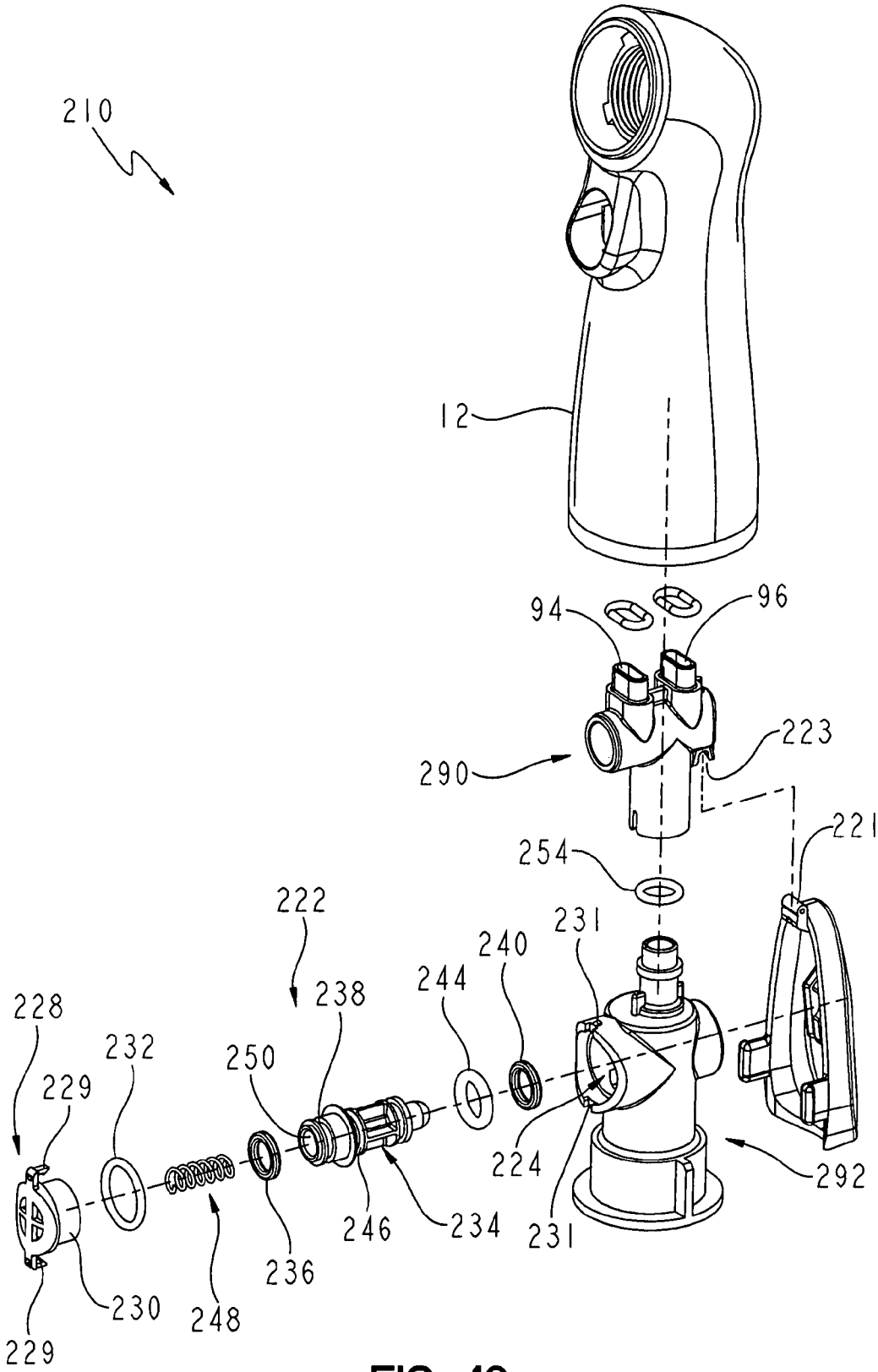
FIG. 16 is a partial exploded view of the spray device of FIG. 15.

A further illustrative embodiment spray device 210 is shown in FIGS. 15 and 16. Like components of spray device 210 and spray device 10 are identified with the same reference numbers. Spray device 210 includes an activation valve assembly 222 operably coupled to a trigger 220. Trigger 220, like trigger 20, includes a tab 221 which is received in a recess 223 of a waterway 289. Waterway 289 is similar to waterway 63, except that waterway 289 includes an upper waterway component 290 and a lower waterway component 292 coupled together through mating portions having a seal 294 interposed there between. Upper waterway component 290 supports diverter assembly 24' and includes ports 66, 94, and 96. Lower waterway component 292 includes a lower fluid conduit 253 which is in fluid communication with a supply of water (not shown) and an upper fluid conduit 254 which is in fluid communication with port 66 of upper waterway component 290.

Activation valve assembly 222 is received within a transverse chamber 224 formed within lower waterway component 292. A retaining insert 228 is received within body 12 and includes a cylindrical portion 230 for receiving a seal 232, such as an o-ring. Retaining insert 228 further includes engagement members 229, illustratively clips, which engage engagement members 231 on lower waterway 292, illustratively a flange, to retain retaining insert 228 relative to lower waterway 292. A plunger 234 is operably coupled to insert 228 and includes a first end slidably received within insert 228. A first outer seal 236 is received within a groove 238 formed within plunger 234 and provides a sliding seal with insert 228. A second outer seal 240 is formed within plunger 234 and provides a sliding seal with lower waterway 292.

An inner seal 244 is received within a groove 246 formed within plunger 234 intermediate outer seals 236 and 240. A spring 248 is received within a bore 250 formed within plunger 234 and biases plunger 234 towards trigger 220. As may be appreciated, pivoting movement of trigger 220 toward body 12 causes plunger 234 to move against spring 248. As such, seal 244 moves away from cooperating valve seat 252 of lower waterway 292, thereby allowing fluid to pass from chamber 253 to passageway 254 and to diverter valve assembly 24. Thus, activation valve 222 is in an open or active state. When seal 224 is seated on valve seat 252, activation valve 222 is in a closed or inactive state. Unlike spray device 10, trigger 220 is directly coupled to plunger 234 and causes the movement of plunger 234 in direction 175 instead of direction 174. Trigger 220 includes a recess 298 which interacts with a head 299 of plunger 234.

Figure 17:
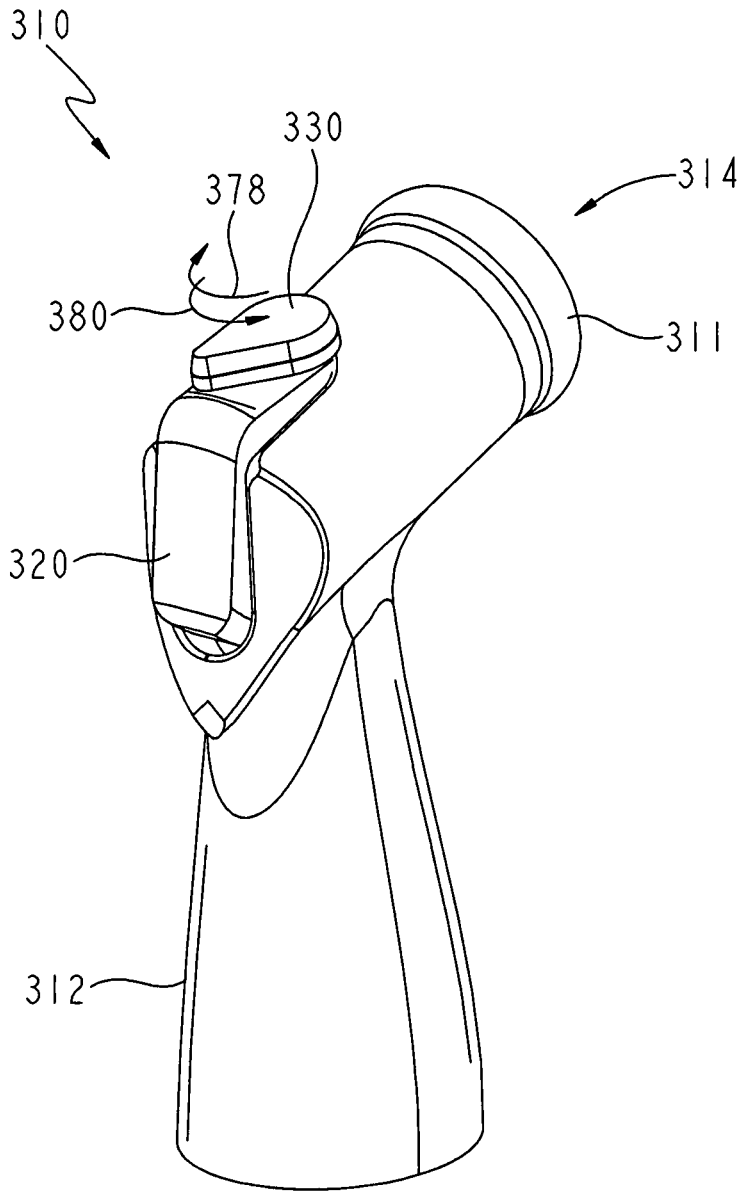
FIG. 17 is a rear perspective view of a further illustrative embodiment spray device.
Figure 18:
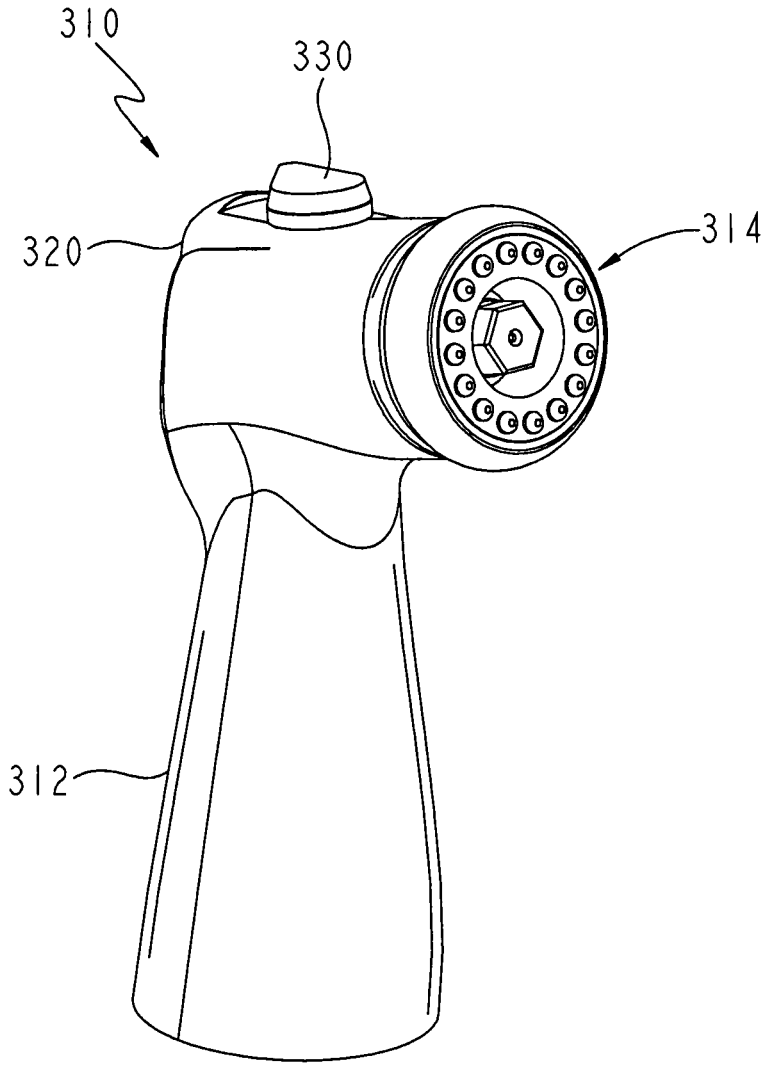
FIG. 18 is a front perspective view of the spray device of FIG. 17.

Diverter valve assembly 24' and spray head 14 are similar to that detailed above with respect to FIGS. 1-14. Diverter valve 24' operates generally the same as diverter valve 24, except that the shape of pistons 268 and 270 are altered from pistons 68 and 70. Piston 270 does not include a stud to locate spring 284 because spring 284 has been moved to a location directly behind button 274 and is compressed between a recess 286 of trigger 274 and upper waterway 290. Piston 268 includes an engagement member 272, illustratively a ridge, which interacts with an engagement member 288, illustratively a recess, of button 274. A further embodiment of spray device 210 is illustrated (see FIGS. 17 and 18) and described in U.S. Provisional Application Ser. No. 60/771,192, filed Feb. 6, 2006, the disclosure of which is expressly incorporated by reference herein.

A further illustrative embodiment spray device 310 is shown in FIGS. 17-25 as including a body 312 which receives a spray head 314. Spray head 314 is similar to spray head 14 detailed above in connection with FIGS. 1-14 except that spray head 314 is retained relative to body 312 through a cap 311 threaded onto body 312. In one embodiment, sprayhead 314 is replaced with sprayhead 14.

Figure 19:
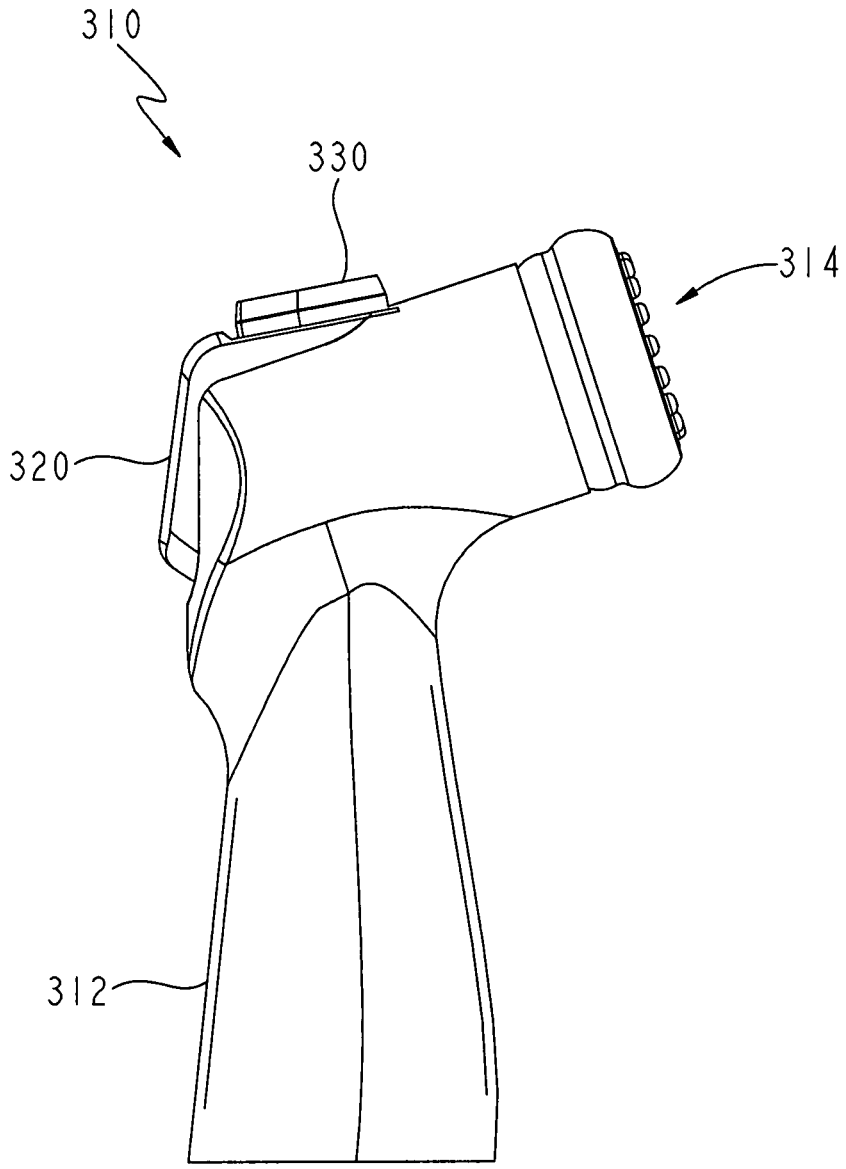
FIG. 19 is a side elevational view of the spray device of FIG. 17.

A trigger 320 is supported by body 312 and is operably coupled to an activation valve assembly 322 (FIG. 19) and a diverter valve assembly 324 (FIG. 19). More particularly, a stem 326 includes a lower end coupled to a poppet valve 328 of activation valve assembly 322, and an upper end coupled to a rotatable knob 330 supported by trigger 320.

Figure 21:
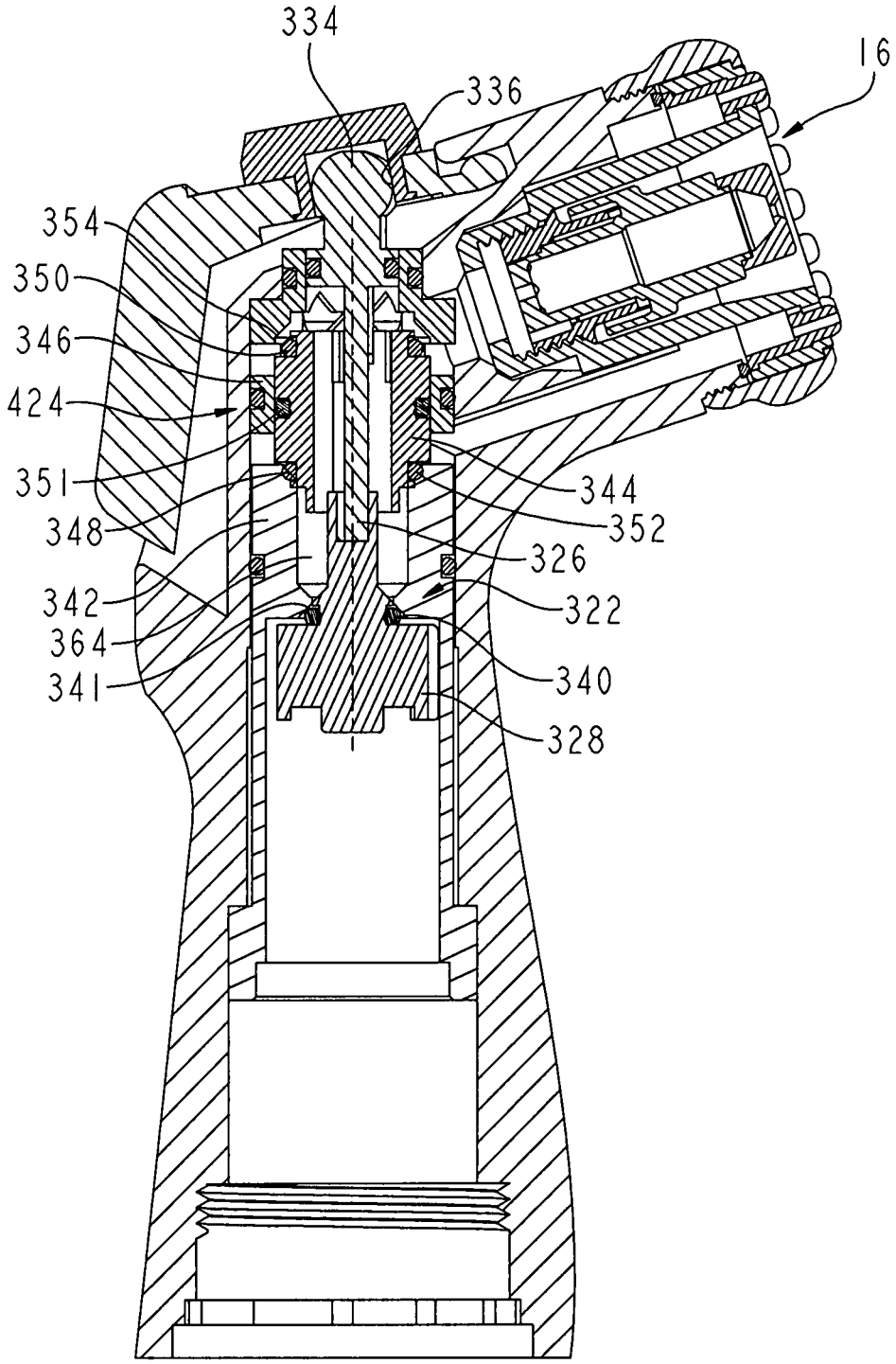
FIG. 21 is a cross-sectional view similar to FIG. 20, showing the activation valve assembly in the inactive position, and the diverter valve assembly in a stream position.
Figure 22:
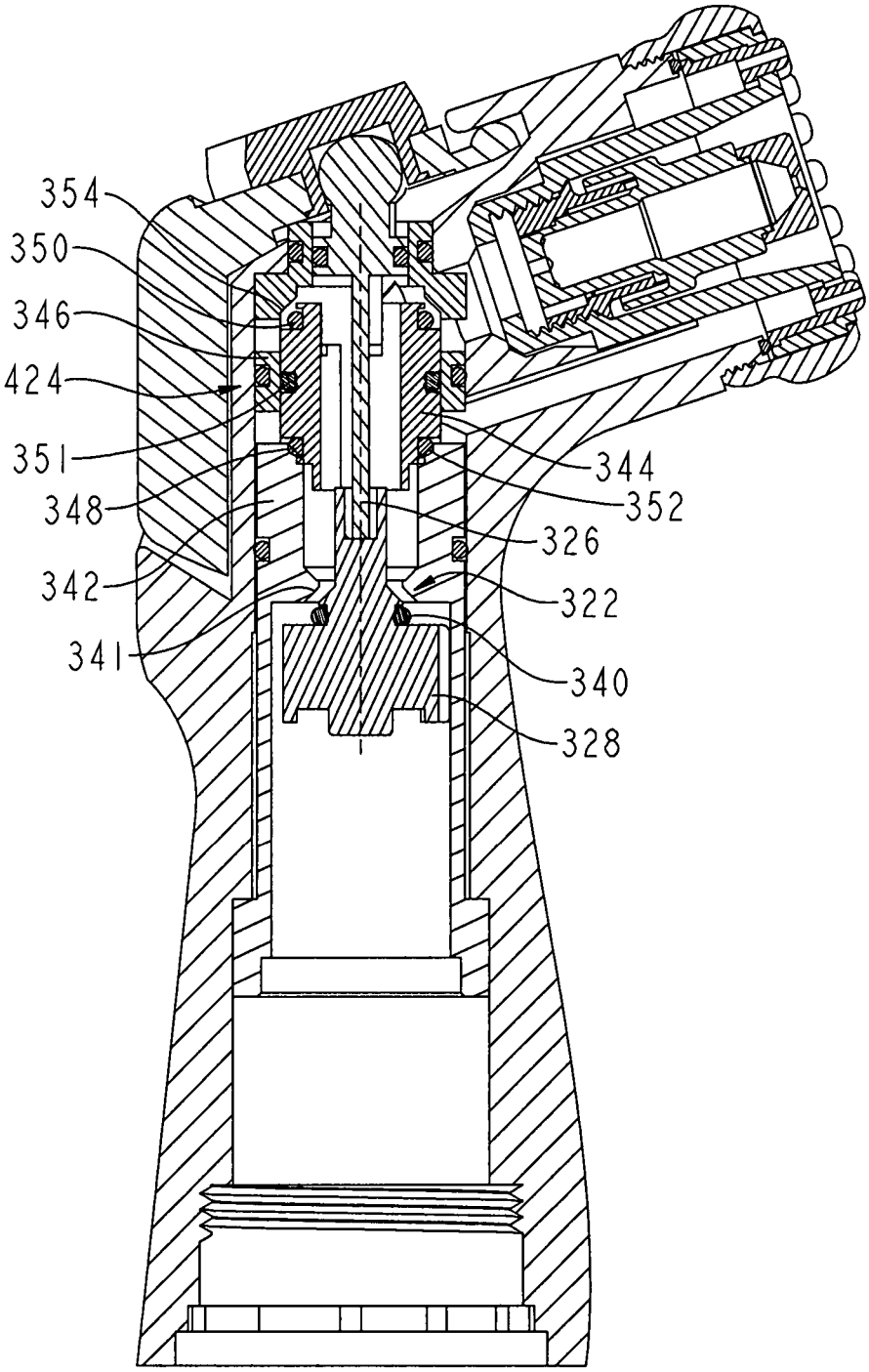
FIG. 22 is a cross-sectional view similar to FIG. 20, showing the activation valve assembly in an active or open position, and the diverter valve assembly in a spray position.

Trigger 320 includes a tab 370 which is received in a recess 372 of body 312 and is rotatable is directions 374 and 376. As explained herein, by rotating trigger 320 in direction 374, activation valve 322 is moved from a closed or inactive state (as shown in FIG. 19) to an open or active state (as shown in FIG. 21).

Knob 330 controls the state of diverter valve 324. Referring to FIG. 16, knob 330 is rotatable in directions 378 and 380. As explained herein, by rotating knob 330 in direction 378 diverter valve assembly 324 is positioned in a spray configuration and by rotating knob 330 in direction 380 diverter valve assembly 324 is positioned in a stream configuration.

Figure 20:
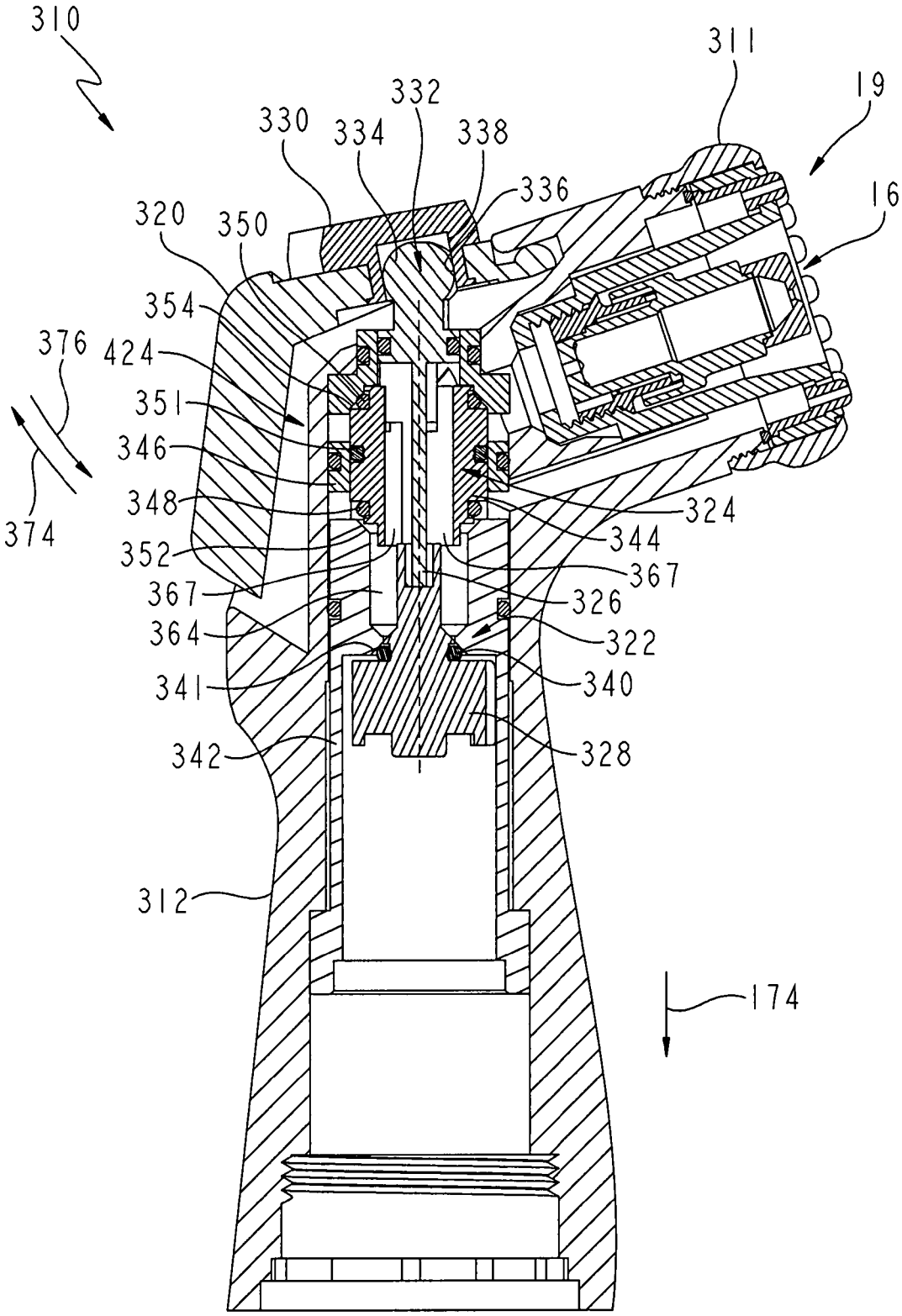
FIG. 20 is a cross-sectional view of the spray device of FIG. 17, showing the activation valve assembly in an inactive or closed position, and the diverter valve assembly in a spray position.

Referring to FIG. 20, coupler 332, illustratively a ball 334 with flats 336, is supported on the upper end of stem 326. Flats 336 cooperate with corresponding flats 338 formed within knob 330. As such, when knob 330 is rotated, stem 326 is rotated. As explained herein, the rotation of stem 326 causes the selection of a spray configuration of diverter valve 324 and a stream configuration of diverter valve 324.

With reference to FIGS. 20-23, poppet valve 328 includes a seal 341 configured to seal against a valve seat 340 formed by a lower sleeve 342. Diverter valve assembly 324 includes a piston 344 configured to move relative to lower sleeve 342 and an upper sleeve 346. Outer seals 348 and 350 are supported by piston 344 and are configured to selectively seal with valve seat 352 defined by lower sleeve 342 and with valve seat 354 defined by upper sleeve 346, respectively. Similarly, an inner seal 351 is supported by piston 344 and provides a sliding seal with upper sleeve 346.

Figure 24:
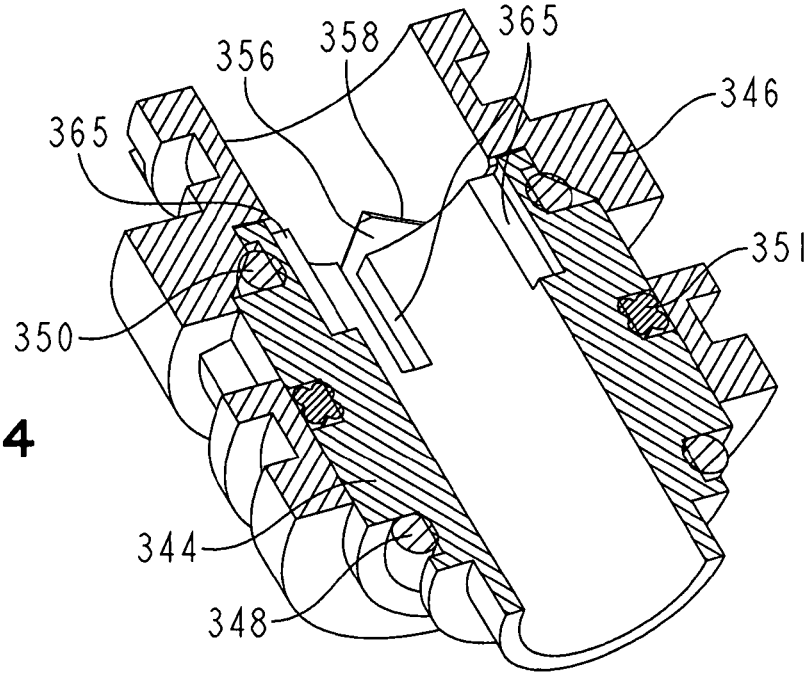
FIG. 24 is a perspective view, in cross-section, of the diverter piston and the diverter sleeve in spray position.
Figure 25:
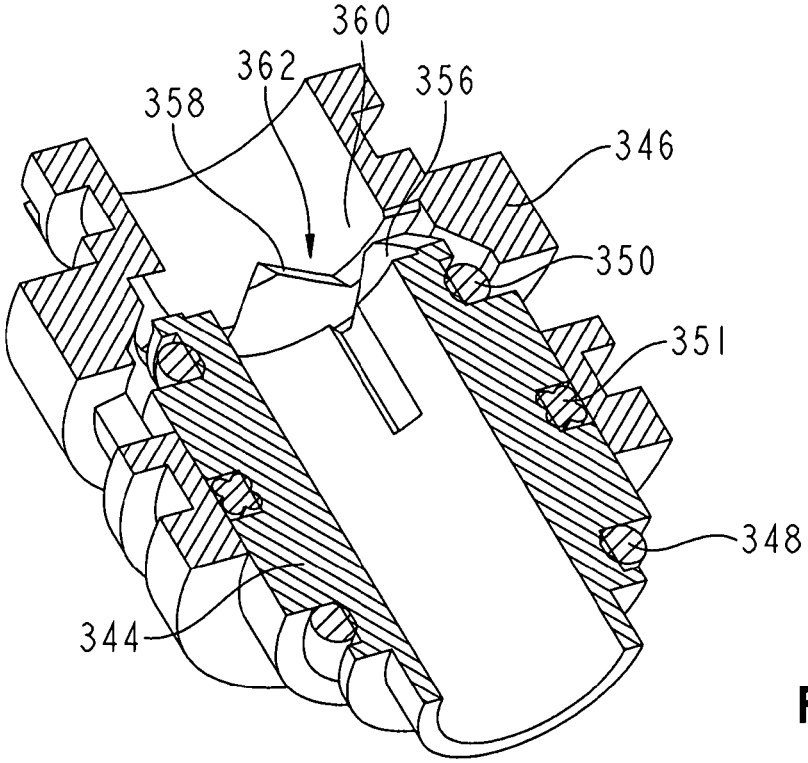
FIG. 25 is a perspective view, in cross-section, similar to FIG. 24, showing the diverter sleeve in a stream position.
Figure 26:
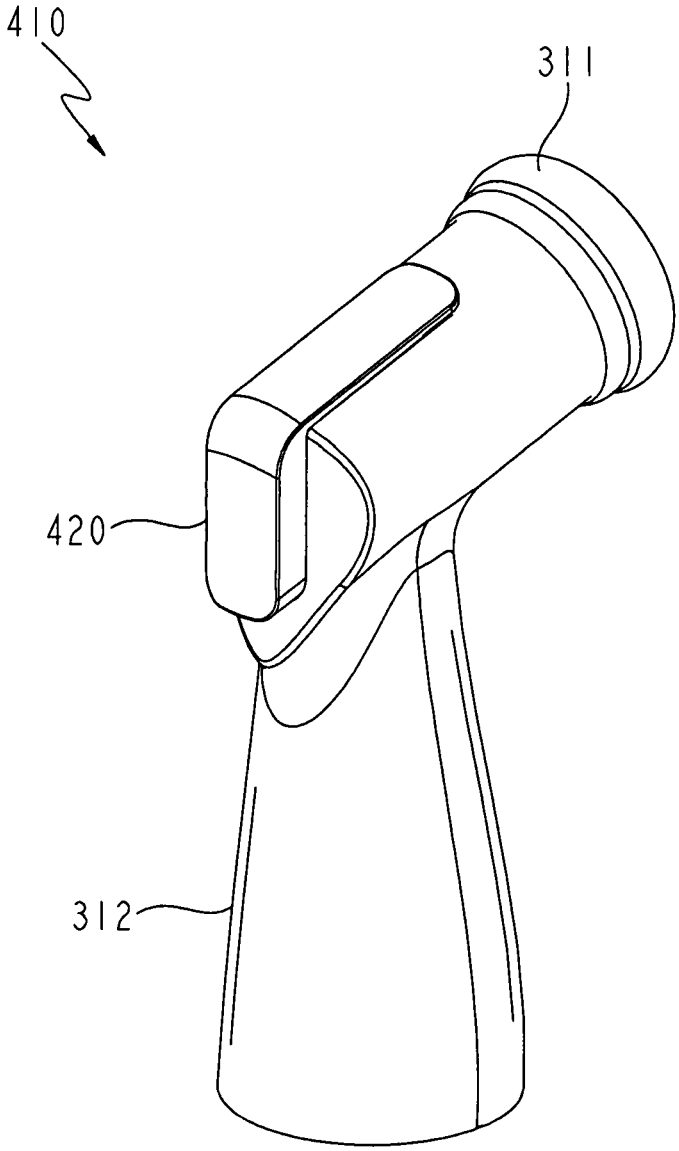
FIG. 26 is a rear perspective view of a further illustrative embodiment spray device.
Figure 27:
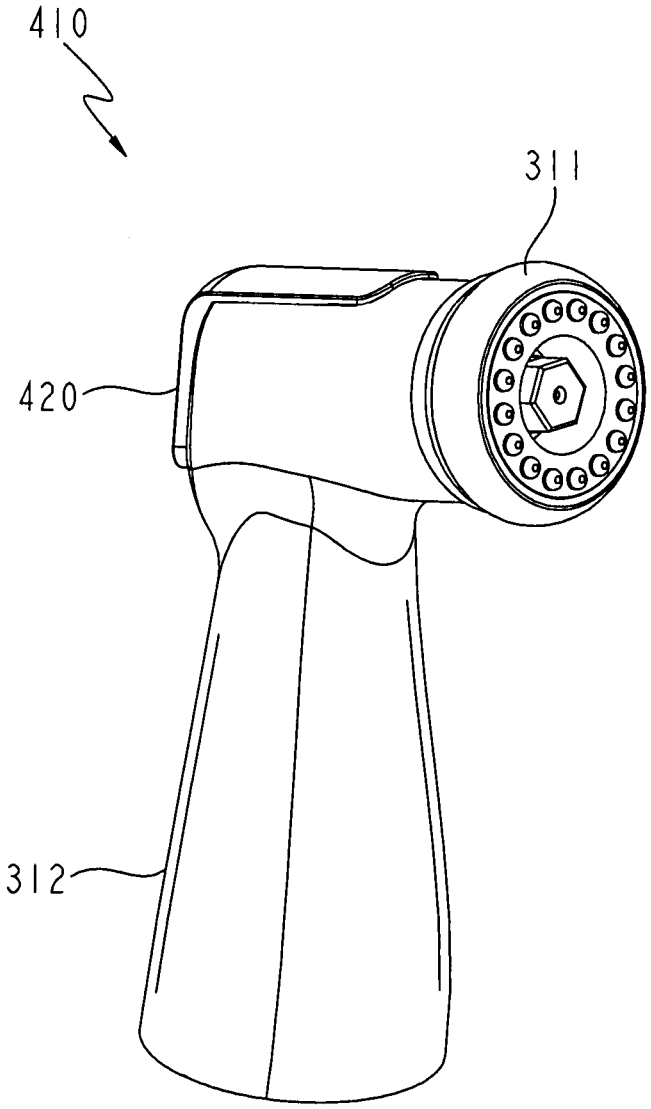
FIG. 27 is a front perspective view of the spray device of FIG. 26.
Figure 28:
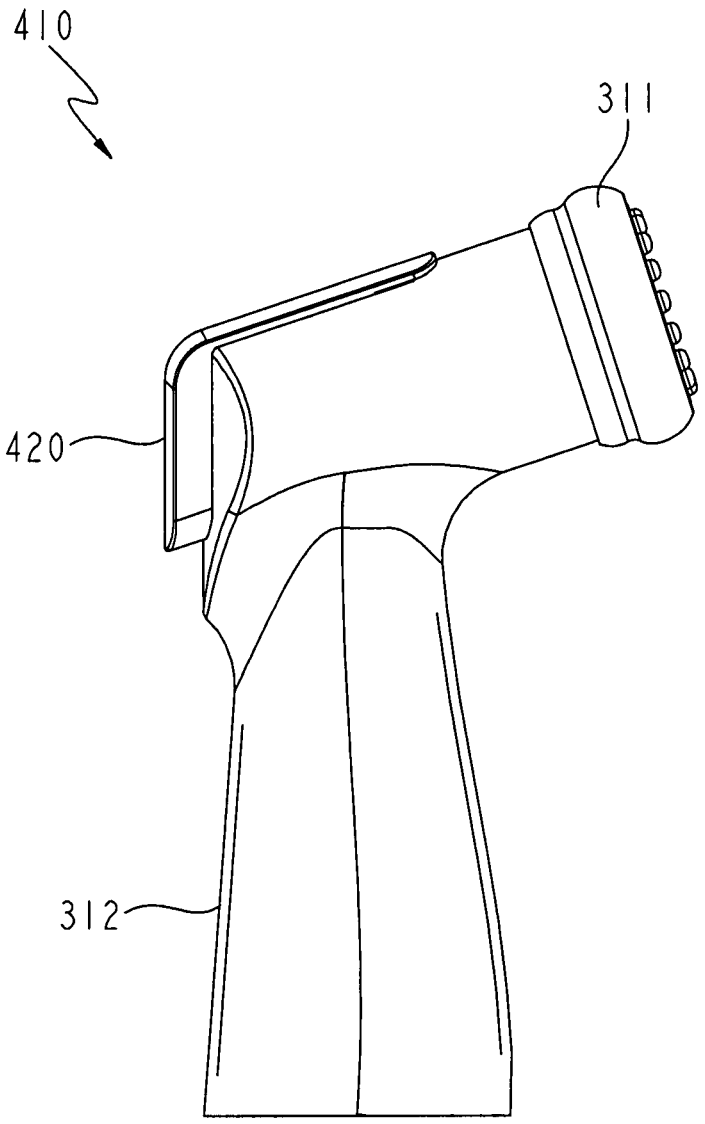
FIG. 28 is a side elevational view of the spray device of FIG. 26.

With reference to FIGS. 24 and 25, piston 344 includes a plurality of circumferentially spaced cam surfaces 356 extending upwardly from an upper end and configured to selectively engage cam recesses 358 and extensions 360 defined by a flange 362 of upper sleeve 346. Cam surfaces 356 and cooperating recesses 358 are illustratively angularly spaced every 45 degrees. Further, piston 344 includes engagement members 365, illustratively slots, which interact with engagement members 363 of stem 326, illustratively tabs, to couple piston 344 to stem 326. As such, rotation of stem 326 by 45 degrees causes piston 344 to move from a spray position as shown in FIG. 20, to a stream position as shown in FIG. 21.

More particularly, in the spray position of FIG. 20, the spray nozzle assembly 19 is in fluid communication with the interior chamber 364 of lower sleeve 342, since seal 348 is in spaced relation to seat 352. When knob 330 is rotated by 45 degrees, stem 326 causes piston 344 to rotate such that cam surfaces 356 are forced down by engagement with extensions 360 of upper sleeve 346. As shown in FIG. 21, seal 348 engages seat 352, while seal 350 is positioned in spaced relation to a seat 354. Cartridge assembly 16 is therefore in fluid communication with interior chamber 364 of lower sleeve 342. Water passes through the channels 367 formed in stem 326 due to a cross shape of stem 326 similar to passages 58 of spray device 10.

In both orientations of piston 344, stream and spray, when trigger 320 is depressed (rotated in direction 374), a trigger 320 forces coupler 332 and stem 326 downwardly in direction 174 such that poppet valve 328 no longer seals against valve seat 340.

Figure 23:
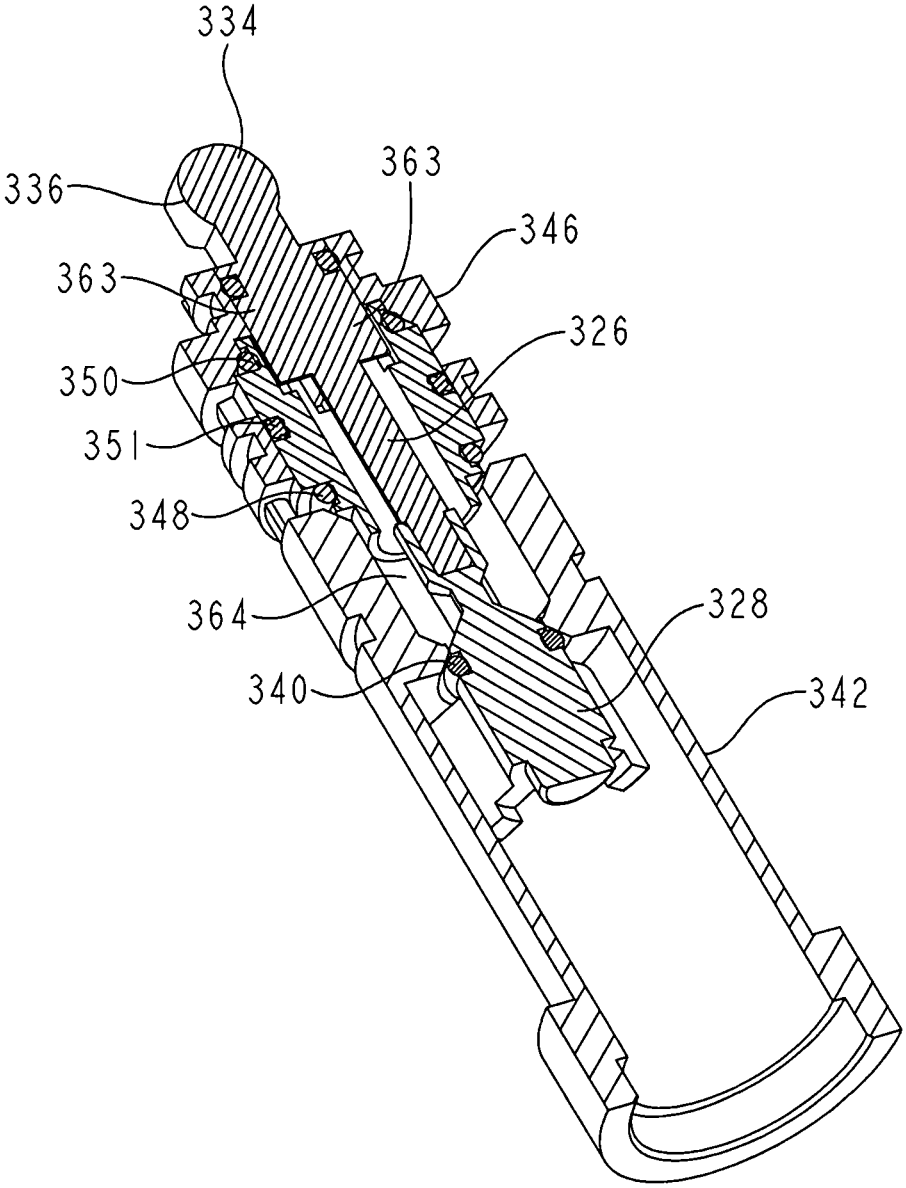
FIG. 23 is a perspective view, in cross-section, of the activation valve assembly operably coupled to the diverter valve assembly.

With reference to FIGS. 23-25, inner seal 351 has a greater diameter and therefor a greater effective cross-sectional area than outer seal 348 or 350. Given the difference in areas, inner seal 351 provides a hydro-balancing effect to piston 344. More particularly, when in the spray position, water pressure will force piston 344 upwardly and away from poppet valve 328. When in the stream position (FIG. 24), water pressure will force piston 344 downwardly in the direction of poppet valve 328.

A further embodiment designated spray device 310 is illustrated and described in U.S. Provisional Application Ser. No. 60/771,192 (see FIGS. 19-29), filed Feb. 6, 2006, the disclosure of which is expressly incorporated by reference herein.

A further illustrative embodiment spray device 410 is shown in FIGS. 26-32. Like components of spray device 410 and spray device 310 are identified with the same reference numbers. A trigger 420 is supported by body 312 and is operably coupled to an activation valve assembly 322 and a diverter valve assembly 424. More particularly, a stem 426 includes a lower end coupled to a poppet valve 328 of activation valve assembly 322, and an upper end 427 supporting a cam surface 428 configured to engage a cam surface 429 of trigger 420. An engagement member, illustratively an annular disc 432, is supported by stem 326 above diverter valve member assembly 324 for selective movement therewith.

Diverter valve assembly 324 includes a piston 444 configured to move within a lower sleeve 342 and an upper sleeve 346. Outer seals 348 and 350 are supported by piston 344 and are configured to selectively seal with valve seat 352 defined by lower sleeve 342 and with valve seat 354 defined by upper sleeve 346, respectively.

Figure 29:
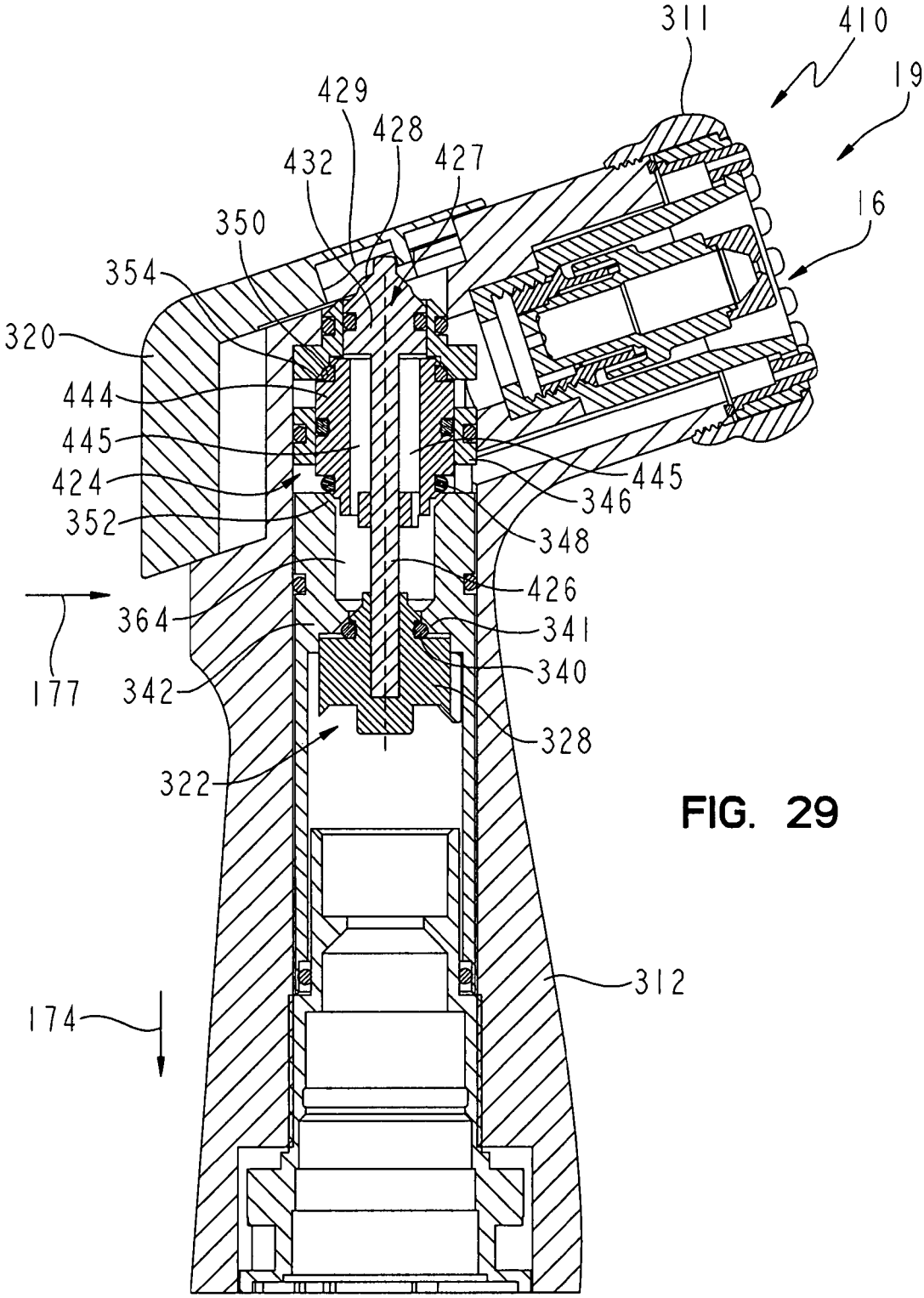
FIG. 29 is a cross-sectional view of the spray device of FIG. 26, showing the activation valve assembly in an inactive or closed position, and the diverter valve assembly in a spray position.
Figure 30:
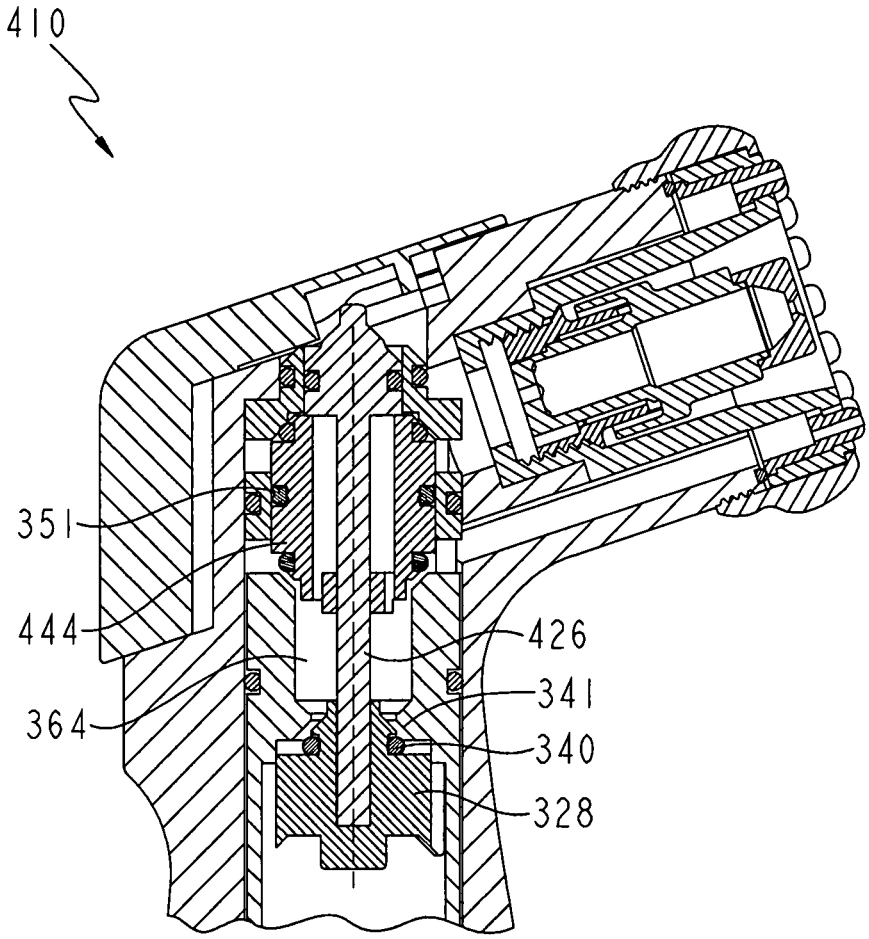
FIG. 30 is a cross-sectional view similar to FIG. 29, showing the activation valve assembly in an active or open position, and the diverter valve assembly in the spray position.
Figure 31:
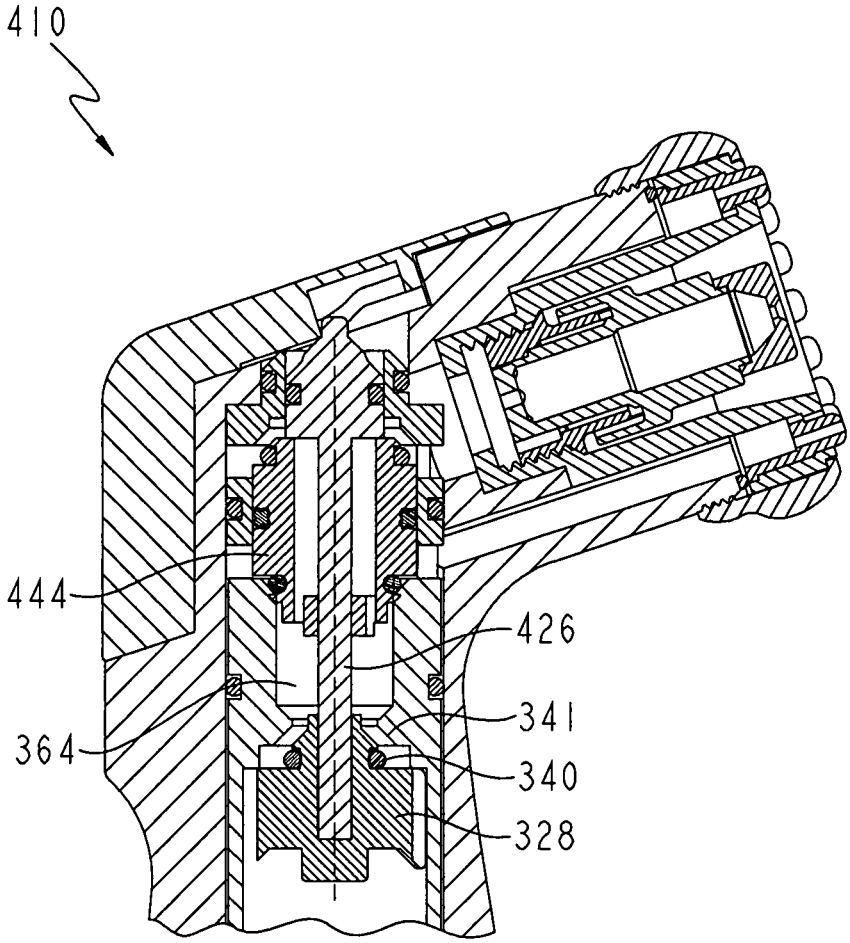
FIG. 31 is a cross-sectional view similar to FIG. 29, showing the activation valve assembly in an active or open position, and the diverter valve assembly in a stream position.
Figure 32:
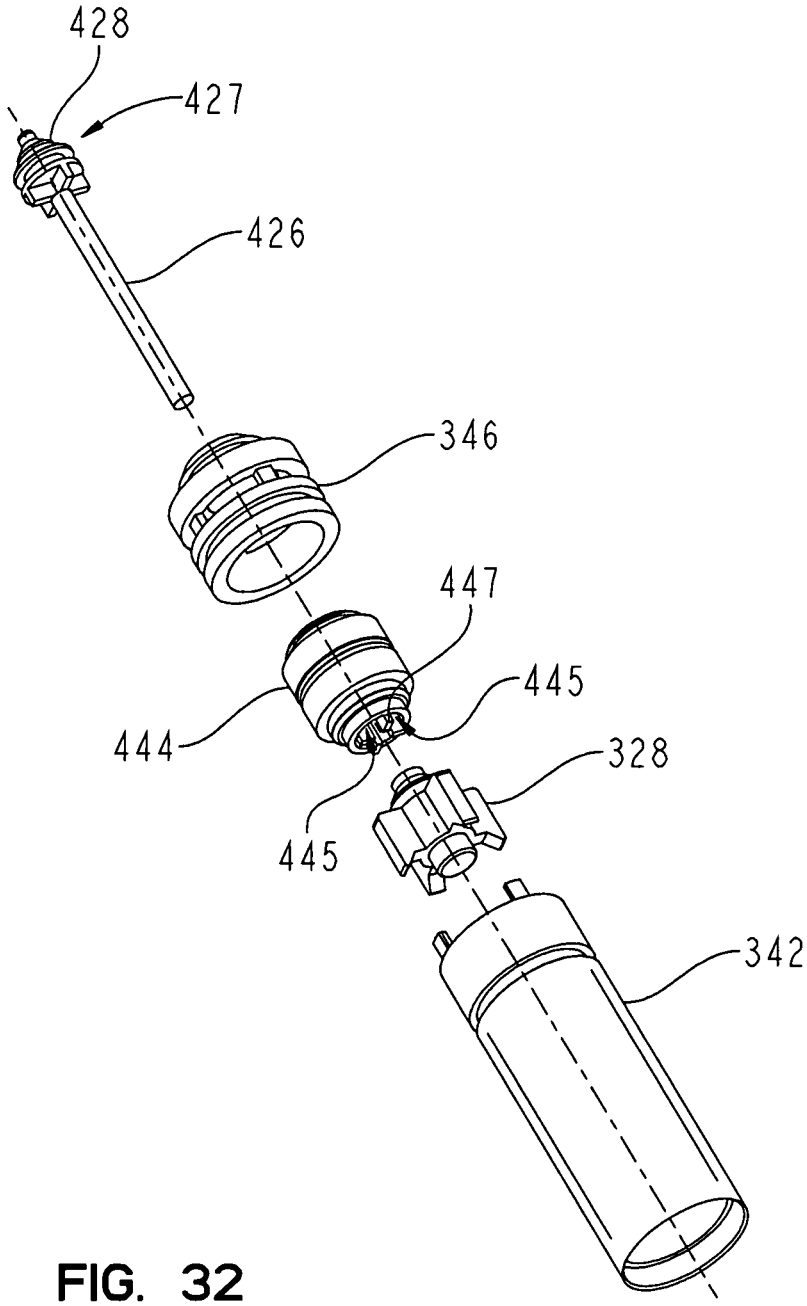
FIG. 32 is an exploded perspective view showing the diverter sleeve, the diverter assembly, the activation sleeve, and the activation valve assembly.
Figure 33:
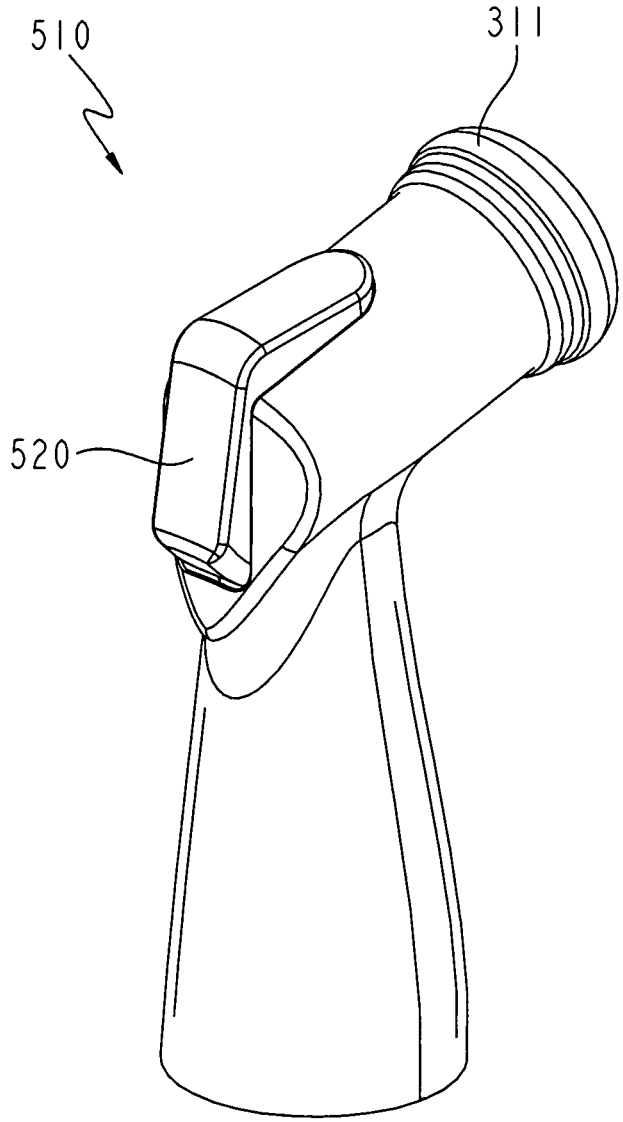
FIG. 33 is a rear perspective view of a further illustrative embodiment spray device.
Figure 34:
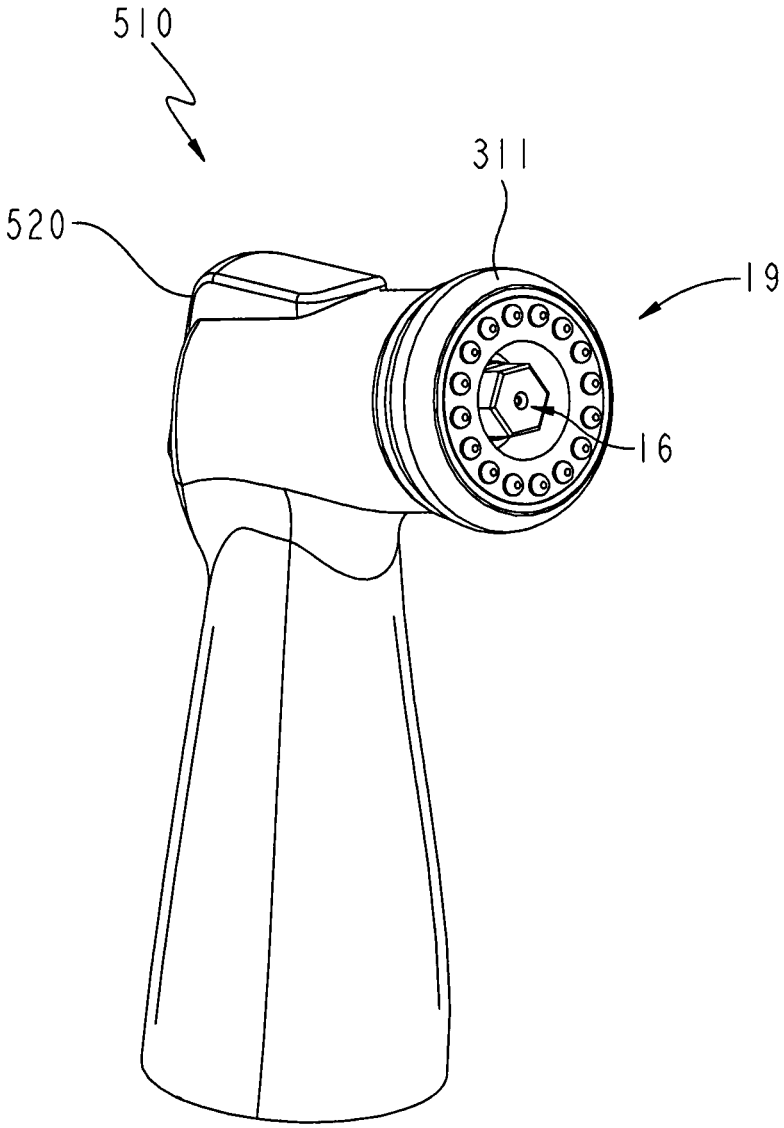
FIG. 34 is a front perspective view of the spray device of FIG. 33.
Figure 35:
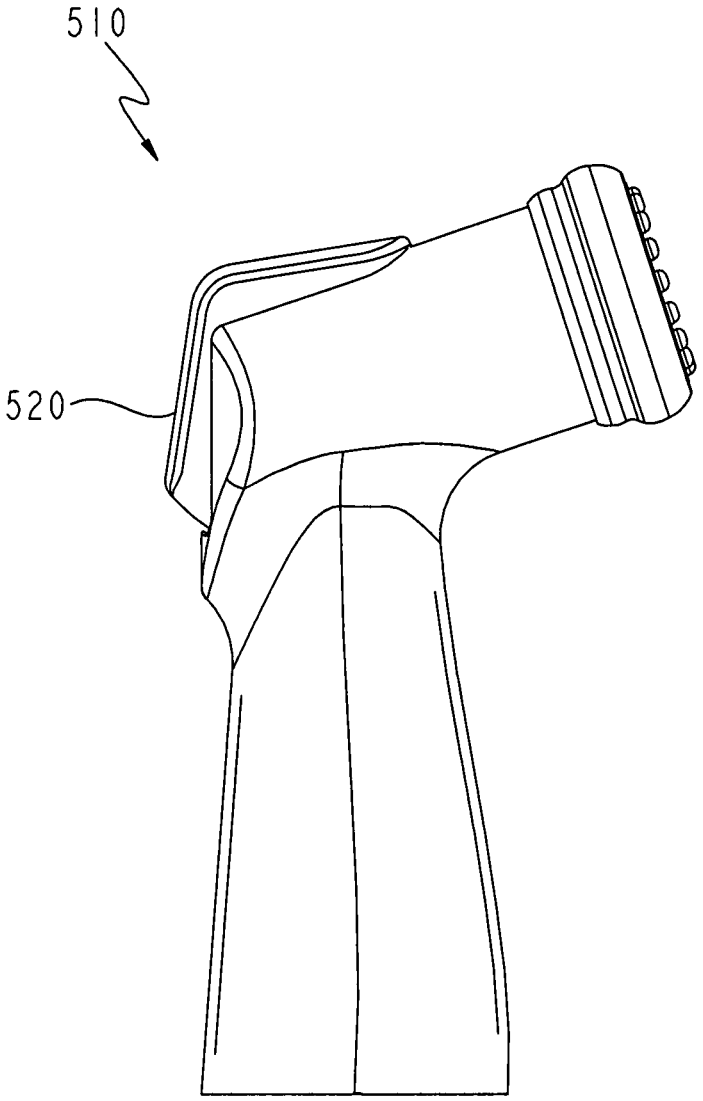
FIG. 35 is a side elevational view of the spray device of FIG. 33.

Referring to FIG. 29, activation valve 322 is in a closed position and diverter valve 424 is in a spray position. In the spray position of FIG. 29, the spray nozzle assembly 19 is in fluid communication with the interior chamber 364 of lower sleeve 342, since seal 348 is in spaced relation to seat 352. When trigger 420 is partially depressed in direction 177, as shown in FIG. 30, stem 326 due to cam surface 429 moves in direction 174 which causes poppet valve 328 to move downwardly in direction 174 such that seal 341 is no longer engaging seat 340. As such, fluid may flow into interior chamber 364 of lower sleeve 342. Due to the position of diverter valve 424 fluid is communication to spray nozzle assembly 19. When trigger 420 is fully depressed in direction 177, as shown in FIG. 31, stem 326 causes disc 432 to engage and move piston 444 downwardly in direction 174. In this position, seal 348 engages seat 352, while seal 350 is positioned in spaced relation to seat 354. Cartridge assembly 16 is therefore in fluid communication with interior chamber 364 of lower sleeve 342. It should be noted in spray device 410, stem 426 is generally cylindrical while piston 444 includes fluid passages 445.

A further embodiment designated spray device 410 is illustrated and described in U.S. Provisional Application Ser. No. 60/771,192 (see FIGS. 30-38), filed Feb. 6, 2006, the disclosure of which is expressly incorporated by reference herein.

A further illustrative embodiment spray device 510 is shown in FIGS. 33-38. Like components of spray device 510 and spray device 410 are identified with the same reference numbers. Spray device 510 is similar to spray device 410, except for the trigger 520 and its associated coupling with stem 526. More particularly, trigger 520 is pivotally coupled to body 512 such that depressing trigger 520 in direction 376 causes a lower surface 522 of trigger 520 to force stem 526 downwardly in direction 174. A tab 560 of trigger 520 is received in a recess 562 of body 512.

Operation of activation valve assembly 322 and diverter valve assembly 424 are substantially the same as detailed above with respect to FIGS. 26-32. It should be noted that the vanes 447 of piston 444 run approximately the full length of piston 444.

Figure 36:
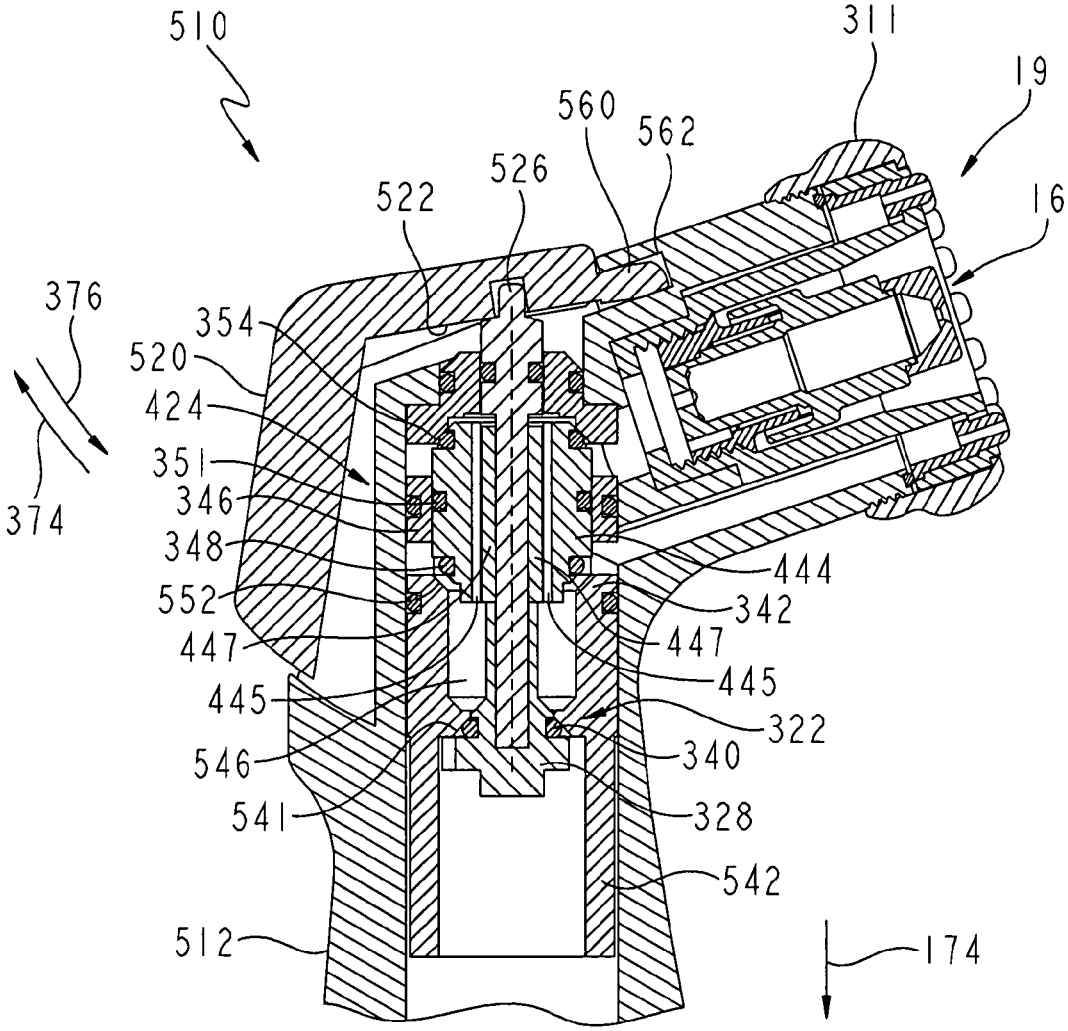
FIG. 36 is a cross-sectional view of the spray device of FIG. 33, showing the trigger in a first position wherein the activation valve assembly is in an inactive or closed position and the diverter valve assembly is in a spray position.
Figure 37:
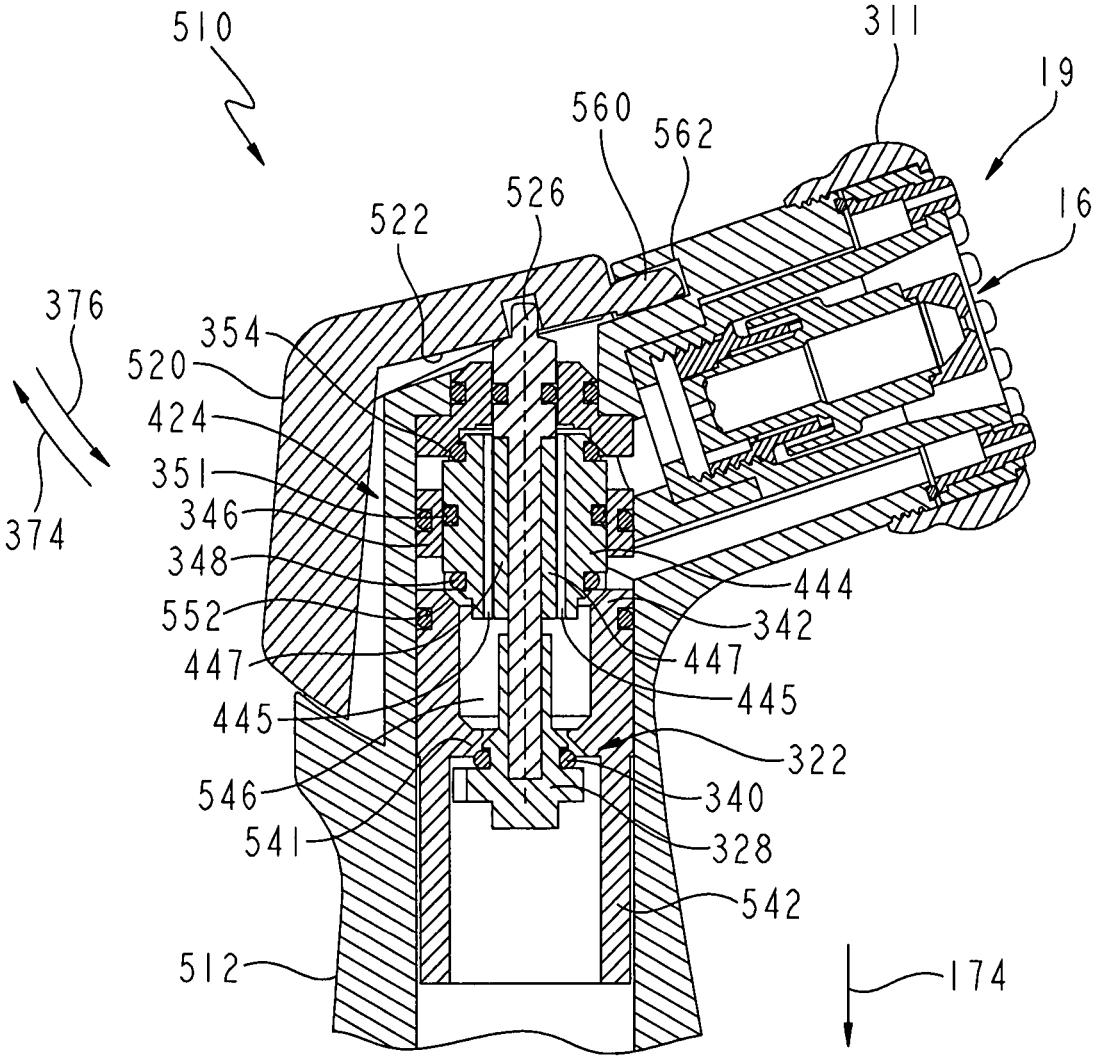
FIG. 37 is a cross-sectional view similar to FIG. 36, showing the trigger in a intermediate position between the first position of FIG. 36 and a second position of FIG. 38, wherein the activation valve assembly is in an active or open position, and the diverter valve assembly is in the spray position.
Figure 38:
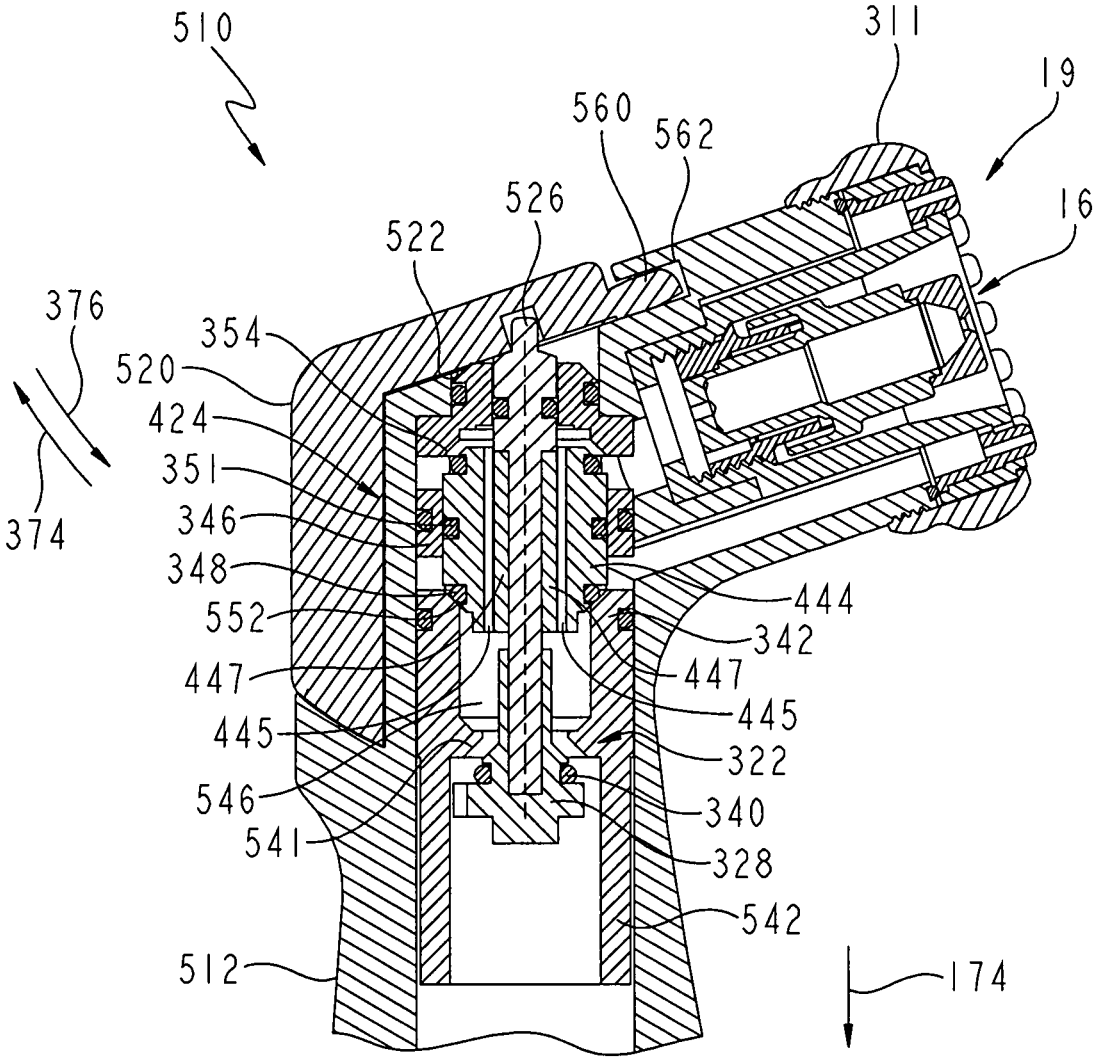
FIG. 38 is a cross-sectional view similar to FIG. 36, showing the trigger in the second position, wherein the activation valve assembly is in the active position, and the diverter valve assembly is in a stream position.

Referring to FIG. 36, activation valve 322 is in a closed position and diverter valve 424 is in a spray position. In the spray position of FIG. 36, the spray nozzle assembly 19 is in fluid communication with the interior chamber 546 of lower sleeve 542, since seal 348 is in spaced relation to seat 552. When trigger 520 is partially depressed in direction 376, as shown in FIG. 37, stem 526 due to surface 522 moves in direction 174 which causes poppet valve 328 to move downwardly in direction 174 such that seal 341 is no longer engaging seat 541. As such, fluid may flow into interior chamber 564 of lower sleeve 542. Due to the position of diverter valve 424 fluid is communication to spray nozzle assembly 19. When trigger 520 is fully depressed in direction 376, as shown in FIG. 38, stem 526 engages and moves piston 444 downwardly in direction 174. In this position, seal 348 engages seat 552, while seal 350 is positioned in spaced relation to seat 554. Cartridge assembly 16 is therefore in fluid communication with interior chamber 364 of lower sleeve 542.

Figure 39:
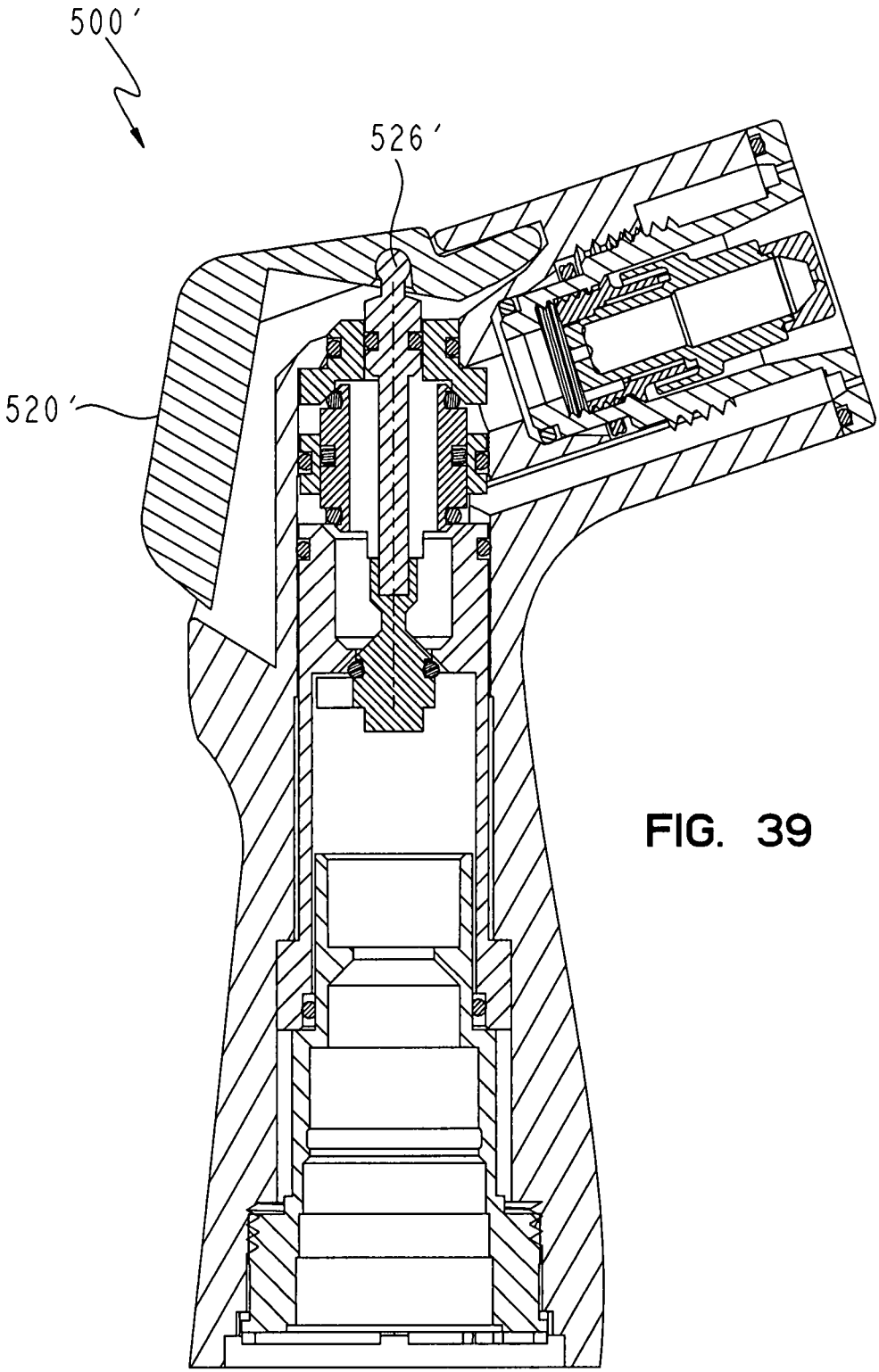
FIG. 39 is a cross sectional view of a modified version of the spray device of FIG. 33.

Referring to FIG. 39, a modified version spray device 510' is shown. Spray device 510 operates the same as spray device 510. In spray device 510', stem 526' and trigger 520' are designed such that stem 526' snap fits into trigger 520'.

Another illustrative embodiment spray device 610 is shown in FIGS. 40-43. Like components of spray device 610 and spray device 510 are identified with the same reference numbers. Spray device 610 is similar to spray device 510, except for the trigger 620 being pivotally coupled to a front of the body 612 as opposed to a rear of the body 612. Trigger is biased in direction 674 due to a spring 650.

Figure 40:
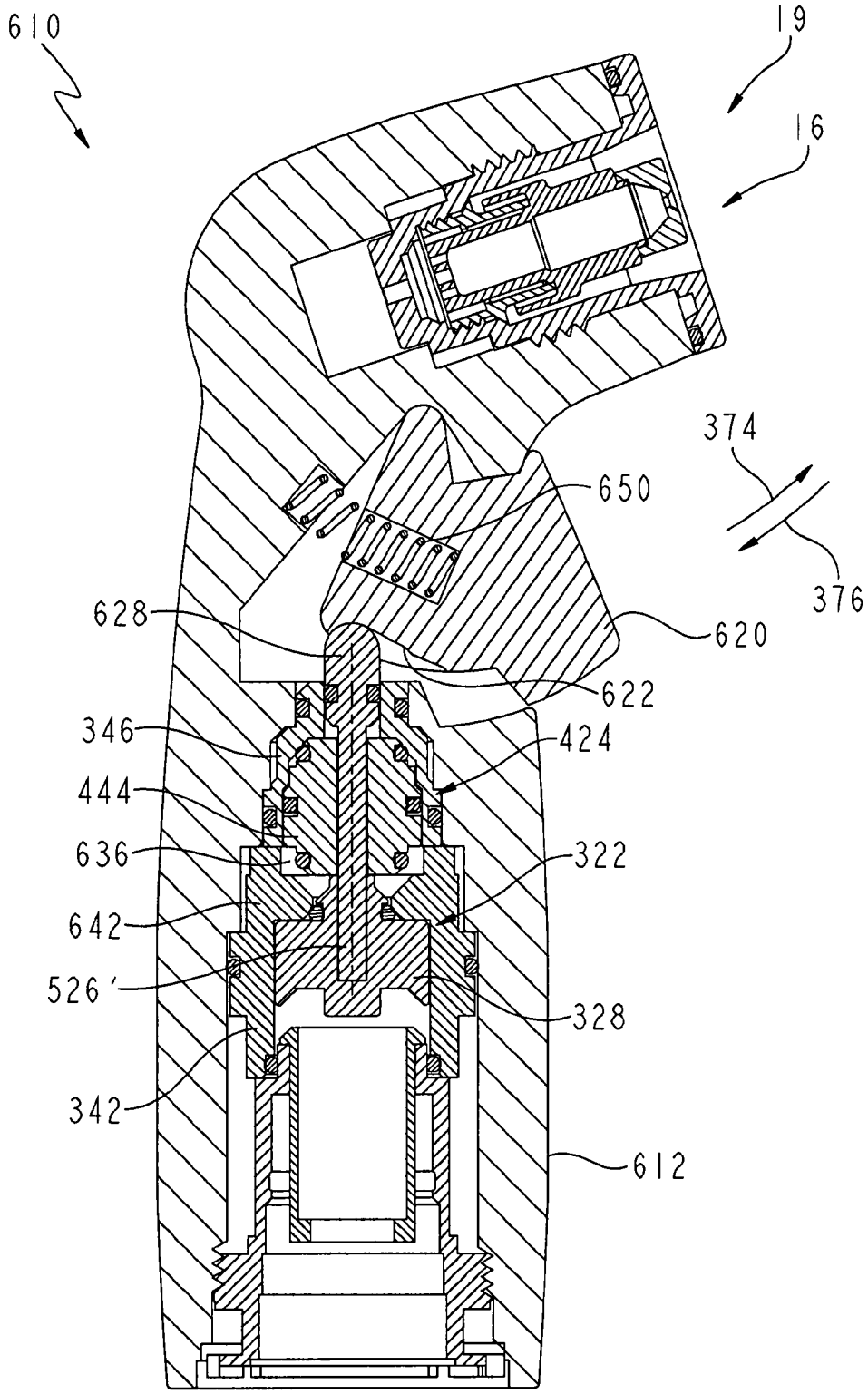
FIG. 40 is a cross-sectional view of a further illustrative embodiment spray device, showing the activation valve assembly in an inactive or closed position, and the diverter valve assembly in a spray position.
Figure 41:
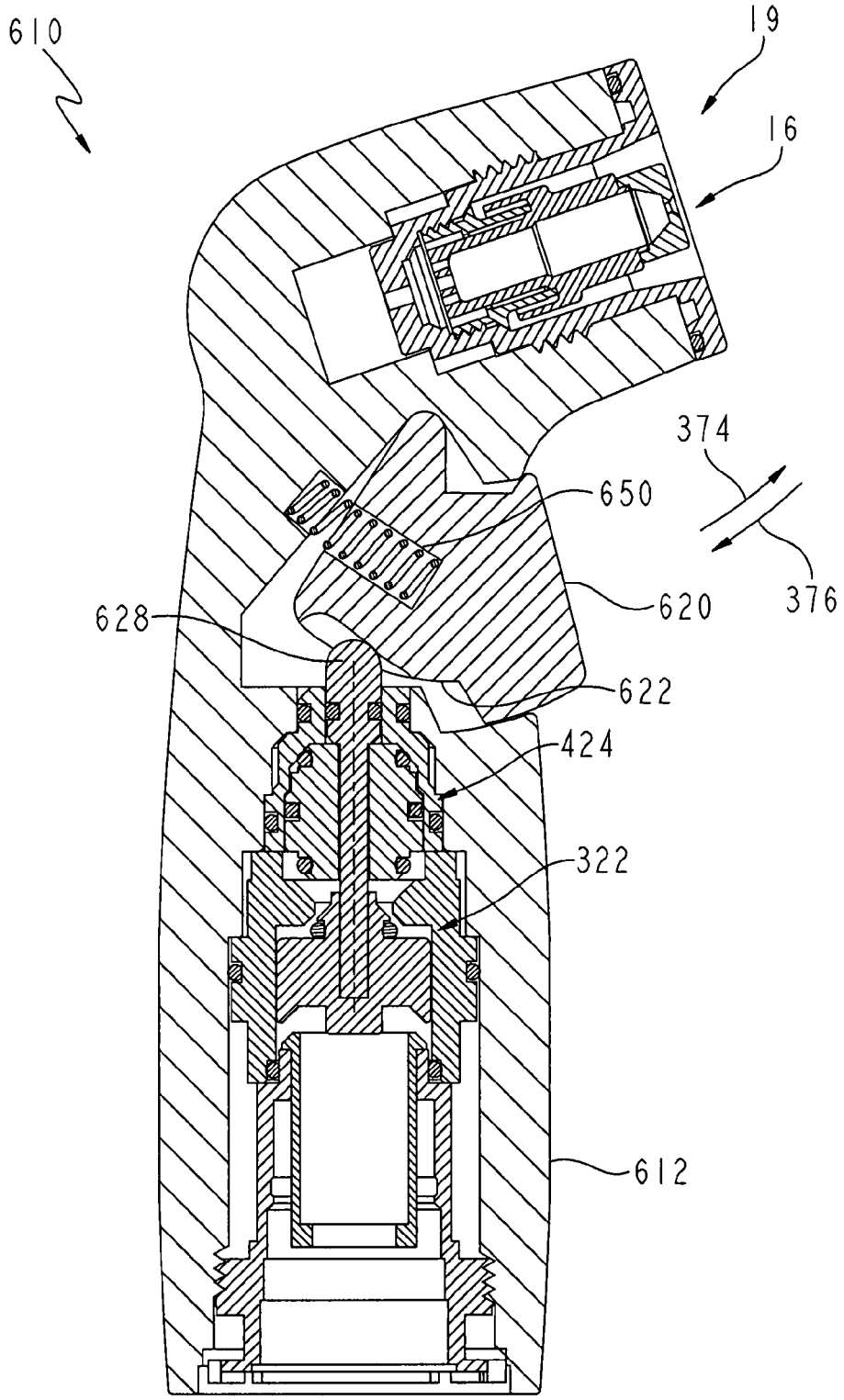
FIG. 41 is a cross-sectional view similar to FIG. 40, showing the activation valve assembly in the an active or open position, and the diverter valve assembly in the spray position.
Figure 42:
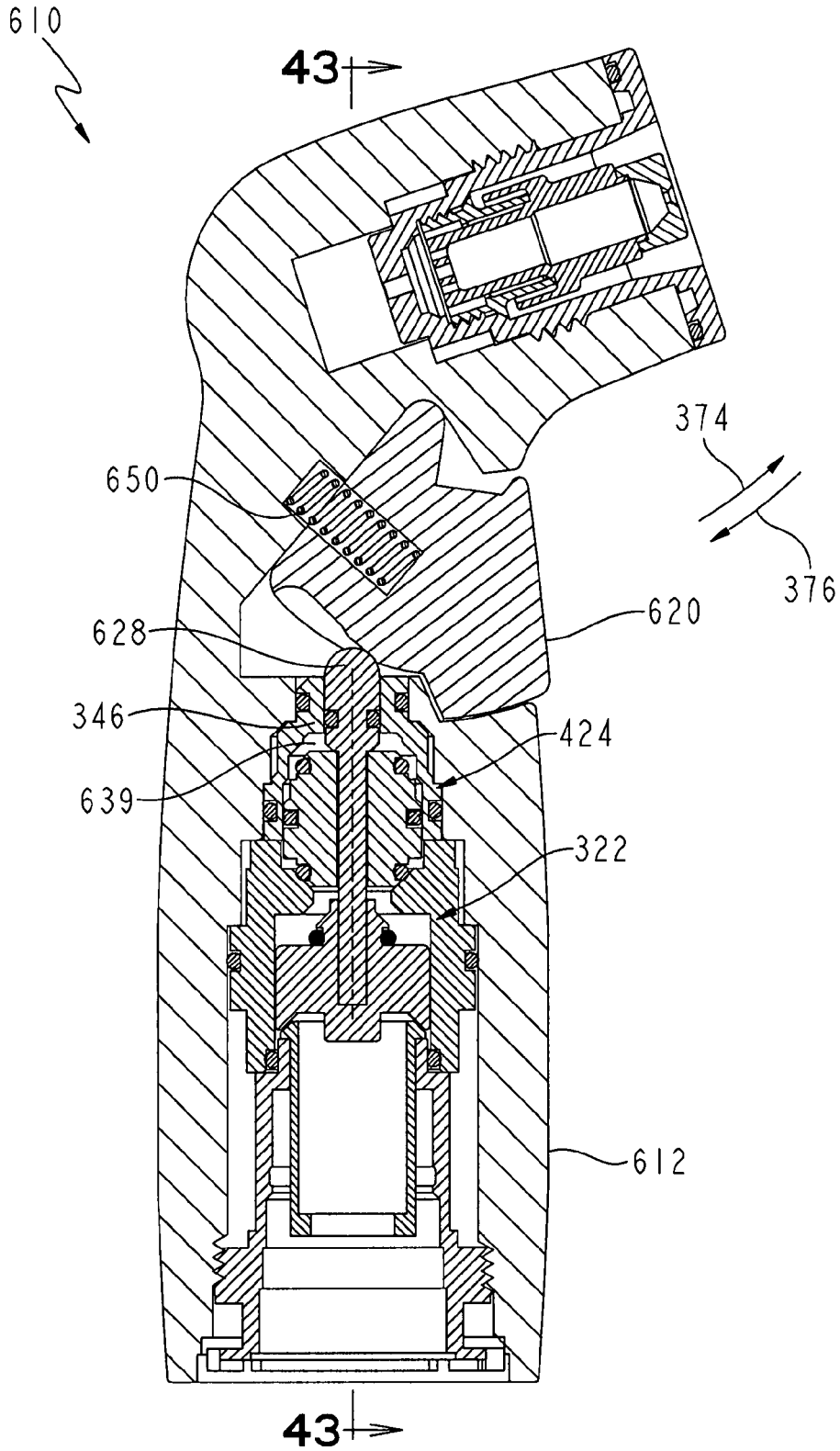
FIG. 42 is a cross-section view similar to FIG. 40, showing the activation valve assembly in the active position, and the diverter valve assembly in the stream position.
Figure 43:
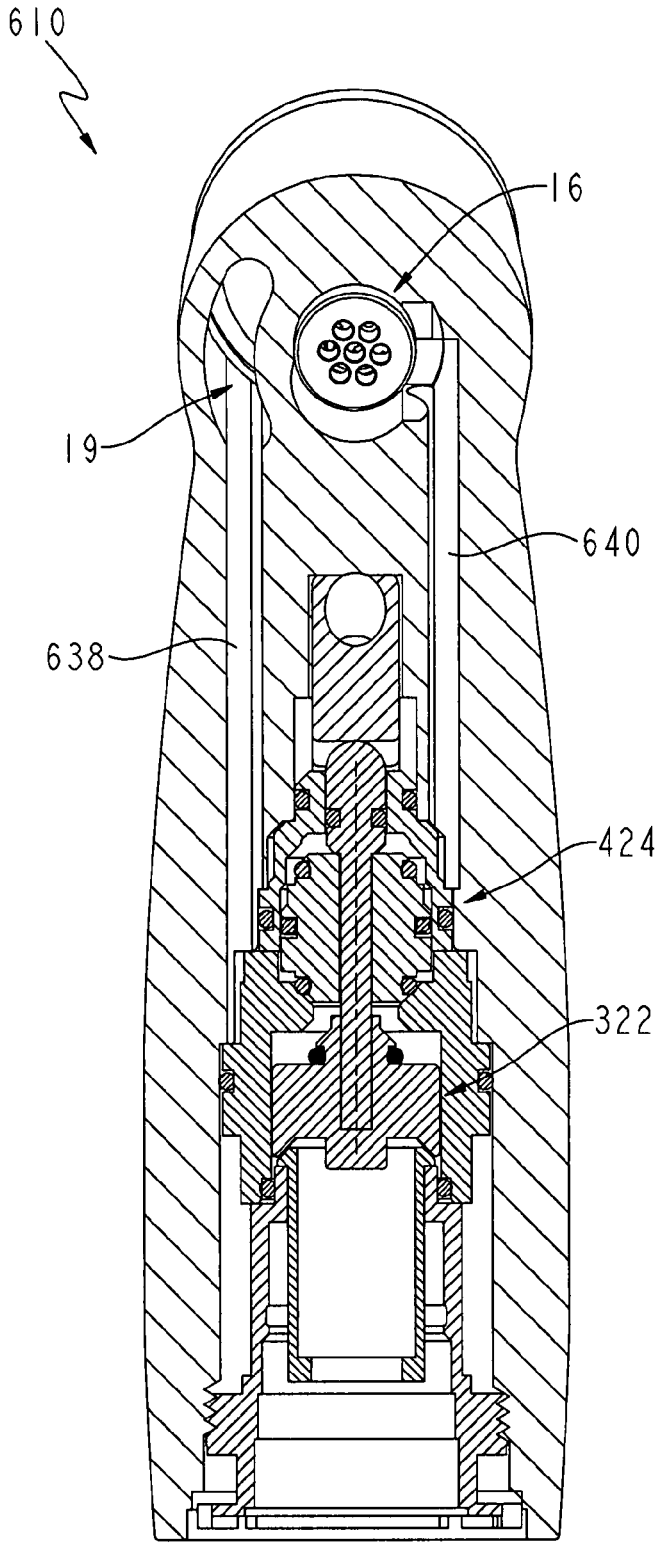
FIG. 43 is a further cross-sectional view of the spray device of FIG. 40, showing the activation valve assembly and the diverter valve assembly in the positions of FIG. 42.

By depressing trigger 620 in direction 676, a lower surface 622 of trigger 620 interacts with activation valve 322 and diverter valve 424 through stem 628 is the same manner as lower surface 522 and stem 528 of spray device 510. Referring to FIG. 40, region 636 of lower sleeve 642 is in fluid communication with fluid pathway 638 (FIG. 43) in body 612 which is in fluid communication with spray nozzle assembly 19. Referring to FIG. 42, region 639 of upper sleeve 346 is in fluid communication with fluid pathway 640 (see FIG. 43) in body 612 which is in fluid communication with cartridge assembly 16.

Figure 44:
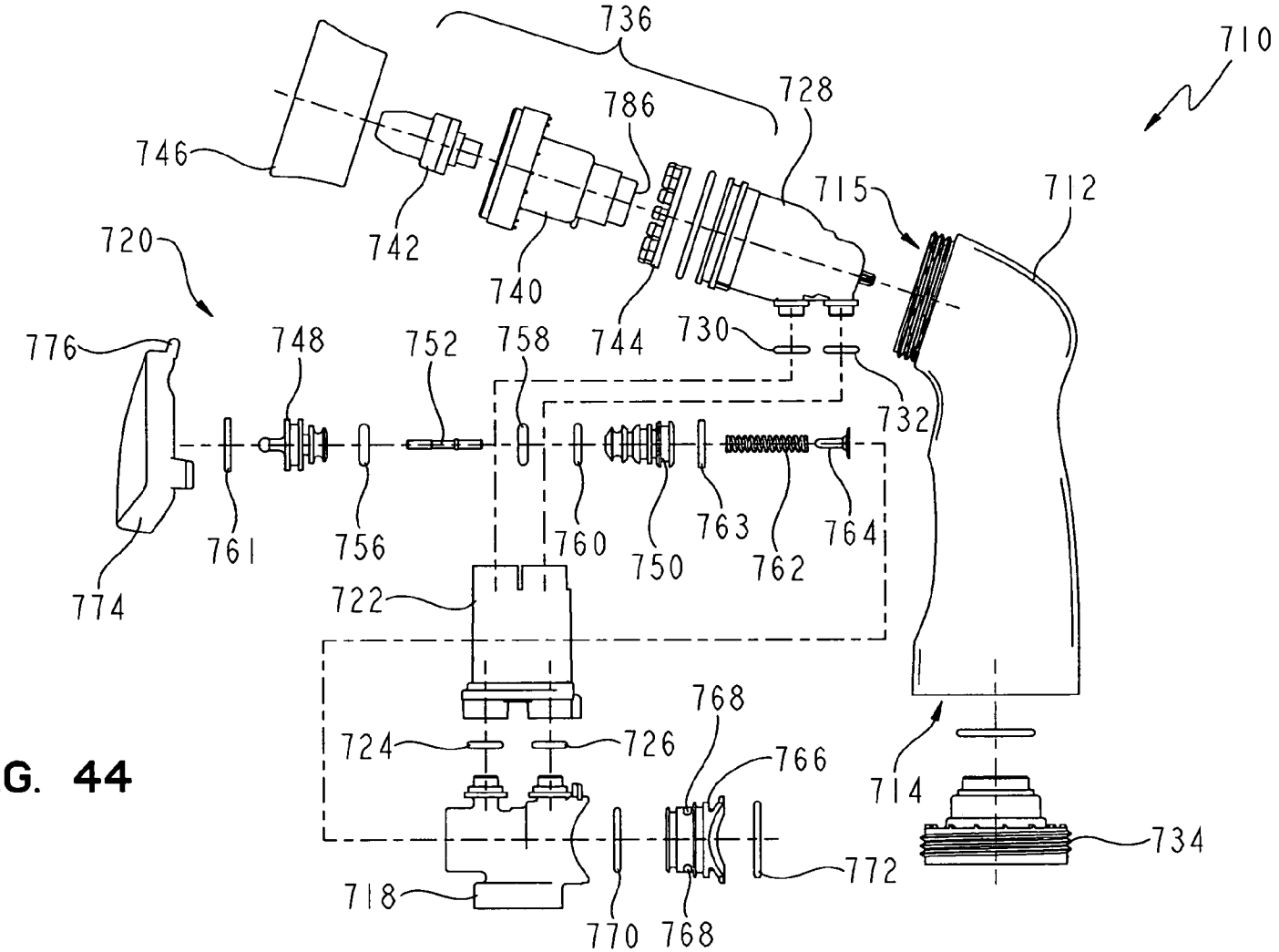
FIG. 44 is an exploded perspective view of another illustrative embodiment spray device.
Figure 45:
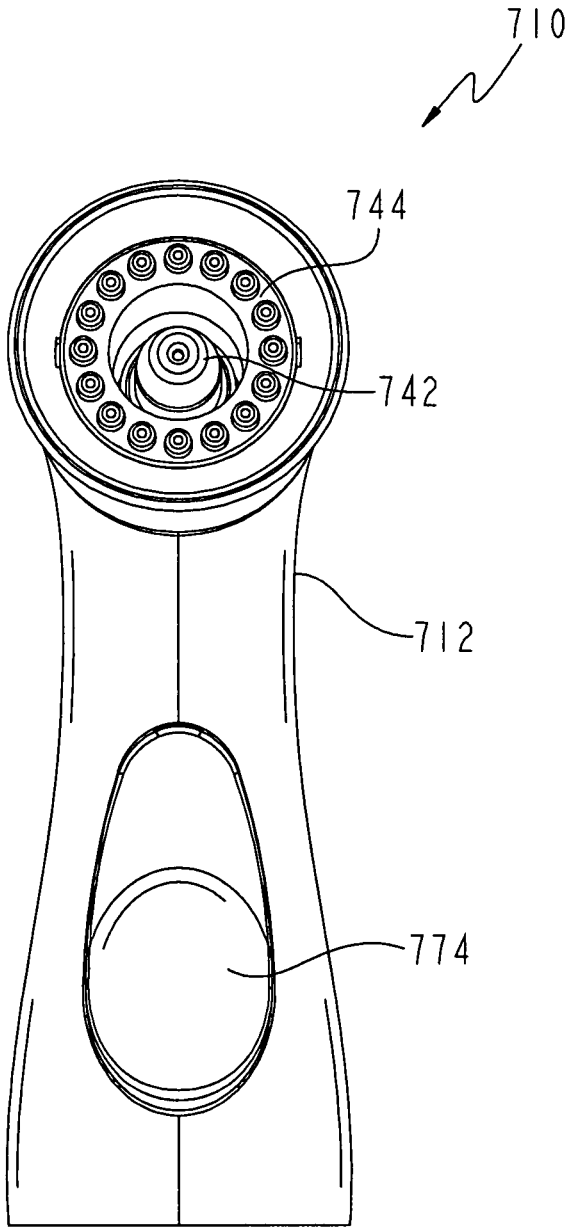
FIG. 45 is a front plan view of the illustrative embodiment spray device of FIG. 44.

Another illustrative embodiment spray device 710 is shown in FIGS. 44-52. Referring initially to FIGS. 44 and 45, a spray head 710 according to an illustrative embodiment of the present disclosure is shown as including a valve body 712 including an inlet 714 and an outlet 715. The valve body 712 includes a chamber 716 configured to receive waterway components. More particularly, the chamber 716 receives a channel member 718 which defines a transversely extending bore 719 configured for receiving a valve assembly 720. An internal straw waterway 722 is operably coupled to the channel 718. O-rings 724 and 726 provide sealing engagement between the waterway 722 and the channel 718. An internal nozzle waterway 728 is operably coupled to an upper end of the internal straw waterway 722 and sealed therebetween by o-rings 730 and 732. A retainer ring 734 is threadably received within the inlet 714 of the spray body 712 to retain the waterway components and to provide a conventional connection to a water supply line (not shown). A nozzle cartridge or assembly 736 is received within the internal nozzle waterway 728 and sealed therebetween by an o-ring 738. The cartridge assembly 736 includes a base or holder 740, a flow nozzle 742, and a sprayer assembly 744. A trim ring 746 is threadably received on the outlet 715 of the body 712 and is configured to retain the internal nozzle waterway 728 in position.

The valve assembly 720 includes a front diverter 748 coupled to a rear diverter 750 through a connecting pin 752. First and second o-rings 756 and 758 are supported on the front and rear diverters 748 and 750, respectively. A third o-ring 760 is also supported by the rear diverter 750. First and second quad rings or seals 761 and 763 are likewise supported by the front and rear diverters 748 and 750. In one embodiment, seal 761 is larger than seal 763 such that the surface area of seal 761 is greater than seal 763. This assists valve assembly 736 in closing under pressure. Additional details regarding the seals are provided in U.S. Provisional Patent Application Ser. No. 60/771,192, which has been incorporated herein by reference.

Figure 49:
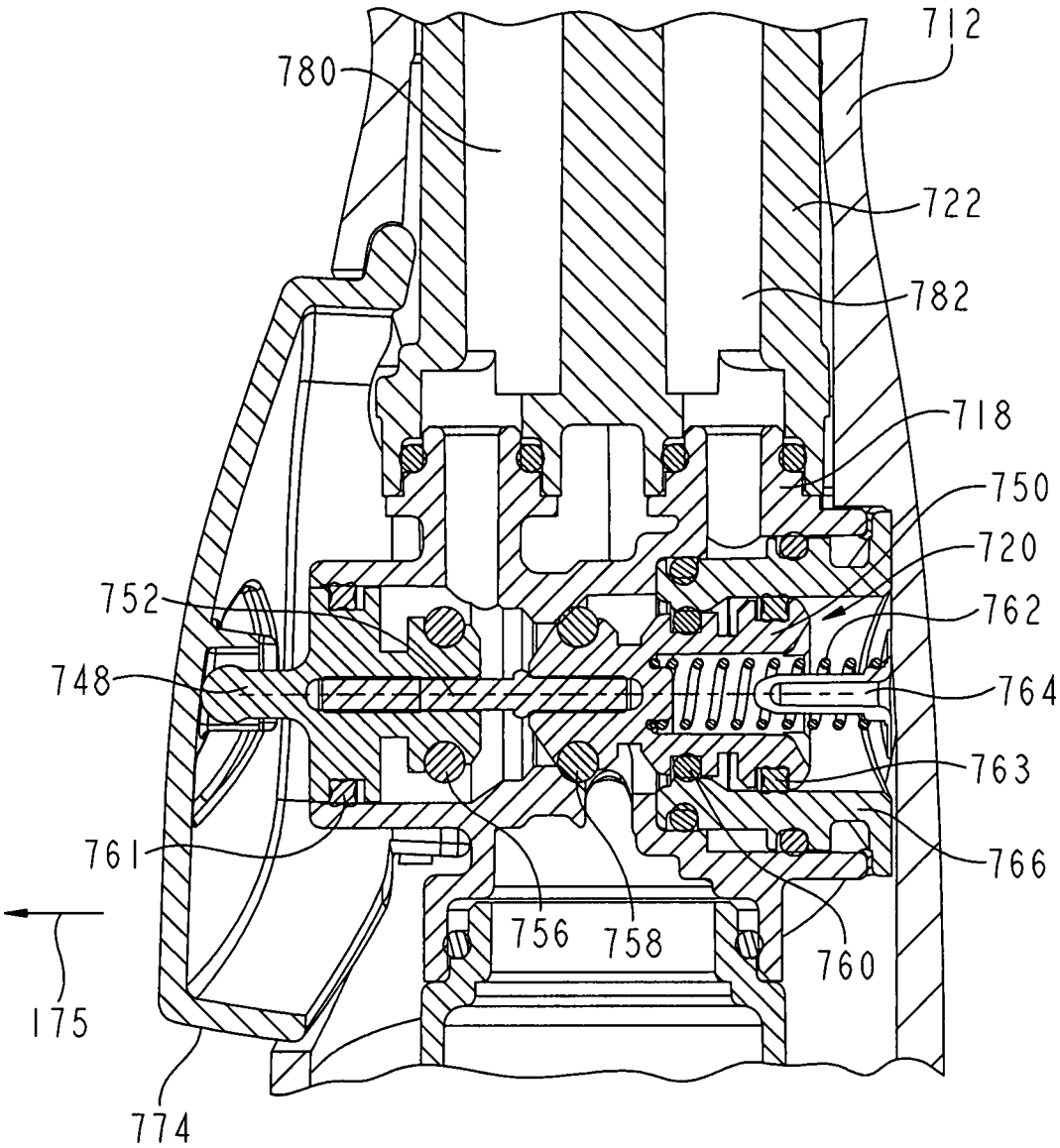
FIG. 49 is a detailed view of the valve assembly of the spray device of FIG. 44.

A spring 762 is operably coupled to the rear diverter 750 and is configured to bias the valve assembly 720 to an off position (direction 175 in FIG. 49). A peg 764 is received within the spring through an interference fit and is configured to prevent the spring from buckling. A sleeve 766 is received within the channel 718 and is configured to receive the rear diverter 750. The sleeve 766 includes annular slots 768 to provide a passageway for the selected flow of water therethrough. O-rings 770 and 772 provide seals between the sleeve 766 and the channel 718. A trigger 774 is operably coupled to the valve assembly 720. More particularly, the trigger 774 includes a hinge 776 which is received within the body such that the trigger 774 may pivot relative to the body 712 and, in response thereto, the valve assembly 720 moves between a plurality of positions. More particularly, the trigger 774 cooperates with the valve assembly 720 to provide a progressive single trigger for flow control (both flow actuation and mode control).

Figure 46:
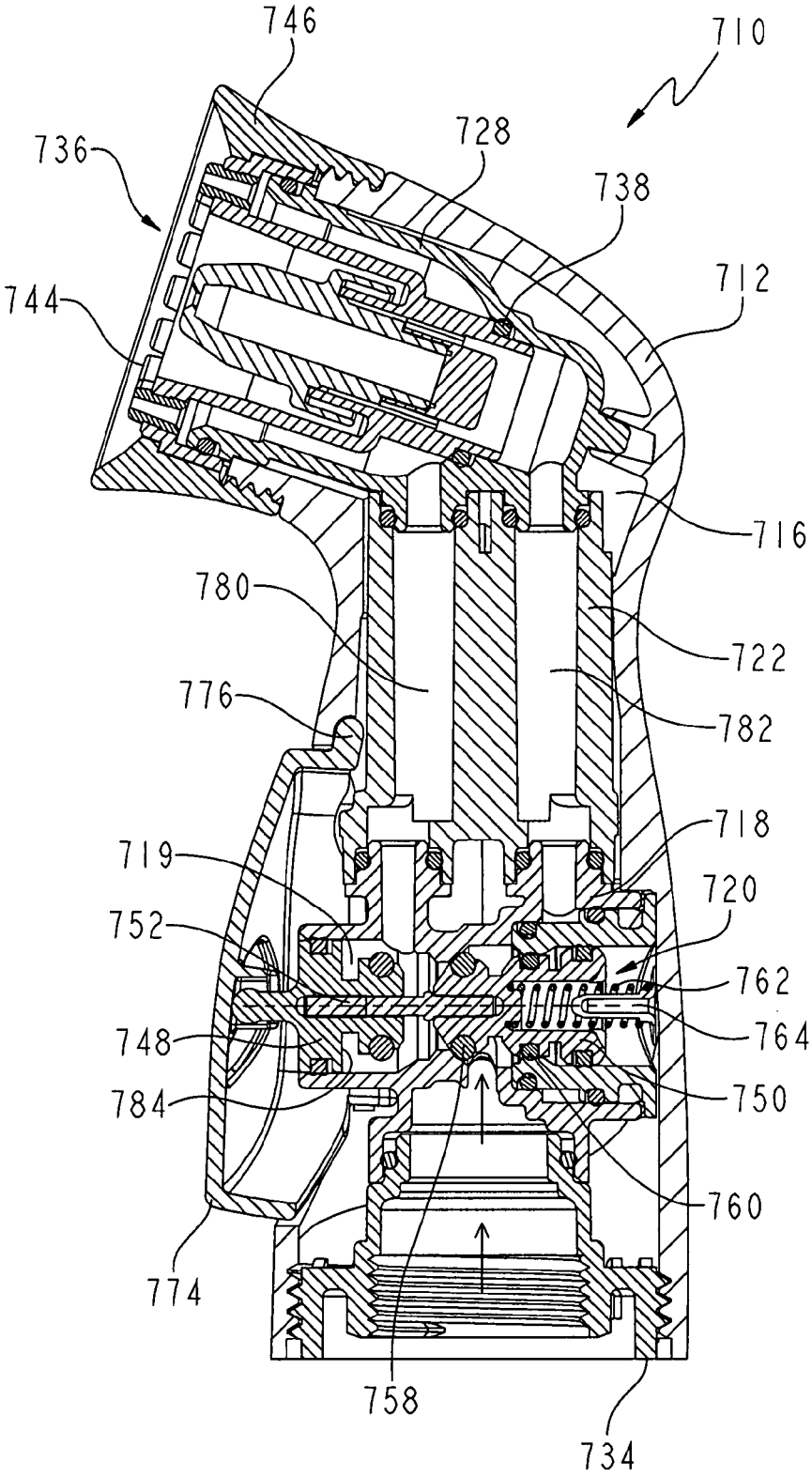
FIG. 46 is a cross-sectional view of the spray device of FIG. 44 in an off mode.
Figure 47:
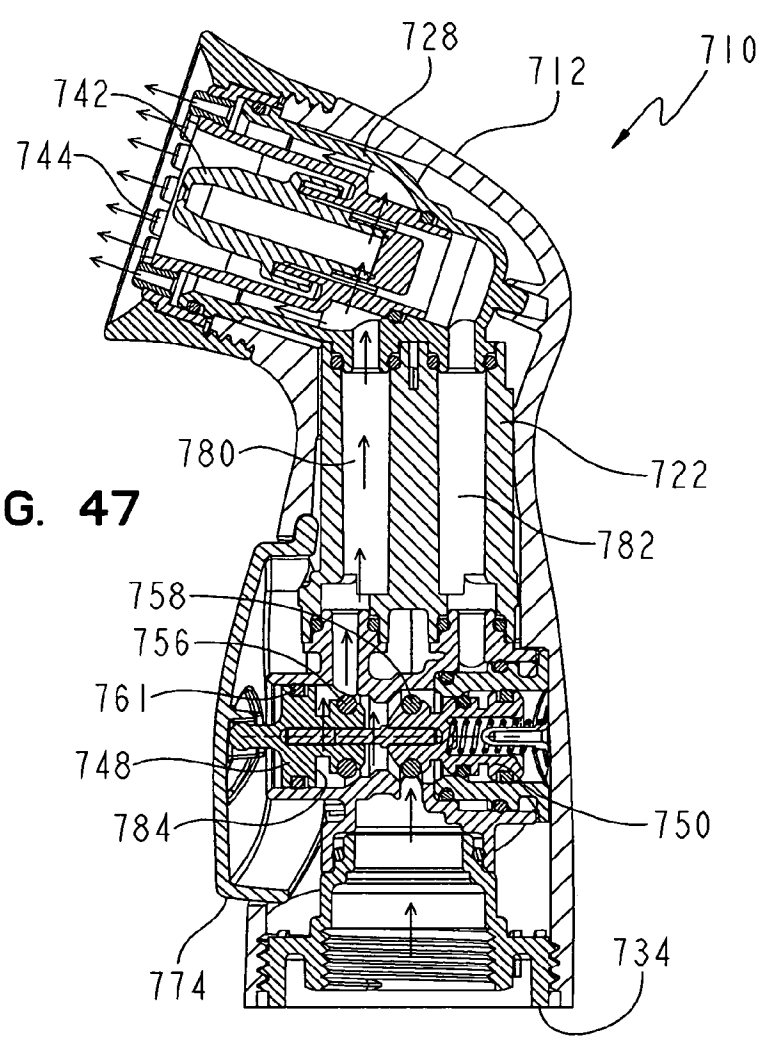
FIG. 47 is cross-sectional view similar to FIG. 46, showing the spray device in a regular spray mode, and showing water flow through a pathway defined by the valve assembly to a spray assembly.

As shown in FIGS. 46 and 47, in a first position, the valve assembly 720 blocks the flow of water to the first and second channels 780 and 782 of the internal straw waterway 722.

In a second position, the spray device 710 is in a regular spray mode of operation. As such, water passes through a passageway defined intermediate the front and rear diverters 748 and 750 through the first channel 780 of the internal straw waterway 722 and out through the outlets of the spray assembly 744. Water also provides force against an internal surface 784 of the front diverter 748 thereby providing for a hydro-balancing effect to assist force exerted by the spring 762.

Figure 48:
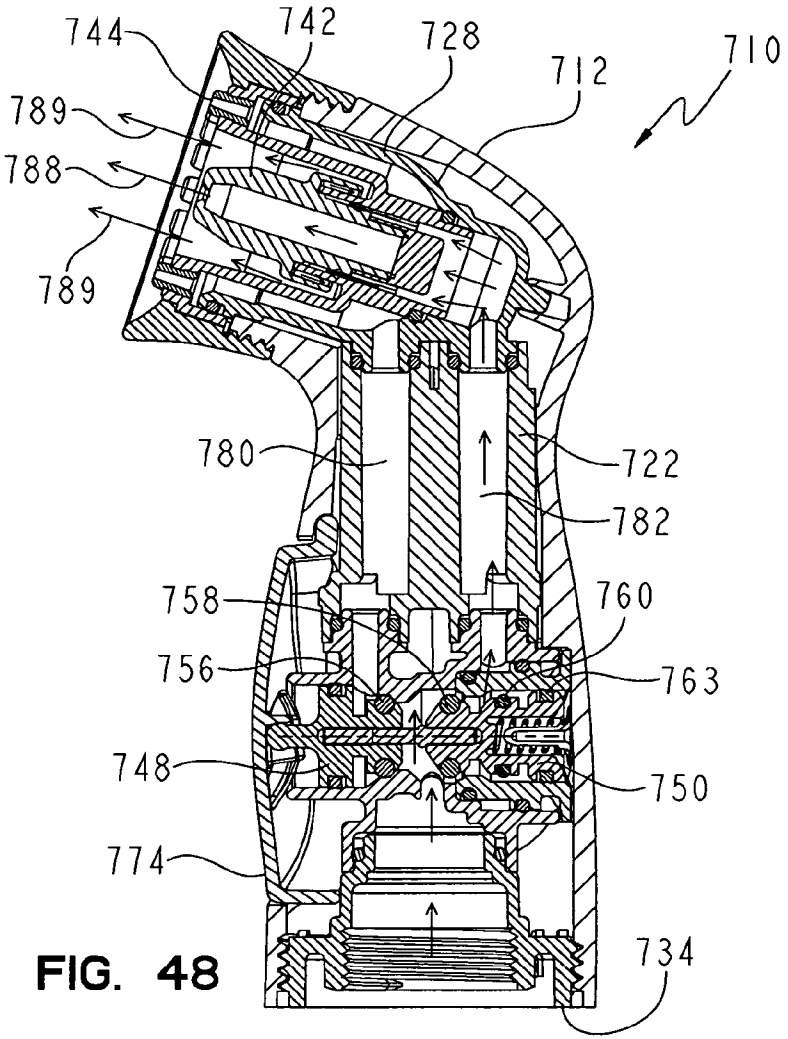
FIG. 48 is a cross-sectional view similar to FIG. 46, showing the spray device in a precision or power spray mode, and showing water flow through a pathway defined by the valve assembly to the inlet of the valve cartridge.

With reference now to FIG. 48, in a third position, the valve assembly 720 provides for a precision or power spray mode of operation. In this mode, a fluid passageway is defined between the front and rear diverters 748 and 750 to the second channel 782 of the internal straw waterway 722. Water flows to an inlet 786 of the valve cartridge assembly 720 and provides for a center stream of water 788 which is surrounded by an outer shield of water 789. Additional details regarding the cartridge assembly 736 are provided in U.S. patent application Ser. No. 11/383,267, which has been incorporated herein by reference.

Figure 50:
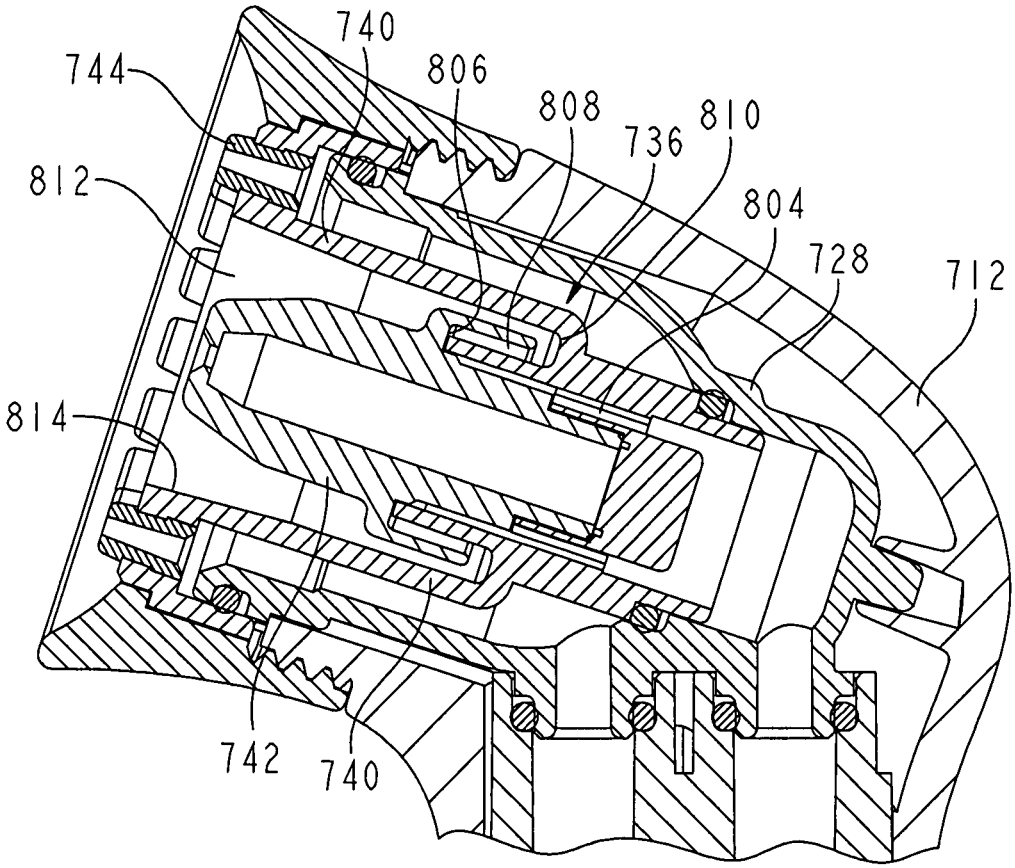
FIG. 50 is a detailed view of the outlet of the spray device of FIG. 44.
Figure 51:
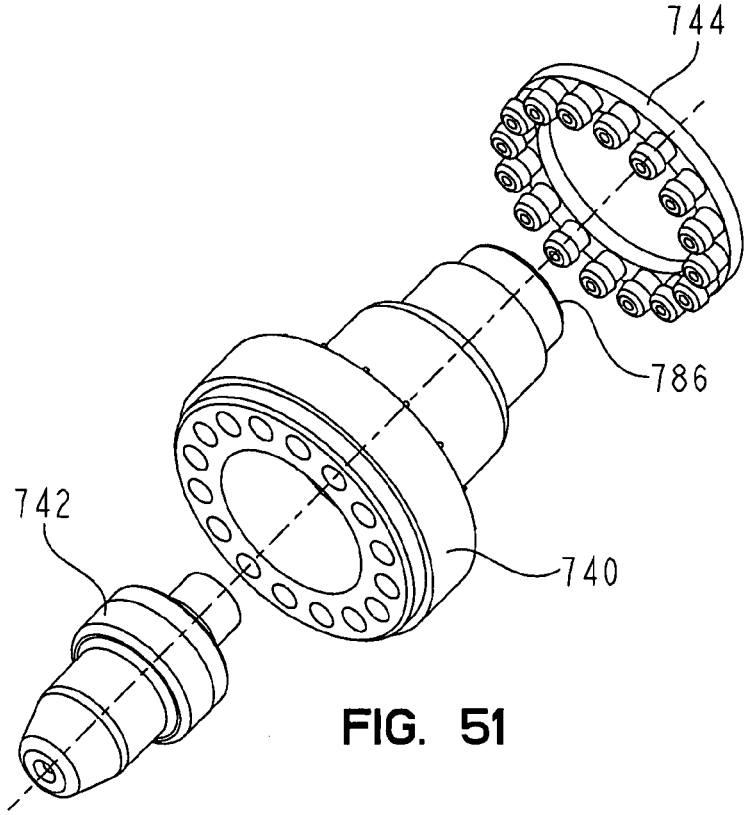
FIG. 51 is an exploded perspective view of the cartridge assembly of FIG. 50.
Figure 52:
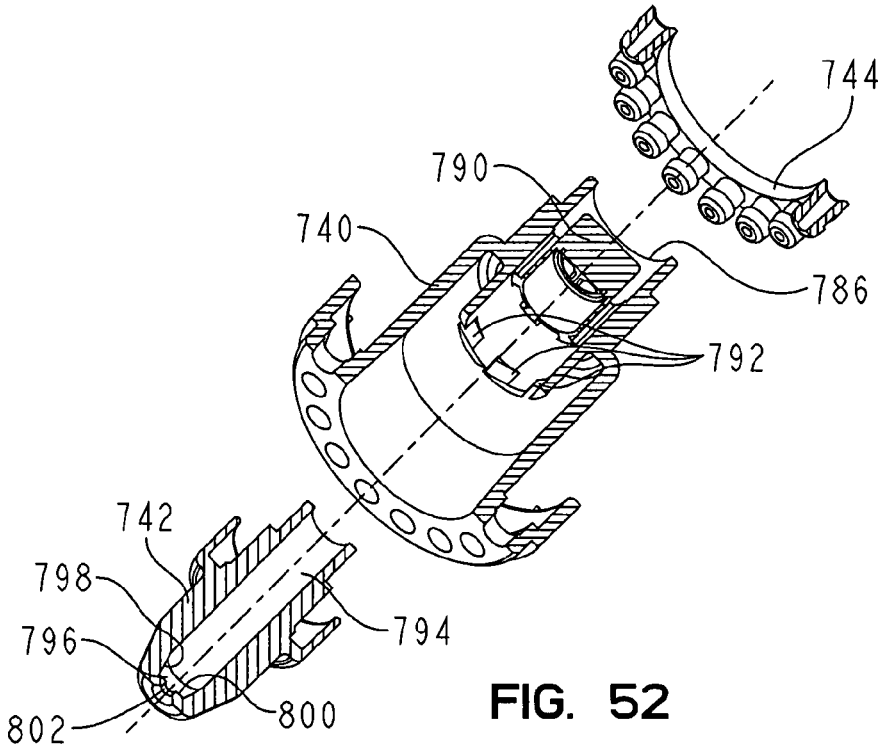
FIG. 52 is an exploded view in cross-section of the cartridge assembly of FIG. 50.

With reference now to FIGS. 50-52, the cartridge assembly 736 which is positioned within the outlet of the spray body 712 is further detailed. The cartridge assembly 736 is received within the internal nozzle waterway 728 and includes base 740 which may be formed from a thermoplastic material, such as noryl. The nozzle 742 is illustratively operably coupled to the base 740 in a conventional manner, such as through sonic welding. The spray assembly 744 may also be coupled to the holder 740 in a conventional manner, such as through sonic welding. The base 740 illustratively includes a flow straightener 790 and a plurality of slots 792 defining a whirl member which impart a rotational movement to the water to assist in the formation of a continuous shield of water 789. In operation, water enters the valve cartridge 736 at the inlet 786. A first portion of the water entering the valve cartridge 736 exits as a stream of water 788 and a second portion of the water entering the valve cartridge 736 exits as a continuous shield of water 789.

Illustratively, the flow straightener 790 includes a plurality of passageways consisting of parallel, longitudinally aligned bores, which are configured to assist in removing turbulence from fluid flowing therethrough, and provide a more linear flow to the fluid. Water passing through the passageways is communicated to an internal waterway 794 and onto a recess 796 in the nozzle 742. The recess 796 includes a tapering conical inner wall 798. The conical inner wall 798 abuts a substantially planar end wall 800 defining an outlet orifice 802 such that water passing therethrough forms a center water stream similar to stream 788. Orifice 802 includes sharp entry corners to assist in providing a substantially laminar flow to the outlet stream. In one illustrative embodiment, the outlet stream 788 has a substantially laminar flow.

A continuous shield of water 789 is formed by water that enters passageways 804 formed by the base 740. Passageways 804 are in fluid communication with the slots 792 and a lower surface 806 of the base 740 to change the direction of flow of the water and impart rotational movement to the water passing therethrough. Once rotational movement is imparted to the water, it moves outwardly to a sidewall 808 and is directed backwards. The water continues generally in the same direction until it is redirected forward again by surface 810 of the base 740. The water then travels generally toward the shield outlet 812. As the fluid moves toward the shield outlet 812, centrifugal force causes it to follow and inner surface 814 of the holder 740. Due to the well-known Coanda effect, the fluid defines a substantially continuous shield of fluid, generally similar to shield 789 having a sheet-like appearance.

Figure 53:
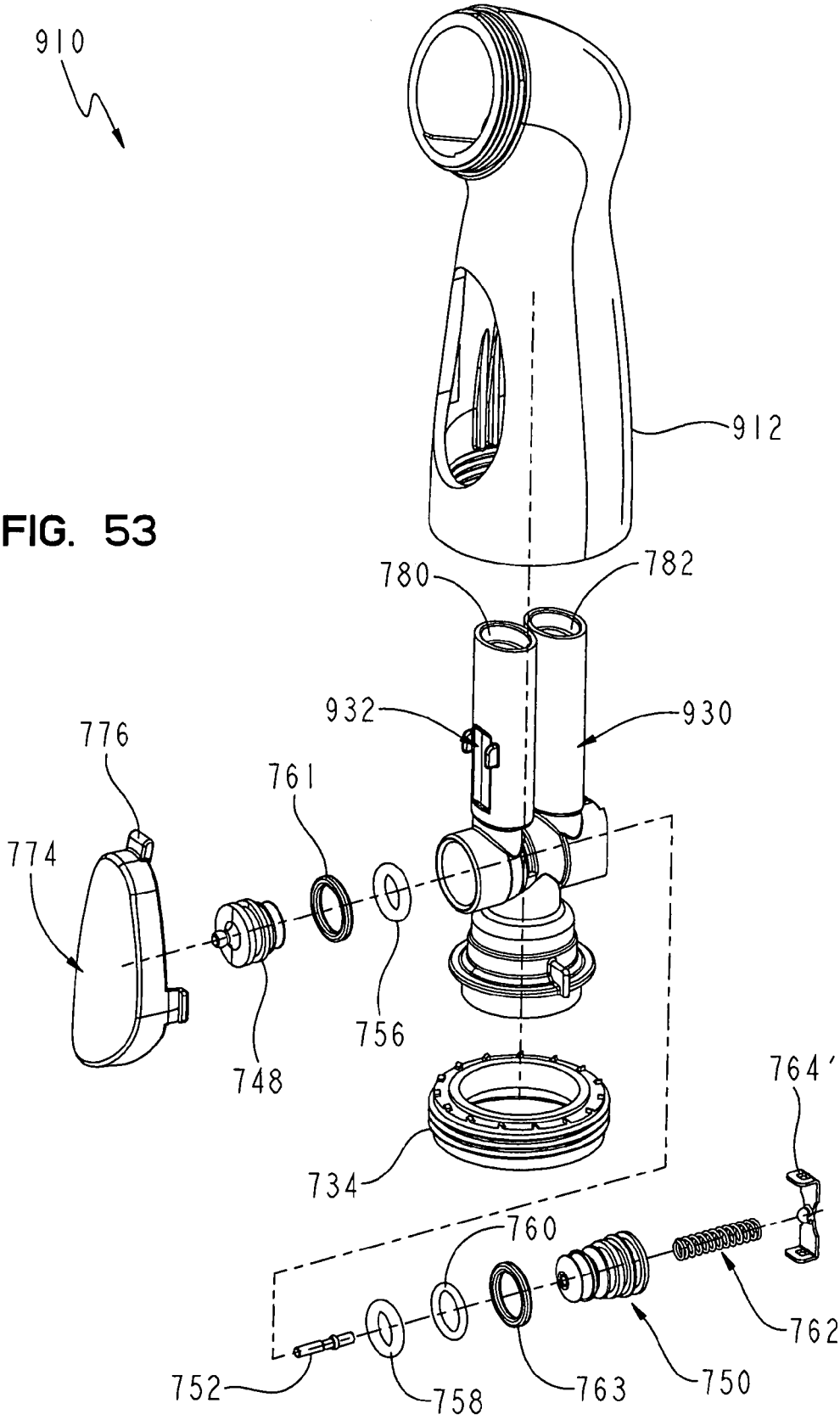
FIG. 53 is an exploded perspective view of yet another illustrative embodiment spray device.
Figure 54:
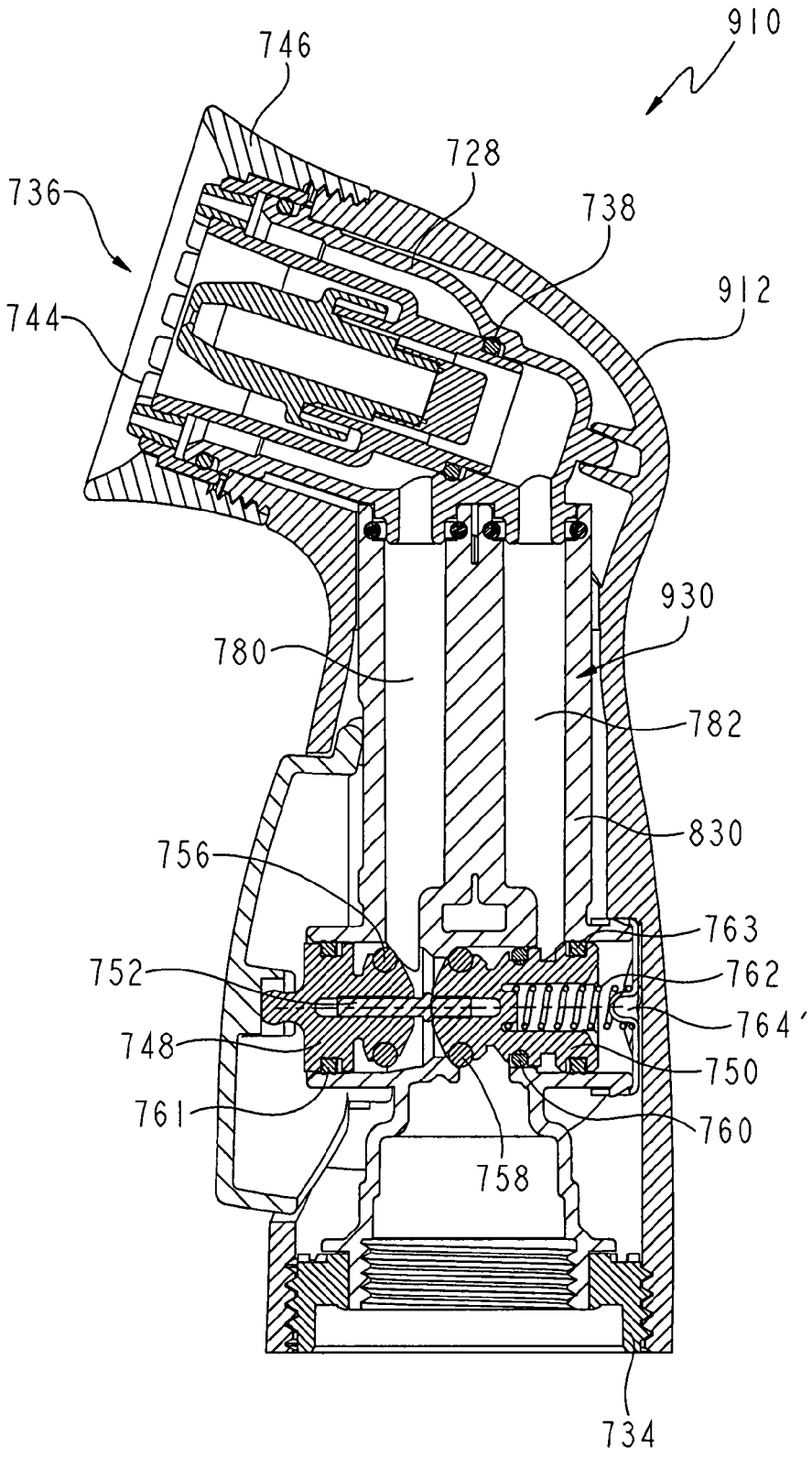
FIG. 54 is a cross-sectional view of the spray device of FIG. 53 in an off mode.

Another illustrative embodiment spray device 910 is shown in FIGS. 53 and 54 having a body 912. Like components of spray device 910 and spray device 710 are identified with the same reference numbers. Spray device 910 is similar to spray device 710, except that components 718, 722, 734, and 766 have been replaced with a single component 930 thereby reducing the number of components and the number of seals used. Further, hinge 776 of trigger 774 engages with an engagement member 932 of component 930. In addition, peg 764' is clipped to component 930.

Figure 55:
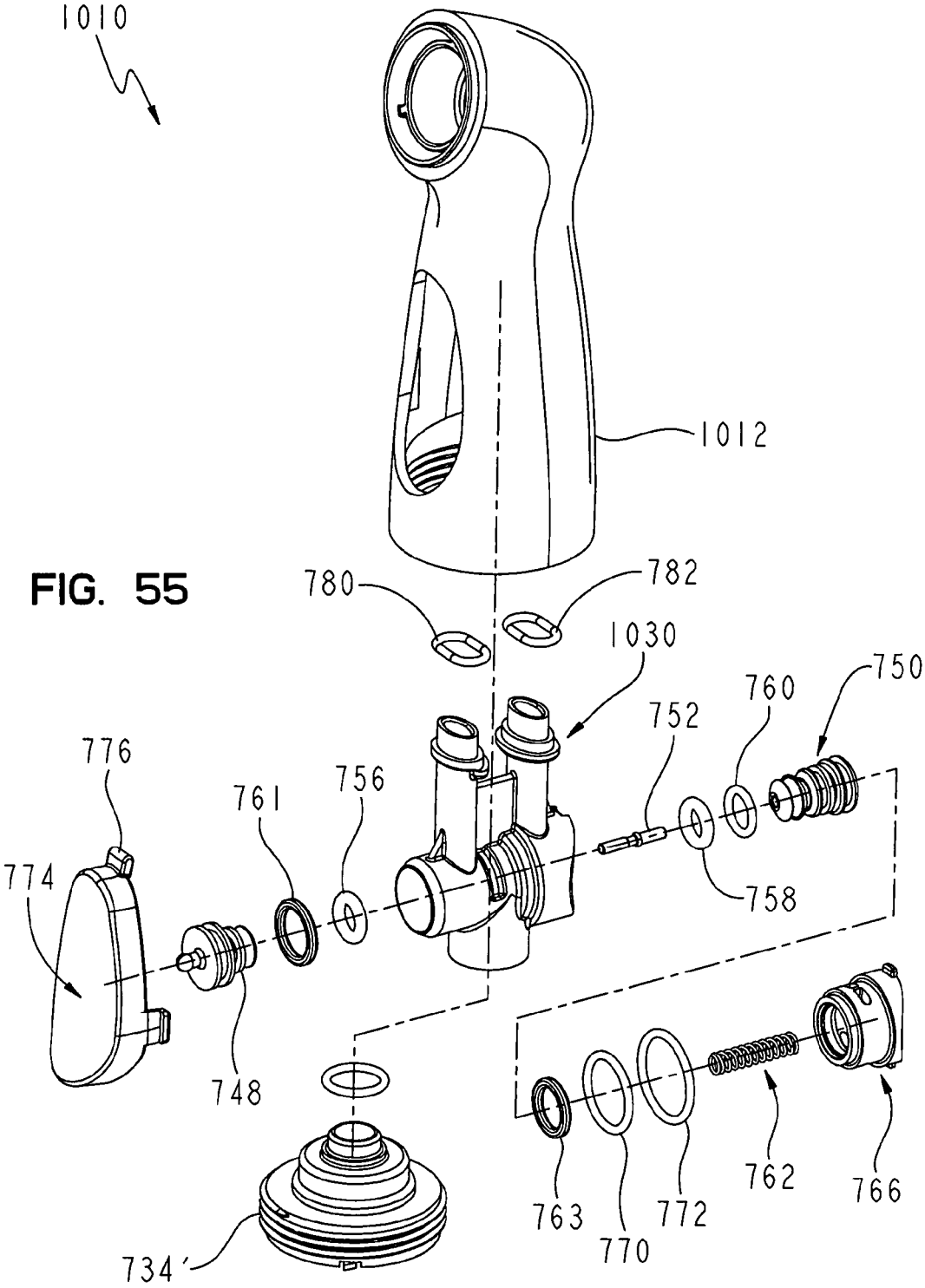
FIG. 55 is an exploded perspective view of yet another illustrative embodiment spray device.
Figure 56:
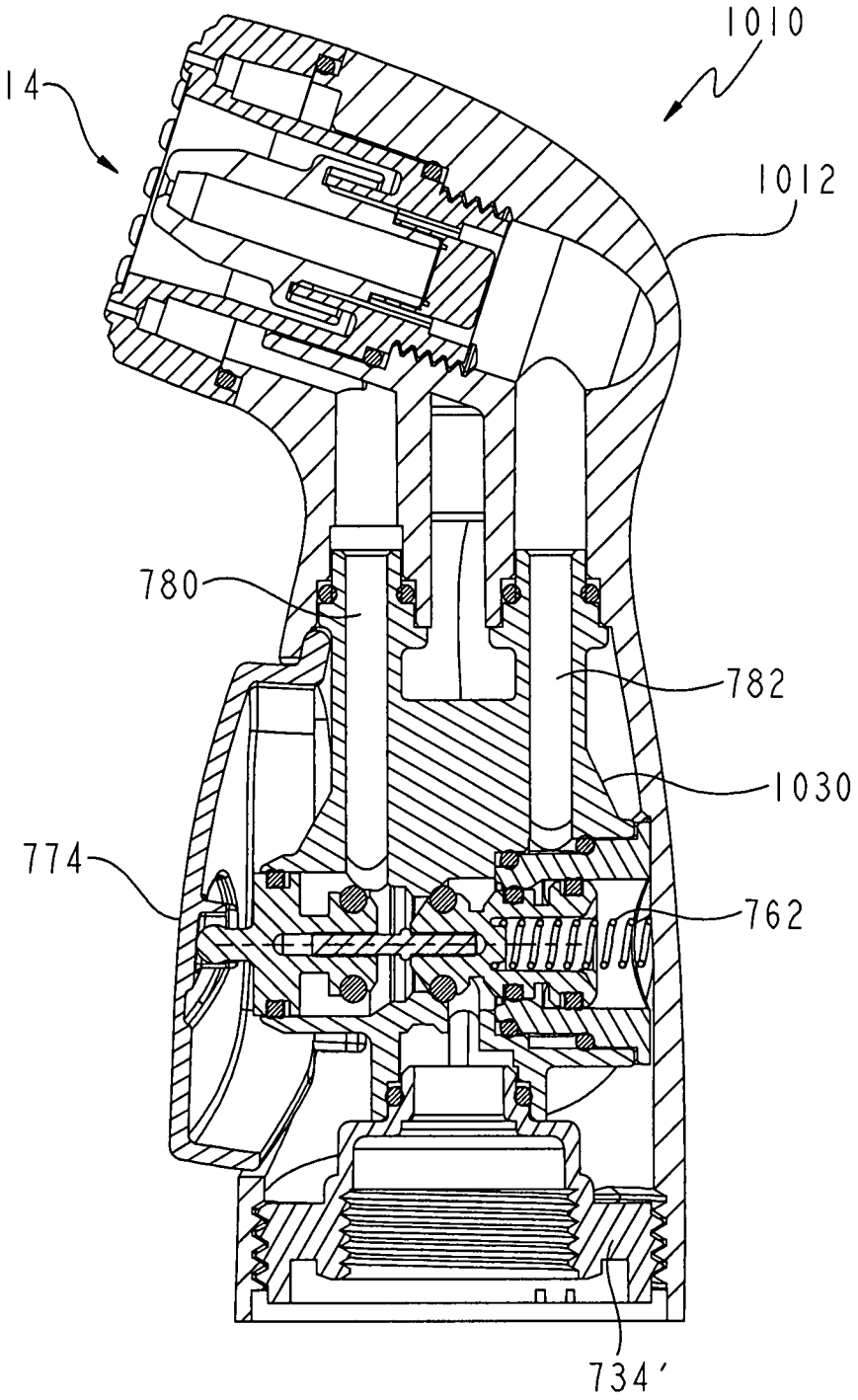
FIG. 56 is a cross-sectional view of the spray device of FIG. 53 in an off mode.

Another illustrative embodiment spray device 1010 is shown in FIGS. 55 and 56 having a body 1012. Like components of spray device 1010 and spray device 710 are identified with the same reference numbers. Spray device 1010 is similar to spray device 710, except that components 718 and 722 have been replaced with a single component 1030 thereby reducing the number of components and the number of seals used. Further spray device 1010 includes spray head 14.

Figure 59:
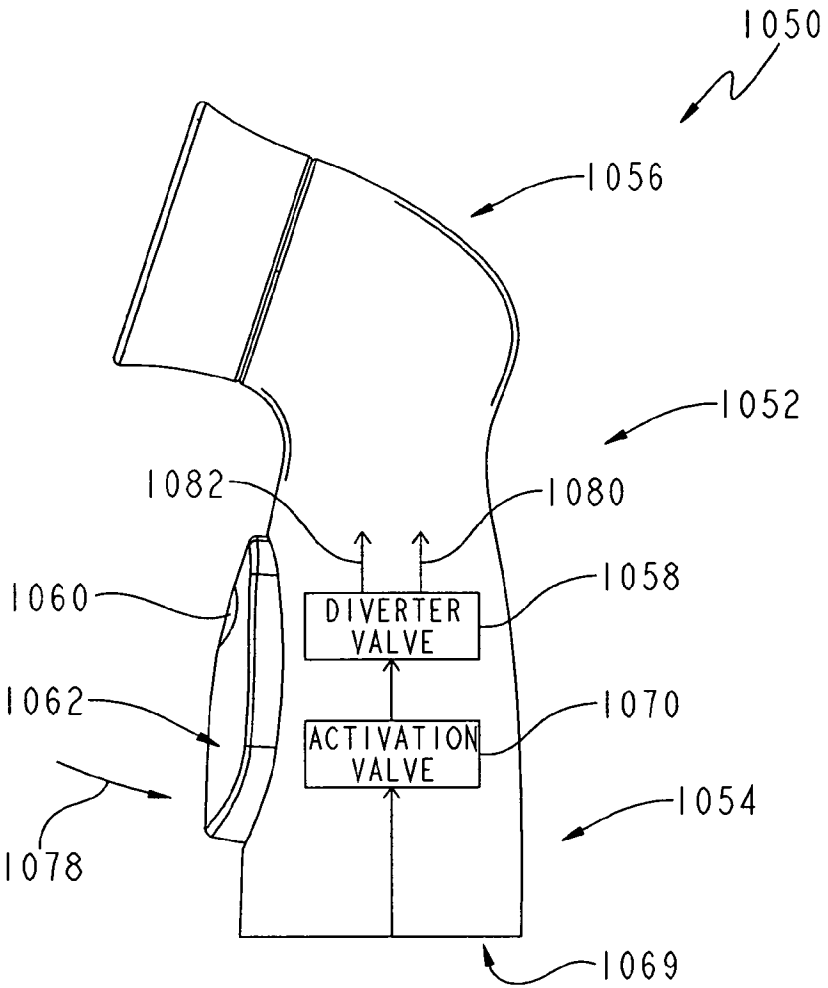
FIG. 59 is a front view of the spray device of FIG. 58.
Figure 58:
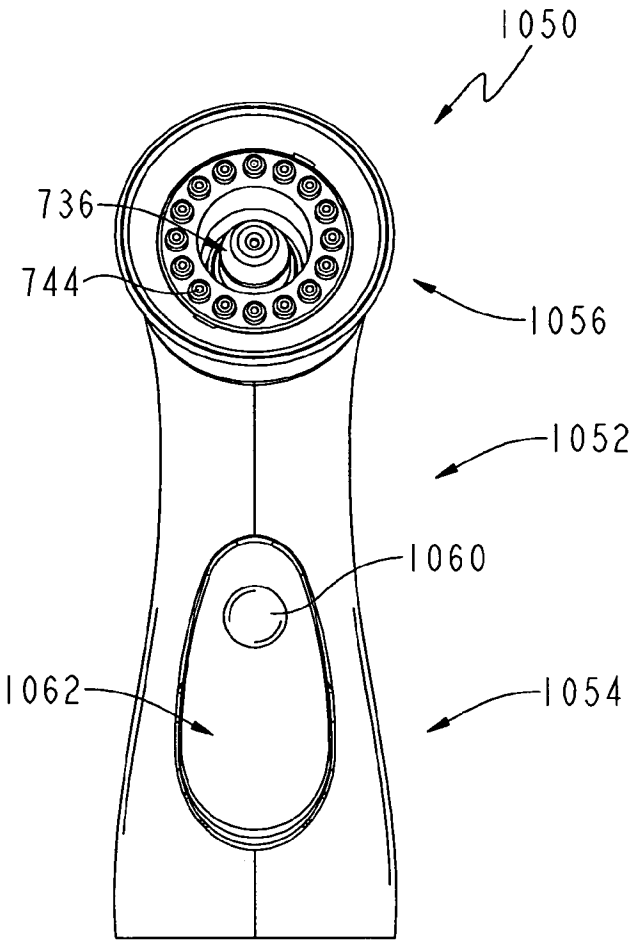
FIG. 58 is a side view of yet a further illustrative embodiment spray device.

Another illustrative embodiment spray device 1050 is shown in FIG. 58 and FIG. 59. Spray device 1050 includes a body 1052 having a grip portion 1054 and a head portion 1056. Spray device 1050 operates generally the same as spray 10, except that the input to a diverter valve 1058, such as diverter valve 24, is provided on a button 1060 which is carried by trigger 1062. In one embodiment, button 1060 is a membrane button.

Trigger 1062 is rotatably coupled to body 1052 and operates an activation valve 1070, such as activation valve 22, which controls the provision of water from the water inlet 1069 to diverter valve 1058 and onto one of cartridge assembly 736 (stream mode) or spray outlets 744 (spray mode). When trigger 1062 is in an off position as illustrated in FIG. 58, activation valve 1070 is in a closed position such that water is not provided to diverter valve 1058. In one embodiment, when trigger 1062 is in the off position button 1060 is spaced apart relative to diverter valve 1058 such that an operator is unable to actuate diverter valve 1058.

As trigger 1062 is rotated in direction 1078, activation valve 1070 is opened and water is provided to diverter valve 1058. In one embodiment, diverter valve 1058 is in a spray mode absent an input from the operator, such as diverter valve 24 in FIG. 5. In one embodiment, as trigger 1062 rotates in direction button 1060 comes into proximity with and/or contacts diverter valve 1058 such that a user by depressing button 1060 is able to actuate diverter valve 1058 to cause the water to be presented to cartridge assembly 736 through fluid conduit 1080 as opposed to spray outlets 744 through fluid conduit 1082.

Figure 57:
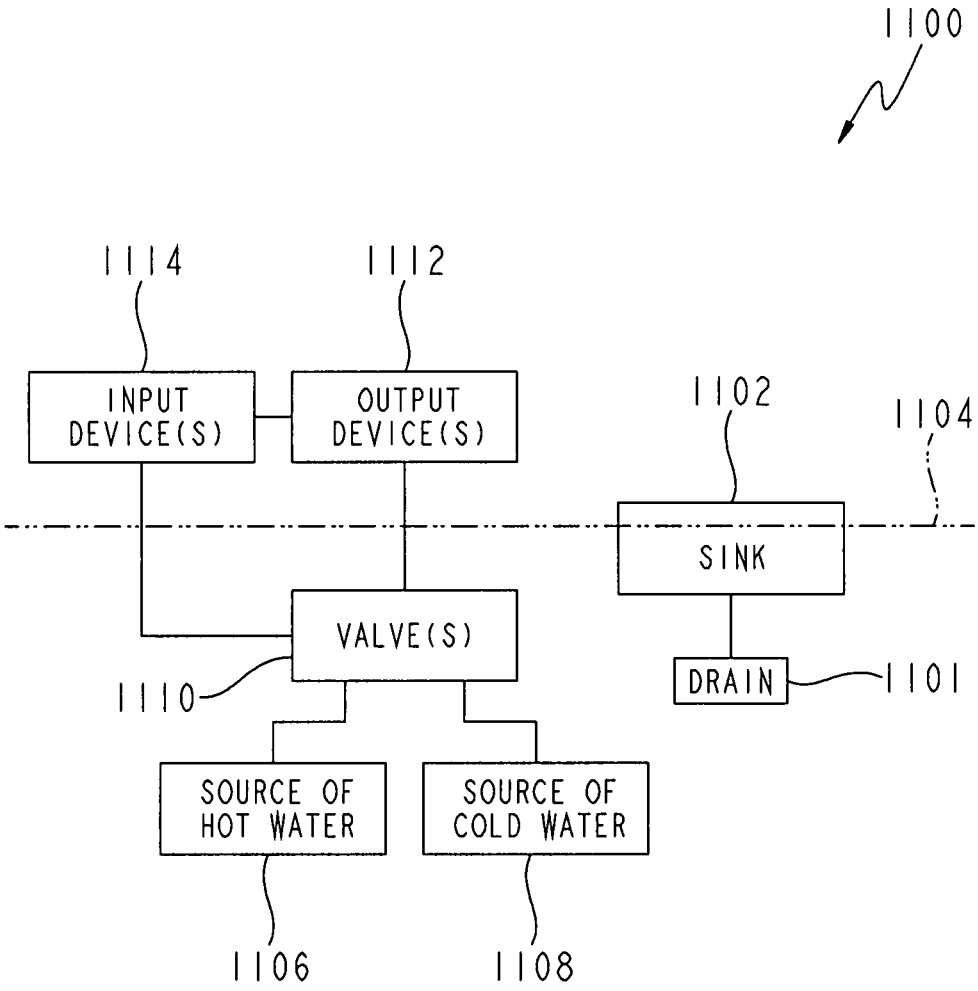
FIG. 57 is a diagrammatic view of an exemplary water delivery system.

As illustrated in FIG. 57, the spray devices discussed herein may be used as apart of a water delivery system 1100, such as a faucet, for use with a sink 1402 having a drain 1101 or other device, residential or commercial, associated with a drain. Sink 1102 is shown being coupled to a countertop 1104. The countertop 1104 and a top portion of the sink 1102 are collectively referred to as the sink deck. Water delivery system 1100 is coupled to a source of hot water 1106 and a source of cold water 1108. Water from the source of hot water 1106 and source of cold water 1108 are provided to one or more valves 1110 which may be adjusted to regulate the flow of water there through.

In one embodiment, the source of hot water 1106 and the source of cold water 1108 are both in fluid communication with a single mixing valve which regulates the flow rate of water from each source 1106, 1108 which is to be provided to an output device 1112, if any depending on the water characteristics desired. For instance, only hot water may be desired so the valve would only pass water from the source of hot water 1106. In another embodiment, the source of hot water 1106 and the source of cold water 1108 are each in fluid communication with a respective valve; each valve regulating the flow of water to be provided to the output device 1112 from the respective source of water in fluid communication with the valve. Valve 1110 may be positioned above the sink deck or below the sink deck.

The control of valve 1110 is through one or more input devices 1114. Exemplary input devices 1114 include both mechanical input devices, such as handles, and electronic input devices, such as a touch sensor or an infrared sensor, which provide an indication to a controller of the water characteristics desired. In one example, the controller adjusts valve 1110 through a motor coupled to valve.

Exemplary output devices 1112 include a spout having a spray head coupled thereto. The spout may be rigid or may have a flexible portion. In one embodiment, spray head is a swivel head attached to the end of a spout base member. Any of the spray devices disclosed herein may be used as a swivel head. In one embodiment, spray head is a pull out wand which is attached to a spout base member. Any of the spray devices disclosed herein may be used as a pull-out wand. The pull out wand having a first position generally coupled to spout base member and a second position wherein the wand is spaced apart from the spout base member and connected thereto through a waterway connecting the two. In another exemplary embodiment, any of the spray devices disclosed herein may be an output device 1112 which is a side spray. In one embodiment, the side spray which may be coupled to the sink deck and is in fluid communication with valve 1110. In one example, the side spray is in fluid communication with valve 1110 independent of a spout.

In one embodiment, water delivery system 1100 is associated with a bathtub, a shower, or other receptacle having an associated drain, such as drain 1101 associated with sink 1102 in FIG. 57. As such, the spray devices disclosed herein may be used as a hand-held spray device with a bathtub or shower.

In one embodiment, each of the spray devices disclosed herein are configured to permit water to be provided to the first water outlet and the second water outlet simultaneously. As an example the spacing from seal 756 from its respective valve seat in valve assembly 720 may be adjusted such that flow is permitted to both fluid conduits 780 and 782 in a third position wherein water is provided to the first water outlet, such as a spray, and a second water outlet, such as a stream, as valve assembly 720 moves from spray position (see FIG. 47) to a stream position (see FIG. 48)

Although the invention has been described in detail with reference to certain preferred embodiments, variations and modifications exist within the spirit and scope of the invention as described and defined in the following claims.

The invention claimed is:

1. A spray device, comprising:

a body having a water inlet and a first water outlet in fluid communication with the water inlet and a second water outlet in fluid communication with the water inlet, the body including a head portion having the first water outlet and the second water outlet and a grip portion;

an actuator supported by the body and having an actuation point, the actuator being moveable relative to the body; and a valve assembly positioned in the grip portion of the body, the valve assembly including a first diverter and a second diverter coupled to the first diverter for simultaneous linear movement relative to the body and being operably coupled to the actuator, wherein in a first position the valve assembly blocks water from the water inlet reaching the first water outlet and the second water outlet when the actuator is in a first position, the valve assembly translates linearly to a second position when the actuator is moved to a second position and permits water from the water inlet to reach the first water outlet by flowing through a passageway between the first diverter and the second diverter, and the second diverter blocks water from the water inlet reaching the second water outlet when the valve assembly is in the second position, and the valve assembly translates linearly to a third position when the actuator is moved to a third position and the first diverter blocks water from the water inlet reaching the first water outlet and permits water from the water inlet to reach the second water outlet by flowing through a passageway between the first diverter and the second diverter when the valve assembly is in the third position, wherein applying a continuous force to the actuator at the actuation point sequentially translates the valve assembly from the first position to the second position, and from second position to the third position.

2. The spray device of claim 1, wherein the actuator is rotatable relative to the body, the actuator being a trigger.

3. The spray device of claim 1, further comprising a first fluid conduit being disposed within the body, the first fluid conduit being in fluid communication with the water inlet and the first water outlet; and a second fluid conduit being disposed within the body, the second fluid conduit being in fluid communication with the water inlet and the second water outlet, wherein the valve assembly blocks water from the water inlet reaching the first fluid conduit and the second fluid conduit when the actuator is in a first position, permits water from the water inlet to reach the first fluid conduit and blocks water from the water inlet reaching the second fluid conduit when the actuator is in a second position, and blocks water from the water inlet reaching the first fluid conduit and permits water from the water inlet to reach the second fluid conduit when the actuator is in a third position.

4. The spray device of claim 3, wherein the valve assembly includes a first piston, a second piston, and a link connecting the first piston and the second piston.

5. The spray device of claim 4, wherein the first fluid conduit and the second fluid conduit are disposed in an insert that is received in a cavity in the body, the valve assembly being positioned within a cavity of the insert.

6. The spray device of claim 5, wherein the valve assembly includes a first seal carried by the first piston, a second seal carried by the second piston, and a third seal carried by the second piston, the first seal and the cavity of the insert cooperating to regulate the flow of water from the water inlet to the first fluid outlet, the second seal and the cavity of the insert cooperating to regulate the flow of water from the water inlet to the first fluid outlet, and the third seal and the cavity of the insert cooperating to regulate the flow of water from the water inlet to the second fluid outlet.

7. The spray device of claim 1, wherein the first water outlet includes a plurality of outlets arranged to provide a spray configuration.

8. The spray device of claim 1, wherein the second water outlet includes at least a first outlet which provides a stream configuration.

9. The spray device of claim 1, wherein the valve assembly includes a first seal for blocking water from the second water outlet when the actuator is in the second position, and a second seal for blocking water from the first water outlet when the actuator is in the third position, the first seal fixed from moving relative to the second seal.

10. A spray device, comprising:

a body having a water inlet and a first water outlet in fluid communication with the water inlet and a second water outlet in fluid communication with the water inlet, the body including a head portion having the first water outlet and the second water outlet and a grip portion;

an actuator supported by the body and having an actuation point, the actuator being moveable relative to the body;

a valve assembly positioned in the grip portion of the body, being translatable relative to the body and being operably coupled to the actuator, wherein in a first position the valve assembly blocks water from the water inlet reaching the first water outlet and the second water outlet when the actuator is in a first position, the valve assembly translates to a second position and permits water from the water inlet to reach the first water outlet and blocks water from the water inlet reaching the second water outlet when the actuator is in a second position, and the valve assembly translates to a third position and blocks water from the water inlet reaching the first water outlet and permits water from the water inlet to reach the second water outlet when the actuator is in a third position, wherein applying a continuous force to the actuator at the actuation point sequentially translates the valve assembly from the first position to the second position, and from the second position to the third position;

a first fluid conduit being disposed within the body, the first fluid conduit being in fluid communication with the water inlet and the first water outlet;

a second fluid conduit being disposed within the body, the second fluid conduit being in fluid communication with the water inlet and the second water outlet, wherein the valve assembly blocks water from the water inlet reaching the first fluid conduit and the second fluid conduit when the actuator is in a first position, permits water from the water inlet to reach the first fluid conduit and blocks water from the water inlet reaching the second fluid conduit when the actuator is in a second position, and blocks water from the water inlet reaching the first fluid conduit and permits water from the water inlet to reach the second fluid conduit when the actuator is in a third position;

wherein the valve assembly includes a first piston, a second piston, and a link connecting the first piston and the second piston;

wherein the first fluid conduit and the second fluid conduit are disposed in an insert that is received in a cavity in the body, the valve assembly being positioned within a cavity of the insert;

wherein the valve assembly includes a first seal carried by the first piston, a second seal carried by the second piston, and a third seal carried by the second piston, the first seal and the cavity of the insert cooperating to regulate the flow of water from the water inlet to the first fluid outlet, the second seal and the cavity of the insert cooperating to regulate the flow of water from the water inlet to the first fluid outlet, and the third seal and the cavity of the insert cooperating to regulate the flow of water from the water inlet to the second fluid outlet; and wherein when the actuator is in the first position, the first seal is spaced apart from a first valve seat, the second seal is contacting a second valve seat, and the third seal is contacting the third valve seat; when the actuator is in the second position, the first seal is spaced apart from the first valve seat, the second seal is spaced apart from the second valve seat, and the third seal is contacting the third valve seat; and when the actuator is in the third position, the first seal is contacting the first valve seat, the second seal is spaced apart from the second valve seat, and the third seal is spaced apart from the third valve seat.

11. The spray device of claim 10, wherein the relative spacing of the first seal, the second seal, and the third seal is constant as the actuator moves from the first position to the third position.

12. The spray device of claim 11, wherein the first piston and the second piston are translatable relative to the insert and the actuator is rotatable relative to the body.

13. A spray device, comprising:

a body having a water inlet and a first water outlet in fluid communication with the water inlet and a second water outlet in fluid communication with the water inlet, the body including a head portion having the first water outlet and the second water outlet and a grip portion;

an actuator supported by the body and having an actuation point, the actuator being moveable relative to the body;

a valve assembly positioned in the grip portion of the body, being translatable relative to the body and being operably coupled to the actuator, wherein in a first position the valve assembly blocks water from the water inlet reaching the first water outlet and the second water outlet when the actuator is in a first position, the valve assembly translates to a second position and permits water from the water inlet to reach the first water outlet and blocks water from the water inlet reaching the second water outlet when the actuator is in a second position, and the valve assembly translates to a third position and blocks water from the water inlet reaching the first water outlet and permits water from the water inlet to reach the second water outlet when the actuator is in a third position, wherein applying a continuous force to the actuator at the actuation point sequentially translates the valve assembly from the first position to the second position, and from the second position to the third position;

wherein the second water outlet includes a first outlet which provides a stream configuration; and wherein the second water outlet further includes a second outlet which provides a continuous sheet which surrounds the stream configuration of the first outlet.

14. A spray device, comprising:

a body having a water inlet and a first water outlet in fluid communication with the water inlet and a second water outlet in fluid communication with the water inlet, the body including a head portion having the first water outlet and the second water outlet and a grip portion;

an actuator supported by the body, the actuator being moveable relative to the body; and a valve assembly positioned in the grip portion and actuated by a movement of the actuator, the valve assembly including a first piston and a second piston coupled to the first piston for simultaneous linear movement along a longitudinal axis, a first seal concentrically supported by the first piston and a second seal concentrically supported by the second piston, the first seal and the second seal positionable in a plurality of positions such that the valve assembly in a first position is configured to permit the flow of water from the water inlet, through a passageway between the first seal and the second seal, to the first water outlet while the second seal blocks flow to the second water outlet, the valve assembly in a second position is configured to permit the flow of water from the water inlet, through a passageway between the first seal and the second seal, to the second water outlet while the first seal blocks flow to the first water outlet, and the valve assembly in a third position is configured to block the flow of water from the water inlet to the first water outlet and the second water outlet, each of the first seal and the second seal surrounding the longitudinal axis of the valve assembly and wherein the first seal maintains its spacing relative to the second seal.

15. The spray device of claim 14, further comprising an insert positioned within the body, the insert having a first fluid conduit in fluid communication with the first water outlet, a second fluid conduit in fluid communication with the second water outlet, a third fluid conduit in fluid communication with the water inlet, and a cavity in fluid communication with the first fluid conduit, the second fluid conduit, and the third fluid conduit, the valve assembly being disposed within the cavity.

16. The spray device of claim 15, further comprising a retaining ring coupled to the body, the retaining ring positioning the insert.

17. The spray device of claim 16, wherein the insert is comprised of an integral body.

18. The spray device of claim 16, wherein the insert includes an upper portion and a lower portion, the upper portion and the lower portion being coupled together.

19. The spray device of claim 14, wherein the valve assembly includes a link extending along the longitudinal axis and connecting the first piston and the second piston.

20. The spray device of claim 14, wherein the actuator is configured to sequentially translate the valve assembly between the third position, the second position, and the first position.

* * * * *